US010784583B2

(12) United States Patent
Tayfeh Aligodarz et al.

(10) Patent No.: US 10,784,583 B2
(45) Date of Patent: Sep. 22, 2020

(54) DIELECTRIC RESONATOR ANTENNA ARRAYS

(71) Applicant: University of Saskatchewan, Saskatoon (CA)

(72) Inventors: Mohammadreza Tayfeh Aligodarz, Saskatoon (CA); David Klymyshyn, Saskatoon (CA); Atabak Rashidian, Winnipeg (CA); Xun Liu, Aurora (CA)

(73) Assignee: University of Saskatchewan, Saskatoon, Saskatchewan (CA)

( * ) Notice: Subject to any disclaimer, the term of this patent is extended or adjusted under 35 U.S.C. 154(b) by 573 days.

(21) Appl. No.: 15/105,294

(22) PCT Filed: Dec. 19, 2014

(86) PCT No.: PCT/CA2014/000905
§ 371 (c)(1),
(2) Date: Jun. 16, 2016

(87) PCT Pub. No.: WO2015/089643
PCT Pub. Date: Jun. 25, 2015

(65) Prior Publication Data

US 2016/0322708 A1 Nov. 3, 2016

Related U.S. Application Data

(60) Provisional application No. 61/919,254, filed on Dec. 20, 2013.

(51) Int. Cl.
*H01Q 9/04* (2006.01)
*H01Q 21/06* (2006.01)
(Continued)

(52) U.S. Cl.
CPC ..... *H01Q 9/0485* (2013.01); *H01P 5/12* (2013.01); *H01Q 1/50* (2013.01); *H01Q 21/0087* (2013.01); *H01Q 21/06* (2013.01)

(58) Field of Classification Search
CPC ..... H01P 5/12; H01Q 21/06; H01Q 9/0485; H01Q 1/50; H01Q 21/0087
See application file for complete search history.

(56) References Cited

U.S. PATENT DOCUMENTS 4,907,012 A 3/1990 Trumble
5,940,036 A 8/1999 Oliver et al.
(Continued)

FOREIGN PATENT DOCUMENTS

CN 1653647 A 8/2005
CN 101593866 A 12/2009
(Continued)

OTHER PUBLICATIONS

Rashidian, Photoresist-Based Polymer Resonator Antenn as (PRAS) With Lithographic Fabrication and Dielectric Resonator Antennas (DRAS) With Improved Performance, Apr. 2011, University of Saskatchewan Saskatoon (Year: 2011).*
(Continued)

*Primary Examiner* — Graham P Smith
*Assistant Examiner* — Jae K Kim
(74) *Attorney, Agent, or Firm* — Bereskin & Parr LLP/S.E.N.C.R.L., s.r.l.; Stephen Beney; Paul R. Horbal

(57) ABSTRACT

Arrays of low permittivity Polymer-based Resonator Antenna elements with different configurations. Individual array elements can be fabricated with complicated geometries; these elements can be assembled into complicated patterns as a single monolithic fabricated structure using narrow wall connecting structures, which removes the requirement to position and assemble the array elements. Monolithic array structures can be assembled as sub-arrays in larger array structures. Elements, sub-arrays, and arrays can also be formed by inserting dielectric materials into cavities defining their lateral geometries, and fabricated in
(Continued)

polymer templates. The polymer templates can be removed or retained to function as part of the antenna. Effective excitation is achieved by one of a number of coupling methods, including standing metal strip feeding on the vertical sides of the elements, feeding by tall metal transmission lines in contact or in close proximity to the vertical sides of the elements, modified microstrip feeding, or aperture feeding by using a slot in the metal plane underneath the elements. The wideband array feeds are realized by optimized transmission line distribution networks which include wideband matching sections.

27 Claims, 69 Drawing Sheets

(51) Int. Cl.

| | |
|---|---|
| ***H01Q 21/00*** | (2006.01) |
| ***H01Q 1/50*** | (2006.01) |
| ***H01P 5/12*** | (2006.01) |

(56) References Cited

U.S. PATENT DOCUMENTS

| | | | | |
|---|---|---|---|---|
| 5,952,972 | A | 9/1999 | Ittipiboon et al. | |
| 6,198,450 | B1 | 3/2001 | Adachi et al. | |
| 6,323,818 | B1 | 11/2001 | Koh et al. | |
| 6,323,824 | B1 | 11/2001 | Heinrichs et al. | |
| 6,452,565 | B1 | 9/2002 | Kingsley et al. | |
| 6,512,494 | B1 | 1/2003 | Diaz | |
| 6,556,169 | B1 | 4/2003 | Fukuura et al. | |
| 6,833,816 | B2 | 12/2004 | Hilgers | |
| 6,952,190 | B2 | 10/2005 | Lynch et al. | |
| 7,196,663 | B2 | 3/2007 | Bolzer et al. | |
| 7,292,204 | B1 | 11/2007 | Chang et al. | |
| 7,443,363 | B2 | 10/2008 | Ying | |
| 7,541,998 | B1 | 6/2009 | Chang et al. | |
| 7,570,219 | B1 | 8/2009 | Paulsen et al. | |
| 7,667,666 | B2 | 2/2010 | Chang et al. | |
| 7,940,228 | B1 | 5/2011 | Buckley | |
| 8,259,032 | B1 | 9/2012 | Buckley | |
| 9,374,887 | B1 | 6/2016 | Warne et al. | |
| 9,810,823 | B2 | 11/2017 | Girard Desprolet et al. | |
| 2002/0024466 | A1 | 2/2002 | Masuda | |
| 2002/0181646 | A1 | 12/2002 | Mehldau | |
| 2003/0011518 | A1 | 1/2003 | Sievenpiper et al. | |
| 2003/0052834 | A1 | 3/2003 | Sievenpiper et al. | |
| 2004/0119646 | A1 | 6/2004 | Ohno et al. | |
| 2004/0130489 | A1 | 7/2004 | Le Bolzer et al. | |
| 2004/0239453 | A1* | 12/2004 | Sasada | H01P 7/10 333/219.1 |
| 2005/0030137 | A1 | 2/2005 | McKinzie, III et al. | |
| 2005/0057402 | A1 | 3/2005 | Ohno et al. | |
| 2005/0062673 | A1 | 3/2005 | Wu et al. | |
| 2005/0074961 | A1 | 4/2005 | Beyer et al. | |
| 2005/0200540 | A1 | 9/2005 | Isaacs et al. | |
| 2006/0092079 | A1 | 5/2006 | de Rochemont | |
| 2006/0199380 | A1 | 9/2006 | Liu et al. | |
| 2006/0232474 | A1 | 10/2006 | Fox | |
| 2006/0267029 | A1 | 11/2006 | Li | |
| 2007/0064760 | A1 | 3/2007 | Kragh | |
| 2007/0152884 | A1 | 7/2007 | Bouche et al. | |
| 2007/0182640 | A1 | 8/2007 | Oohira | |
| 2007/0222699 | A1 | 9/2007 | Modro | |
| 2007/0236406 | A1 | 10/2007 | Wen et al. | |
| 2008/0001843 | A1 | 1/2008 | Wu et al. | |
| 2008/0018391 | A1 | 1/2008 | Bates | |
| 2008/0042903 | A1 | 2/2008 | Cheng | |
| 2008/0048915 | A1 | 2/2008 | Chang et al. | |
| 2008/0129616 | A1 | 6/2008 | Li et al. | |
| 2008/0129617 | A1 | 6/2008 | Li et al. | |
| 2008/0129626 | A1 | 6/2008 | Wu et al. | |
| 2008/0272963 | A1 | 11/2008 | Chang et al. | |
| 2008/0286554 | A1 | 11/2008 | Schwanke et al. | |
| 2009/0028910 | A1 | 1/2009 | DeSimone et al. | |
| 2009/0073332 | A1 | 3/2009 | Irie | |
| 2009/0102739 | A1 | 4/2009 | Chang et al. | |
| 2009/0174609 | A1 | 7/2009 | Sanada | |
| 2009/0184875 | A1 | 7/2009 | Chang et al. | |
| 2009/0278754 | A1 | 11/2009 | Tanielian et al. | |
| 2010/0053013 | A1 | 3/2010 | Konishi et al. | |
| 2010/0073232 | A1 | 3/2010 | Sajuyigbe et al. | |
| 2010/0103052 | A1 | 4/2010 | Ying | |
| 2010/0127596 | A1 | 5/2010 | Ayazi et al. | |
| 2010/0127798 | A1 | 5/2010 | Ayazi et al. | |
| 2010/0147365 | A1 | 6/2010 | DeSimone et al. | |
| 2010/0156754 | A1 | 6/2010 | Kondou | |
| 2011/0057853 | A1 | 3/2011 | Kim et al. | |
| 2011/0133991 | A1 | 6/2011 | Lee et al. | |
| 2011/0248890 | A1 | 10/2011 | Lee et al. | |
| 2011/0248891 | A1 | 10/2011 | Han et al. | |
| 2012/0026054 | A1 | 2/2012 | Liu et al. | |
| 2012/0242556 | A1 | 9/2012 | Ando | |
| 2012/0245016 | A1 | 9/2012 | Curry et al. | |
| 2013/0002520 | A1 | 1/2013 | Choi et al. | |
| 2013/0088396 | A1 | 4/2013 | Han | |
| 2013/0127669 | A1 | 5/2013 | Han et al. | |
| 2013/0234898 | A1* | 9/2013 | Leung | H01Q 1/36 343/700 R |
| 2014/0043124 | A1 | 2/2014 | Liu et al. | |
| 2014/0062824 | A1 | 3/2014 | Yamaguchi et al. | |
| 2014/0111400 | A1 | 4/2014 | Latrach et al. | |
| 2014/0118217 | A1 | 5/2014 | Cannon et al. | |
| 2014/0118218 | A1 | 5/2014 | Jordan et al. | |
| 2014/0327597 | A1 | 11/2014 | Rashidian et al. | |
| 2015/0380824 | A1 | 12/2015 | Tayfeh Aligodarz et al. | |
| 2016/0111769 | A1 | 4/2016 | Pance et al. | |
| 2016/0218437 | A1 | 7/2016 | Guntupalli et al. | |
| 2016/0294068 | A1 | 10/2016 | Djerafi et al. | |
| 2017/0365920 | A1 | 12/2017 | Mukai et al. | |

FOREIGN PATENT DOCUMENTS

| | | | | |
|---|---|---|---|---|
| CN | 101710650 | A | 5/2010 | |
| CN | 103337714 | A | 10/2013 | |
| EP | 0 801 436 | A2 | 10/1997 | |
| EP | 0801436 | A2 * | 10/1997 | H01Q 9/0485 |
| EP | 1 767 582 | B1 | 3/2012 | |
| GB | 2396747 | A | 6/2004 | |
| WO | 01/031746 | A1 | 5/2001 | |
| WO | 2003/098737 | A1 | 11/2003 | |
| WO | 2007/147446 | A1 | 12/2007 | |
| WO | 2009/004361 | A1 | 1/2009 | |
| WO | 2013/016815 | A1 | 2/2013 | |
| WO | 2014/117259 | A1 | 7/2014 | |
| WO | 2015/000057 | A1 | 1/2015 | |
| WO | 2015/089643 | A1 | 6/2015 | |

OTHER PUBLICATIONS

ZainalArifin Ahmad; Mohd Fadzil Bin Ain ; Ubaid Ullah ; Seyi Stephen Olokede; "Dual-segment corporate feed four elements array antenna for broadband application"; Date of Conference: Aug. 27-29, 2012; 2012 IEEE Asia-Pacific Conference on Antennas and Propagation (Year: 2012).*

Office Action dated Oct. 24, 2017 in related U.S. Appl. No. 14/764,764.

Non-final Office Action and Notice of References Cited dated Nov. 15, 2017 in related U.S. Appl. No. 14/235,595.

Examiner's Report dated Nov. 13, 2018 in related CA Patent Application No. 2,843,415.

International Search Report and Written Opinion dated Mar. 12, 2015 in corresponding International Patent Application No. PCT/CA2014/000905.

International Preliminary Report on Patentability dated Jun. 21, 2016 in corresponding International Patent Application No. PCT/CA2014/000905.

Mohd, et al., "Dual-segment corporate feed four elements array antenna for broadband application", In IEEE Asia-Pacific Confer-

(56) References Cited

OTHER PUBLICATIONS ence on Antennas and Propagation (APCAP), 2012, Singapore, 4 pages.
Haneishi, et al., "Array Antenna Composed of Circularly Polarized Dielectric Resonator Antennas", In IEEE Antennas & Propagation Society International Symposium, 1999, Orlando, FL, pp. 252-255.
Extended European Search Report dated Jun. 21, 2017 in corresponding EP Patent Application No. 14871362.1.
Klymyshyn, et al., "Photoresist-based Resonator Antenna Array", In Proceedings of the 6th German Microwave Conference, 2011, Darmstadt, Germany, 3 pages.
Rashidian, et al., "Deep x-ray lithography processing for batch fabrication of thick polymer-based antenna structures", Journal of Micromechanics and Microengineering, 2010, 20(2): 1-11.
Rashidian, et al., "Photoresist-Based Polymer Resonator Antennas: Lithography Fabrication, Strip-Fed Excitation, and Multimode Operation", IEEE Antennas and Propagation Magazine, 2011, 53(4): 16-27.
First Office Action dated Jan. 13, 2015 in related CN Patent Application No. 2012800476924.
Second Office Action dated Aug. 20, 2015 in related CN Patent Application No. 2012800476924.
Extended European Search Report dated Mar. 11, 2015 in related EP Patent Application No. 12820623.2.
Petosa, et al., "Design and Analysis of Multisegment Dielectric Resonator Antennas", IEEE Transactions on Antennas and Propagation, 2000, 48(5): 738-742.
Smith, et al., "Microstrip-Fed Circular Substrate Integrated Waveguid (SIW) Cavity Resonator and Antenna", IEEE Antennas and Propagation Society International Symposium (APSURSI), 2010, Toronto, Ontario, Canada, 4 pages.
Rashidian, et al., "Development of Polymer-based Dielectric Resonator Antennas for Millimeter-Wave Applications", Progress in Electromagnetics Research C, 2010, vol. 13, pp. 203-216.
International Search Report and Written Opinion dated Sep. 24, 2012 in related International Patent Application No. PCT/CA2012/050391.
Non-final Office Action and Notice of References Cited dated May 26, 2016 in related U.S. Appl. No. 14/235,595.
Final Office Action and Notice of References Cited dated Jan. 4, 2017 in related U.S. Appl. No. 14/235,595.
"Photolithography", Wikipedia, 8 pages, 2016.
International Search Report and Written Opinion dated Apr. 30, 2014 in related International Patent Application No. PCT/CA2014/000074.
Sabah, "Multiband Metamaterials Based on Multiple Concentric Open-Ring Resonators Topology", IEEE Journal of Selected Topics in Quantum Electronics, 2013, 19(1): 8500808 (8 pages).
Kabiri, et al., "A Super-miniaturized Low Profile Antenna on a Substrate of Rose Curve Resonators", In Progress in Electromagnetics Research Symposium (PIERS) Proceedings, Marrakesh, Morocco, 2011, pp. 106-109.
Njoku, et al., "Effective Permittivity of Heterogeneous Substrates with Cubes in a 3-D Lattice", IEEE Antennas and Wireless Propagation Letters, 2011; 10: 1480-1483.
International Preliminary Report on Patentability dated Aug. 13, 2015 in related International Patent Application No. PCT/CA2014/000074.
Extended European Search Report dated Aug. 19, 2016 in related EP Patent Application No. 14746755.9.
Petosa, et al., "Dielectric Resonator Antennas: A Historical Review and the Current State of the Art", IEEE antennas and Propagation Magazine, 2010, 52(5): 91-116.
Rashidian, et al., "Photodefinable Microcomposites for Antenna Applications", In 2010 IEEE Antennas and Propagation Society International Symposium (APSURSI), Toronto, Ontario, Canada, 4 pages.
Rashidian, et al., "SU-8 Resonator Antenna", In 2010 IEEE Antennas and Propagation Society International Symposium (APSURSI), Toronto, Ontario, Canada, 4 pages.
Rashidian, et al., "Microwave Performance of Photoresist-Alumina Microcomposites for Batch Fabrication of Thick Polymer-Based Dielectric Structures", Journal of Micromechanics and Microengineering, 2012, 22(10): 1-9.
Rashidian, et al., "Strip-fed Excitation of Very Low Permittivity Dielectric Resonator Antennas", In the Asia-Pacific Microwave Conference (APMC), 2008, Macau, China, 4 pages.
Rashidian, et al., "A Novel Approach to Enhance the Bandwidth of Miniaturized Microstrip-fed Dielectric Resonator Antennas", In the 3rd European Conference on Antennas and Propagation (EuCAP), 2009, Berlin, Germany, 2 pages.
Rashidian, et al., "Very Low Permittivity Slot-fed Dielectric Resonator Antennas with Improved Bandwidth for Millimetre-wave Applications", In the 3rd European Conference on Antennas and Propagation (EuCAP), 2009, Berlin, Germany, 2 pages.
Sahbani, et al., "New Tunable Coplanar Microwave Phase Shifter With Nematic Crystal Liquid", In the 3rd International Design and Test Workshop, 2008, Monastir, Tunisia, pp. 78-81.
Weil, et al., "Highly-anisotropic liquid-crystal mixtures for tunable microwave devices", Electronics Letters, 2003; 39 (24): 1732-1734.
International Search Report and Written Opinion dated Oct. 2, 2014 in related International Patent Application No. PCT/CA2014/000535.
Chaudhary, et al., "Wideband Two-layer Rectangular Dielectric Resonator Antenna with (Zr0.8Sn0.2)TiO4-Epoxy Composite System", 2011 Indian Antenna Week (IAW), Kolkata, India, 4 pages.
Tayfeh Aligodarz, et al., "Polyester-styrene/Ceramic Nanocomposites for Antenna Applications", IEEE Antennas and Propagation Society International Symposium (APSURSI), Orlando, Florida, 2013, 2 pages.
Rashidian, et al., "A New Low-Loss and Efficient Excitation Method for Low-Permittivity Dielectric Resonator Antennas", IEEE Antennas and Propagation Society International Symposium (APSURSI), Chicago, Illinois, 2012, 2 pages.
Sabah, "Multiband Metamaterials Based on Multiple Concentric Open-Ring Resonators Topology", IEEE Journal of Selected Topics in Quantum Electronics, 2013, 19(1): 8500808 (16 pages).
Rashidian, "Photoresist-based polymer resonator antennas (PRAs) with lithographic fabrication and dielectric resonator antennas (DRAs) with improved performance", Ph.D. Thesis, University of Saskatchewan, Saskatoon, Canada, 2011, 188 pages.
Rashidian, et al., "Compact Wideband Multimode Dielectric Resonator Antennas Fed with Parallel Standing Strips", IEEE Transactions on Antennas and Propagation, 2012, 60(11): 5021-5031.
Rashidian, et al., "A Modified Microstrip Line for Excitation of Wide-Band Dielectric Resonator Antennas", 15th International Symposium on Antenna Technology and Applied Electromagnetics (ANTEM), Toulouse, France, 2012, 2 pages.
Rashidian, et al., "Low-Profile Dielectric Resonator Antennas for Millimeter-Wave Applications", 15th International Symposium on Antenna Technology and Applied Electromagnetics (ANTEM), Toulouse, France, 2012, 2 pages.
Rashidian, et al., "Dielectric Characterization of Materials using a Modified Microstrip Ring Resonator Technique", IEEE Transactions on Dielectrics and Electrical Insulation, 2012, 19(4): 1392-1399.
Tayfeh Aligodarz, "Air-Gap Standing Parallel Strips Waveguide for X-Ray Lithography Fabrication: Characteristics and Antenna Application", Proceedings of the 5th European Conference on Antennas and Propagation (EUCAP), Rome, Italy, 2011, pp. 1440-1443.
Hanemann, et al., "Development of new polymer-BaTiO3-composites with improved permittivity for embedded capacitors", Microsyst Technol., 2011, 17(2): 195-201.
Schumacher, et al., "Temperature treatment of nano-scaled barium titanate filler to improve the dielectric properties of high-k polymer based composites", Microelectronic Engineering, 2009, 87: 1978-1983.
Müller, et al., "Fabrication of ceramic microcomponents using deep X-ray lithography", Microsystem Technologies, 2005, 11(4-5): 271-277.
Notice of Allowance and Notice of References Cited dated Feb. 25, 2019 in related U.S. Appl. No. 14/764,764.

(56) References Cited

OTHER PUBLICATIONS

Examination Report dated Mar. 23, 2018 in related EP Patent Application No. 14746755.9.
Final Office Action and Notice of References Cited dated Jun. 26, 2018 in related U.S. Appl. No. 14/764,764.
Notices of Allowance and References Cited dated Apr. 1, 2019 in related U.S. Appl. No. 14/235,595.

* cited by examiner

2394

DIELECTRIC RESONATOR ANTENNA ARRAYS

FIELD

The embodiments described herein relate to microwave antenna arrays and, more particularly, to dielectric resonator antenna arrays.

BACKGROUND

Contemporary integrated antenna arrays are often based on thin planar metallic microstrip "patch" elements, which can occupy large lateral areas. Such an antenna element typically consists of a metallic strip or patch placed above a grounded substrate and generally fed through a coaxial probe or an aperture.

Recently, dielectric resonator antennas (DRAs) have attracted increased attention for miniaturized wireless and sensor applications at microwave frequencies. DRAs are three-dimensional structures with lateral dimensions that can be several times smaller than traditional planar patch antennas, and which may offer superior performance in terms of radiation efficiency and bandwidth.

DRAs are becoming increasingly important in the design of a wide variety of wireless applications from military to medical usages, from low frequency to very high frequency bands, and as elements in array applications. Compared to other low gain elements, for instance small metallic patch elements, DRA elements offer higher radiation efficiency (due to the lack of surface wave and conductor losses), larger impedance bandwidth, and compact size. DRAs also offer design flexibility and versatility. Different radiation patterns can be achieved using various geometries or resonance modes, wideband or compact antenna elements can be provided by different dielectric permittivities, and excitation of DRA elements can be achieved using a wide variety of feeding structures.

Despite the superior electromagnetic properties of DRAs, planar metallic antenna elements are still widely used for commercial microwave array applications, due to the relatively low fabrication cost and simple printed-circuit technology used to manufacture these antennas. Also, planar metallic antenna elements and arrays can be produced in arbitrary shapes by lithographic processes while DRA elements have been mostly limited to simple structures (such as rectangular and circular shapes), and must be manually assembled into arrays involving individual element placement and bonding to the substrate. Generally, DRA arrays are more difficult to make using well-known automated manufacturing processes.

SUMMARY

In a broad aspect, there is provided a dielectric resonator antenna array comprising: a substrate with a first planar surface; a plurality of dielectric resonator bodies disposed on the first planar surface of the substrate, wherein each of the resonator bodies is spaced apart from each other; a plurality of coupling structures, each of the coupling structures operatively coupled to a respective one of the resonator bodies to provide an excitation signal thereto; and a signal distribution structure operatively coupled to the plurality of coupling structures to provide the excitation signal thereto.

In some cases, the signal distribution structure comprises a plurality of feedlines, each of the feedlines operatively coupled to at least one of the coupling structures.

In some cases, the signal distribution structure further comprises at least one transmission line.

In some cases, each of the resonator bodies is connected to at least one other of the resonator bodies via a wall structure.

In some cases, the resonator bodies form a single monolithic structure.

In some cases, the resonator bodies form an array of sub-arrays.

In some cases, the sub-arrays are formed as separate monolithic structures.

In some cases, the signal distribution structure comprises one or more transmission lines selected from the group consisting of a metal microstrip transmission line, a metal coplanar waveguide transmission line, a metal coplanar strip transmission line, a metal stripline transmission line, a dielectric waveguide transmission line, a substrate integrated waveguide transmission line, and a substrate integrated image guide.

In some cases, the signal distribution structure comprises one or more thick metal transmission lines.

In some cases, the thick metal transmission line has a metal thickness between 10% and 100% of a thickness of the plurality of resonator bodies.

In some cases, each of the plurality of coupling structures is provided under a respective resonator body in proximity to and substantially parallel to the planar surface.

In some cases, each of the plurality of coupling structures is a respective section of the signal distribution structure.

In some cases, each of the plurality of coupling structures is a tapered respective section of the signal distribution structure.

In some cases, each of the plurality of coupling structures is provided by a slot defined in the planar surface beneath a respective resonator body.

In some cases, each of the plurality of coupling structures terminates in proximity to a respective resonator body substantially perpendicularly to the planar surface.

In some cases, each of the plurality of coupling structures has a height between 10% and 100% of the respective resonator bodies.

In some cases, each of the plurality of coupling structures abuts the respective resonator bodies.

In some cases, each of the plurality of coupling structures is separated from the respective resonator bodies by a respective gap.

In some cases, each of the plurality of coupling structures is embedded within a respective resonator body substantially perpendicularly to the planar surface.

In some cases, each of the feedlines is a tee-line that branches off at least one main feedline.

In some cases, the signal distribution structure is periodically loaded by the plurality of resonator bodies.

In some cases, the signal distribution structure is configured to uniformly distribute an electromagnetic energy of the excitation signal to each of the feedlines.

In some cases, at least one feedline of the plurality of feedlines has a different impedance than at least one other feedline of the plurality of feedlines.

In some cases, the different impedance is achieved by altering a shape of the at least one feedline relative to the at least one other feedline.

In some cases, the signal distribution structure is configured to non-uniformly distribute an electromagnetic energy of the excitation signal to each of the feedlines.

In some cases, the plurality of coupling structures are configured to uniformly distribute an electromagnetic energy of the excitation signal to each of the resonator bodies.

In some cases, the plurality of coupling structures are configured to non-uniformly distribute an electromagnetic energy of the excitation signal to each of the resonator bodies.

In some cases, each feedline is configured to maintain a uniform phase of the excitation signal.

In some cases, at least one feedline is sized to produce a first phase of the excitation signal that is different from a second phase of the excitation signal at another feedline.

In some cases, the resonator bodies are spaced apart in a substantially linear configuration.

In some cases, the resonator bodies are spaced apart in a substantially quadrilateral configuration.

In some cases, the resonator bodies are spaced apart in a substantially circular configuration.

In some cases, the feed structure comprises a respective signal port on each respective feedline for receiving the excitation signal, and wherein the feed structure further comprises a signal divider electrically coupled to the signal port for dividing the excitation signal to provide a divided excitation signal to each of the feedlines.

In some cases, the feed structure further comprises at least one additional signal divider electrically coupled to at least one of the feedlines to further sub-divide the excitation signal.

In some cases, the dielectric resonator bodies are formed of polymer-based materials.

In some cases, the dielectric resonator bodies are formed of low-permittivity dielectric materials.

In some cases, the dielectric materials have a relative permittivity in the range between 2 and 12.

In some cases, a frequency of operation of the antenna is in the range of 0.3 GHz to 300 GHz.

In another broad aspect, there is provided a method of fabricating a dielectric resonator antenna array, the method comprising: providing a substrate with at least a first planar surface; providing a plurality of polymer-based resonator bodies on the first planar surface, wherein each of the bodies is spaced apart from each other; providing a plurality of feed coupling structures on the first planar surface, each of the coupling structures positioned to operatively couple to a respective one of the resonator bodies to provide an excitation signal thereto; and providing a signal distribution structure to operatively couple to the plurality of coupling structures to provide the excitation signal thereto.

In some cases, at least one of the plurality of resonator bodies is coupled to at least one other of the resonator bodies by a wall structure.

In some cases, at least two of the plurality of resonator bodies form a sub-array of resonator bodies.

In some cases, the polymer-based resonator bodies have a plurality of layers, the layers formed by depositing a polymer-based material; exposing the polymer-based material to a lithographic source via a pattern mask, wherein the pattern mask defines each polymer-based resonator body; developing a portion of the polymer-based material; removing one of an exposed portion and an unexposed portion of the polymer-based material to reveal the respective polymer-based resonator bodies.

In some cases, the signal distribution structure comprises a plurality of feedlines, each of the feedlines operatively coupled to at least one of the coupling structures.

In some cases, the signal distribution structure further comprises at least one transmission line.

In some cases, the signal distribution structure comprises a transmission line selected from the group consisting of a metal microstrip transmission line, a metal coplanar waveguide transmission line, a metal coplanar strip transmission line, a metal stripline transmission line, a dielectric waveguide transmission line, a substrate integrated waveguide transmission line, and a substrate integrated image guide.

In some cases, the signal distribution structure comprises a thick metal transmission line.

In some cases, the thick metal transmission line has a metal thickness between 10% and 100% of a thickness of the plurality of resonator bodies.

In some cases, the resonator bodies are provided by fabricating on a sacrificial substrate, removing from the sacrificial substrate and transferring to the first planar surface.

In some cases, the dielectric resonator bodies are formed of polymer-based materials.

In some cases, the dielectric resonator bodies are formed of low-permittivity dielectric materials.

In some cases, the dielectric materials have a relative permittivity in the range between 2 and 12.

In another broad aspect, there is provided a method of fabricating a dielectric resonator antenna array, the method comprising: providing a substrate with at least a first planar surface; providing a mold on the substrate, the mold defining a plurality of cavities shaped to define a plurality of resonator bodies disposed on the first planar surface, wherein each of the cavities is spaced apart from each other; filling the plurality of cavities with a first dielectric material to form the resonator bodies; providing a plurality of feed coupling structures on the first planar surface, each of the coupling structures positioned to operatively couple to a respective one of the resonator bodies to provide an excitation signal thereto; and providing a signal distribution structure to operatively couple to the plurality of coupling structures to provide the excitation signal thereto.

In some cases, the mold defines at least one sub-array of resonator bodies.

In some cases, the mold further defines at least one coupling cavity shaped to define the plurality of feed coupling structures, and wherein the plurality of feed coupling structures are provided by depositing a conductive material within the at least one coupling cavity.

In some cases, the mold further defines at least one distribution cavity shaped to define the signal distribution structure, and wherein the signal distribution structure is deposited within the at least one distribution cavity.

In some cases, the mold is a sacrificial mold that is not retained in the dielectric resonator antenna array.

In some cases, at least a portion of the mold is retained in the dielectric resonator antenna array.

In some cases, the mold is defined by lithography.

In some cases, the mold is provided and the cavities are filled on a sacrificial substrate, wherein the mold and the cavities are removed from the sacrificial substrate and transferred to the first planar surface.

In some cases, the dielectric resonator bodies are formed of polymer-based materials.

In some cases, the dielectric resonator bodies are formed of low-permittivity dielectric materials.

In some cases, the dielectric materials have a relative permittivity in the range between 2 and 12.

In some cases, the mold is provided by: forming a polymer-based body; exposing the polymer-based body to a lithographic source via a pattern mask, wherein the pattern mask defines each respective cavity to be formed in each polymer-based body; developing a portion of the polymer-based body; removing one of an exposed portion and an unexposed portion of the polymer-based body to reveal the respective cavities.

In some cases, the polymer-based body forms a single monolithic structure, and wherein each respective cavity is separated by a wall structure formed of the polymer-based body.

In some cases, the mold has a plurality of layers, the layers formed by repeating the forming, the exposing, the developing and the removing at least once.

In some cases, the method further comprises repeating the filling for each of the layers.

In some cases, a second dielectric material is used to fill at least one of the layers.

In some cases, the signal distribution structure comprises a plurality of feedlines, each of the feedlines operatively coupled to at least one of the coupling structures.

In some cases, the signal distribution structure further comprises at least one transmission line.

In some cases, the signal distribution structure comprises a transmission line selected from the group consisting of a metal microstrip transmission line, a metal coplanar waveguide transmission line, a metal coplanar strip transmission line, a metal stripline transmission line, a dielectric waveguide transmission line, a substrate integrated waveguide transmission line, and a substrate integrated image guide.

In some cases, the signal distribution structure comprises a thick metal transmission line.

In some cases, the thick metal transmission line has a metal thickness between 10% and 100% of a thickness of the plurality of resonator bodies.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which:

FIGS. 100 and 10D illustrate different planes perpendicular to each other and mutually perpendicular to the substrate surface, of radiation patterns showing the realized gain distribution for the PRA array of FIG. 10A;

Figure 1A:
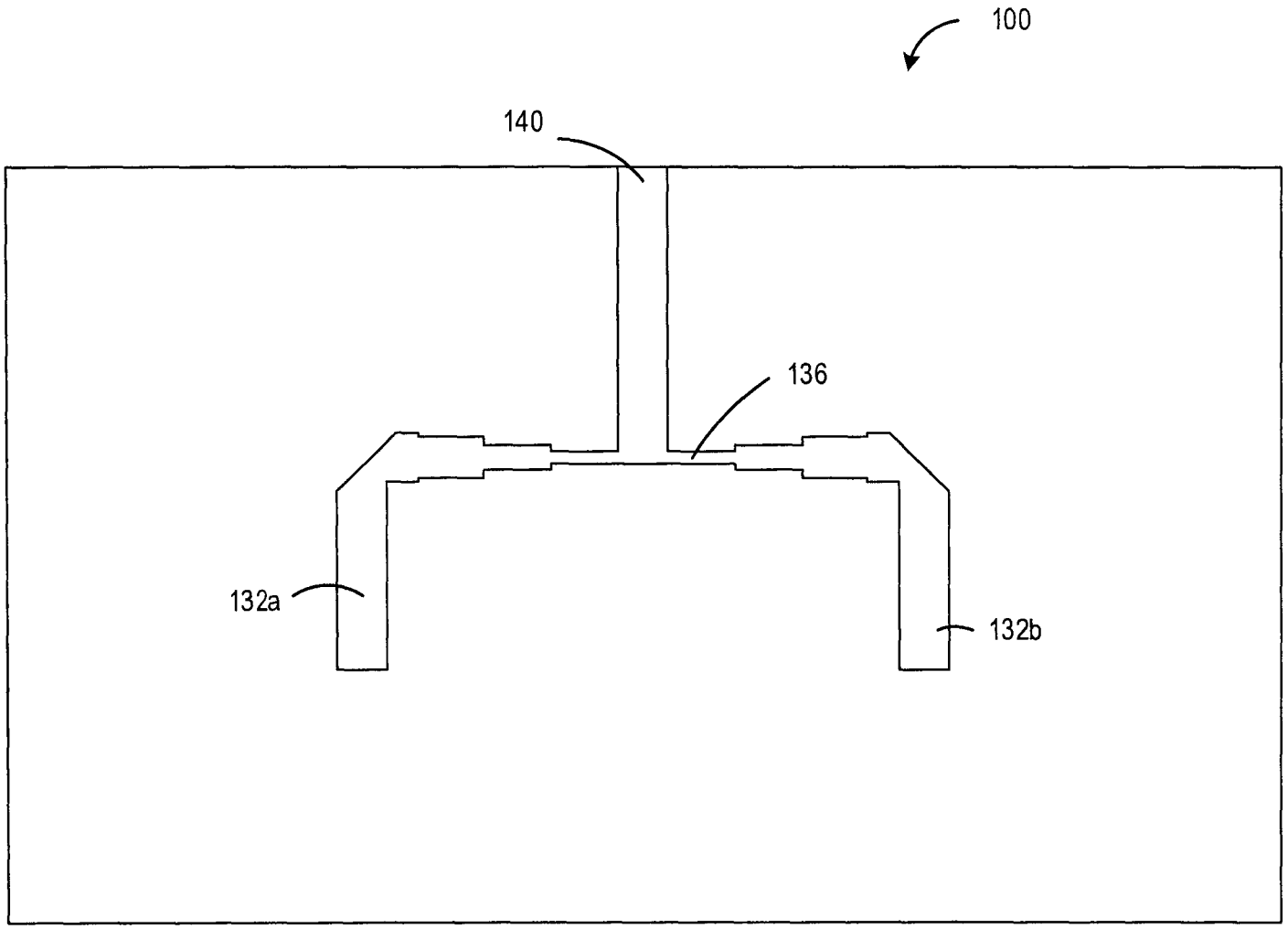
FIG. 1A is a plan view of a signal distribution structure for an antenna array with two antenna elements.

The skilled person in the art will understand that the drawings are for illustration purposes only. It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF EXEMPLARY EMBODIMENTS

An antenna array is an arrangement of antenna elements. Each antenna element receives signal power through a feeding structure, and radiates this power into space with a specific electromagnetic radiation pattern or "beam shape", defined by an effective power gain in a certain spatial direction. The overall radiation pattern for the antenna array is the spatial combination of the radiated signals from all the antenna elements. The overall radiation pattern, or the gain, may be approximated with an array factor and an antenna factor. The array factor can define the spatial combination of the various antenna elements of the antenna array and the antenna factor corresponds to the gain, of each antenna element in the antenna array. The overall radiation pattern may then be approximated by multiplying the array factor with the antenna factor, for example.

In comparison with an antenna with a single antenna element, an antenna array can offer certain advantages. The gain of an antenna array is typically greater than that of a single antenna element, for instance. Also, the gain of an antenna array can be varied without necessarily replacing the antenna element, but by changing the associated array factor.

The array factor can depend on various factors, such as spatial characteristics of the antenna elements (e.g., the number of antenna elements in the antenna array, a separation distance between each of the antenna elements, and a position of each antenna element in the antenna array) and characteristics of the excitation signal (e.g., an amplitude, a phase, etc.).

Generally, the spatial characteristics of the antenna elements may not be easy or practical to change, especially after fabrication. It may, therefore, be more appropriate to change the array factor by varying the excitation signal. For example, a beam direction of a radiation pattern of the antenna array may be changed by changing the phase of the excitation signals provided to the antenna elements. No mechanical rotation of the antenna array is required.

At the design stage of the antenna array, the characteristics of the excitation signal may be controlled by certain weight coefficients in the array factor. The weight coefficients are applied to control the electromagnetic energy distribution generated by each antenna element, which in turn controls the performance of the antenna array. The weight coefficients can be determined based on known distributions, such as uniform, binomial, Chebyshev, etc.

To configure the excitation signal for each antenna element in the antenna array, various aspects of the antenna array may be adjusted. The various aspects include the material, shape, number, size and physical arrangement of the antenna elements in the antenna array and a configuration of a feed structure that provides the excitation signal to the antenna elements. The arrangement of the antenna elements, however, is typically restricted by an operating wavelength of the excitation signal and potential mutual coupling between neighbouring antenna elements. The configuration of the feed structure and/or feed signals for the antenna array can provide control of the amplitude and phase of the excitation signals, and can control the overall pattern of the array, enhance the gain, and control the direction of maximum gain.

An array structure can also be used to improve the performance of certain antenna types. Single DRA elements operating in their dominant mode are relatively low gain antennas and typically characterized by a gain of up to approximately 5 dBi. By arranging the DRAs in an array structure, the corresponding gain of the DRA array can be increased.

As noted, traditional DRA arrays cannot easily be fabricated as larger multi-element structures with conventional automated manufacturing processes, and are typically realized by fabricating elements separately and performing individual element placement and bonding to the substrate.

DRA arrays may be formed with low permittivity dielectric materials. This allows, for instance, the use of low permittivity polymer-based materials to realize Polymer-based Resonator Antenna (PRA) elements and arrays with different configurations.

Both pure polymer and higher permittivity polymer-ceramic composites can be used as low permittivity dielectric antenna materials. The use of low permittivity polymer-based materials is attractive, as it can dramatically simplify the fabrication by employing batch-fabrication techniques, such as lithography. As such, the individual array elements can be fabricated with complicated geometries, and these elements can be fabricated directly in complicated patterns to form multi-element monolithic structures, for example using narrow-wall connecting structures, which removes the requirement to precisely position and assemble the array elements. Low permittivity dielectric materials may be associated with relative permittivity of approximately 6 or less at microwave frequencies. However, in some embodiments, lithography with pure polymers to form frames or templates may be augmented with ceramic composite or other dielectric materials injected into these polymer frames/templates using microfabrication techniques, as described herein and in International Patent Application No. PCT/CA2012/050391, for example.

Example pure plastics can include various polymer resins (e.g., polyester-styrene (PSS)), various photoresist polymers (e.g., polymethyl-methacrylate (PMMA) which is a positive photoresist and SU-8™ which is an epoxy-based negative photoresist, etc.).

In some cases, to counterbalance the lower relative permittivity values of pure polymer materials, a filler material with a higher relative permittivity can be mixed or added to create a composite material with enhanced dielectric properties. For example, a filler such as a ceramic can have a relative permittivity greater than 9 when the ceramic constituent is in substantially pure solid form. The filler material may include structural or functional ceramics. The filler may include high-K materials with a relative permittivity between 4 and 1000 (e.g. zirconia, alumina) or above 103 for perowskite-type ceramics (e.g. barium titanate, potassium sodium tartrate, barium strontium titanate, etc.). In general, various ceramic powders, such as aluminum oxide, barium titanate oxide, zirconium oxide and the like have been shown to be effective filler materials.

For ceramic filler materials, the ceramic particles may include ceramic powder, micro-powder and/or nano-powder. The ceramic constituent may include ceramic particles having a size determined by the functional pattern size for the dielectric application and elements of the antenna. For example, in some embodiments, the ceramic constituent may have a mean diameter in a range of 50 nm to 5 μm prior to being mixed with a polymer constituent. In some embodiments, the ceramic constituent may have a mean diameter in a range of 300 nm to 900 nm.

The composite material may also include other fillers, such as fiber materials, carbon nanotubes and CdS nanowires and active ferroelectric materials, which can be selected to form materials with desired properties, such as enhanced tunability or power-harvesting ability. The resulting composite materials can provide a broader group of viable materials suitable for dielectric applications. In some cases, the use of such composites may alter photoresist properties, requiring adjustment of lithographic processing, or additional steps in the fabrication process. Polymer-ceramic composites are described further in U.S. Provisional Patent Application No. 61/842,587.

As described herein, antenna elements and feeding and signal distribution structures can be fabricated using lithography.

In common applications of electroplating with photoresist templates, the template or frame is removed following the formation of the metal body. However, in at least some of the embodiments described herein, a polymer or polymer-based template (e.g., photoresist) can be retained following electroplating to act as functional dielectric material possibly encompassing or in proximity to a metal feeding structure.

Accordingly, in some embodiments, the polymer materials may be used as an electroplating template, and additionally form the functional structure of the PRA (e.g., resonator body). However, in variant embodiments, at least some of the electroplating template can be removed.

For example, a feedline can be prepared on a microwave substrate using UV lithography or other patterning techniques. A polymer-based photoresist can be cast or formed (multiple times, if necessary) and baked at temperatures below 250° C. (e.g., 95° C.). In some alternative embodiments, photoresist may be formed by, for example, bonding or gluing a plurality of pre-cast polymer-based material sheets. Next, a narrow gap or aperture near the edge of the antenna element can be patterned using an X-ray or ultra-deep UV exposure and developed, typically at room temperature. Finally, the resultant gap can subsequently be filled with metal (via electroplating or otherwise), up to a desired height, to produce the embedded vertical strip.

Notably, these fabrication processes can be carried out at relatively low temperatures and typically without sintering, which could limit the range of polymer materials available for use, as well as limit fine feature sizes and element shapes due to shrinkage and cracking.

When using metal electroplating, a microstrip line can be used as a plating base to initiate the electroplating process. Electroplating of microstructures has been demonstrated in the LIGA process for complicated structures with heights of several millimeters.

For a 2 mm tall polymer dielectric structure, a typical aspect ratio of vertical to minimum lateral dimensions in the range of up to 50 is within the capability of known fabrication techniques.

Increased surface roughness can correspond to increased metallic loss. However, using an X-ray lithography process, the metal strip sidewalls can be fabricated to be very smooth, with a roughness on the order of tens of nanometers. This may allow for an increase in the efficiency of antenna at millimeter-wave frequencies, which may be particularly attractive for high frequency array applications, where a major portion of losses can be attributed to the feed network.

The ability to fabricate complex shapes in PRAs allows for the resonator body and other elements to be shaped according to need. For example, the lateral shapes of the PRA elements can be square, rectangular, circular, or have arbitrary lateral geometries, including fractal shapes. Accordingly, the resonator body may have three dimensional structures corresponding to a cube (for a square lateral geometry), a cylinder (for a circular lateral geometry), etc.

As noted above, PRA elements can be fabricated in thick polymer or polymer-composite layers, up to several millimeters in thickness, using deep penetrating lithographic techniques, such as thick resist UV lithography or deep X-ray lithography (XRL). In some alternate embodiments, other 3D printing or micromachining processes may be used.

Various fabrication methods may also be employed, including direct fabrication, or by injecting dielectric materials into lithographically fabricated frames or templates formed of photoresist materials, or frames or templates formed of polymers, metals, substrates, etc. fabricated using other 3D printing, micromachining, or molding processes. The use of such frames enables the use of complicated shapes with a wide range of dielectric materials that might otherwise be very difficult to produce using other fabrication techniques.

Example lithography processes may include X-ray lithography, UV lithography, stereo lithography, e-beam lithography and laser lithography. Example microfabrication techniques may include a low temperature co-fired ceramic (LTCC) process, wet/dry etching, ink-jet/3D printing, imprint lithography, laser machining, electric discharge machining (EDM), precision machining, computer numerical control (CNC) milling, injection molding, and screen printing.

To enhance the precision and placement of antenna elements and feeding structures in and for an array, the entire array may be fabricated in a single process and as a single monolithic piece (or as several separate sub-array pieces), by connecting individual array elements with wall structures that are preferably substantially narrower than the array elements themselves (e.g., less than 5% the width of the array elements). This approach not only provides substantially uniform elements due to the fabrication in the same process, it allows for arbitrary relative positioning of the elements, and also facilitates very precise positioning of the elements. By building a single block rather than separate elements, the post-fabrication task of positioning individual elements relative to each other is completely eliminated. This is especially important in the high frequency and millimeter wave applications where the positioning of the elements is more difficult and prone to errors due to small features.

In some cases, each element may be fabricated directly using materials such as a polymer photoresist, which may remain post-fabrication. In other cases, a templating approach may be used in which polymer-based frames are fabricated, which serve to shape other materials (e.g., ceramic or polymer-ceramic composites) that are injected or filled using complementary microfabrication techniques. The templates may be removed in a later fabrication stage, or may remain as part of the final array structure. In some cases, feedlines and feed structures may also be formed using a templating approach to allow for tall metal structures to be formed, for instance using electrodeposition.

Tall structural features may be fabricated in a single thick layer, or may be built up with successive fabrication stages. When successive fabrication stages are used, there may be a vertical inhomogeneity in the resulting structures. In some cases, an inhomogeneity may be obtained in other ways. For example, an inhomogeneous mixture may result from delaying a pre-baking process of a composite mixture, since particles tend to move to a lower region of the composite mixture before drying.

A controlled and gradual change of a density of the filler can also be obtained by applying successive layers. The use of the inhomogeneous mixture as the composite material can be advantageous in dielectric applications. For example, for antenna applications, each of the impedance bandwidth, the coupling level, and the realized gain of the antenna can be enhanced, and the cross-polarization patterns may be improved by exploiting inhomogeneity. These improvements to antenna applications may result from constituents in the composite material providing an impedance transformer through one of the segments. As well, improvements in antenna applications may be realized from constituents in the composite material having suitable polarizations and directions such that the electric near-field patterns exhibit desirable characteristics.

One or more different types of polymer or composite materials may be stacked one over the other. In some cases, layers can be distributed at a gradient or other similar distribution profiles in the inhomogeneous arrangement. For example, the distribution profiles may include a linearly increasing or decreasing density, or a logarithmically increasing or decreasing density.

In some cases, inhomogeneity may also be lateral as opposed to, or in addition to, vertical inhomogeneity.

Single thick resist layers of up to 2 mm have been demonstrated. However, a multi-layer approach can also be used as noted, in which the array elements can be fabricated by a process of aligning, stacking, and bonding of several copies of the arrays fabricated separately in thinner layers (of a common material, or layers of different materials) using various lithography or microfabrication techniques.

The polymer-ceramic composite materials can also be directly exposed (in the case of photoresist polymers) as described above to fabricate arrays using lithographic techniques, or micromachined directly using various microfabrication methods, and in all cases as single layers or as multiple layers (of common or different materials) using alignment, stacking, and bonding approaches, or multiple layer injections and curing steps. In some example composite arrays described herein, a negative sacrificial template of the array is fabricated from a 1.5 mm thick PMMA layer. In an alternative approach, the templates can consist of narrow frames of thick material defining array geometries. The templates are then filled with dielectric material. For example, the dielectric material may be PSS/BT composites with different weight percentages of the ceramic content. The PSS/BT composite-filled templates can then be baked for 6 hours at 65 degrees Celsius. Up to 20% shrinkage typically occurs during baking at the center of the casts, which can be accounted for in the layout if necessary. Other materials can also be injected. The resulting samples are then polished to obtain smooth and precise sample heights with thicknesses in the 1 mm range. The PMMA template is then removed by exposing the samples to X-rays and developing in propylene glycol monomethyl ether acetate (PGMEA) developer. As described herein, this template/frame may not in all cases be necessary to remove, as narrow frames in suitable materials around the side-walls of the PRA array elements may not dramatically affect the performance of the array. Examples of these fabrication approaches are described with reference to FIGS. 21A to 21C.

Although use of low permittivity dielectric materials in the DRA array may cause higher mutual coupling between the resonator bodies, the bandwidth of the resulting DRA array nevertheless may be increased.

One aspect of DRA array design is effectively providing signals to the respective DRA elements. This structure used to provide feed signals to each array element is generally described herein as a "feed network" or "feed structure". However, the feed network or feed structure generally includes two functional sub-structures: 1) a signal distribution network for providing signals at the input of the DRA elements; and 2) a coupling structure at each element to functionally couple signal energy into the element.

Two basic types of distribution network are described herein, both are based on microwave transmission lines (TLs) or waveguides. In a first type of distribution network, the TL is periodically loaded by the DRA elements, such that signal power is transferred to the elements from the common TL as it travels down the loaded TL. In a second type of distribution network, the signal power is divided by TL networks and transferred individually to DRA elements from separate TLs.

In addition, three basic types of TL are described. A first type of TL is the typical thin metal planar microstrip TL. A second type of TL is the tall metal microstrip TL, in which the metal thickness is not negligible and can be on the order of the height of the DRA element. The thick metal TL offers additional options for coupling energy into the elements, due to increased vertical metal cross-sectional area and increased coupling capacitance. The third type of TL is a type of dielectric waveguide called a substrate integrated waveguide, which is typically comprised of a dielectric layer sandwiched between two metallic plates (which form top and bottom walls of the waveguide) and rows of closely-spaced metallized vias (which form the left and right sides of the waveguide) passing through the dielectric layer and connected to the metallic plates. This distribution task is more demanding for PRAs due to their inherently wideband operation. Often, a simple signal divider cannot cover the required bandwidth of the antenna elements. In order to address this problem, at least some of the described examples employ wideband impedance transformers (for instance, designed using quarter wavelength TLs, and using binomial, Chebyshev, or other known distributions) to realize a wideband signal division.

Although three types of TL or waveguide distribution structures are described herein, various other structures may also be used for any of the DRA arrays described herein. The example structures are shown with both thin metal and thick metal microstrip TLs but other types of microwave transmission structures may similarly be applied. For example, the microstrip lines in each of these distribution structures may also be replaced with any one of a thin or thick metal coplanar waveguide (CPW), thin/thick metal parallel standing strips, thin/thick metal slotline, or metal stripline. The example dielectric waveguide structures shown are implemented using a type of substrate integrated waveguide with rows of metalized vias acting as waveguide walls, however various other types of substrate integrated waveguides could be implemented, such as substrate integrated image guide, with rows of non-metallized vias (i.e.: air or dielectric-filled) acting as waveguide walls, or solid vertical metal sidewalls fabricated using deep penetrating lithographies and filled with metal using electroplating, or other types of dielectric or air filled waveguide with metallized or non-metallized outer wall boundaries.

Figure 2A:
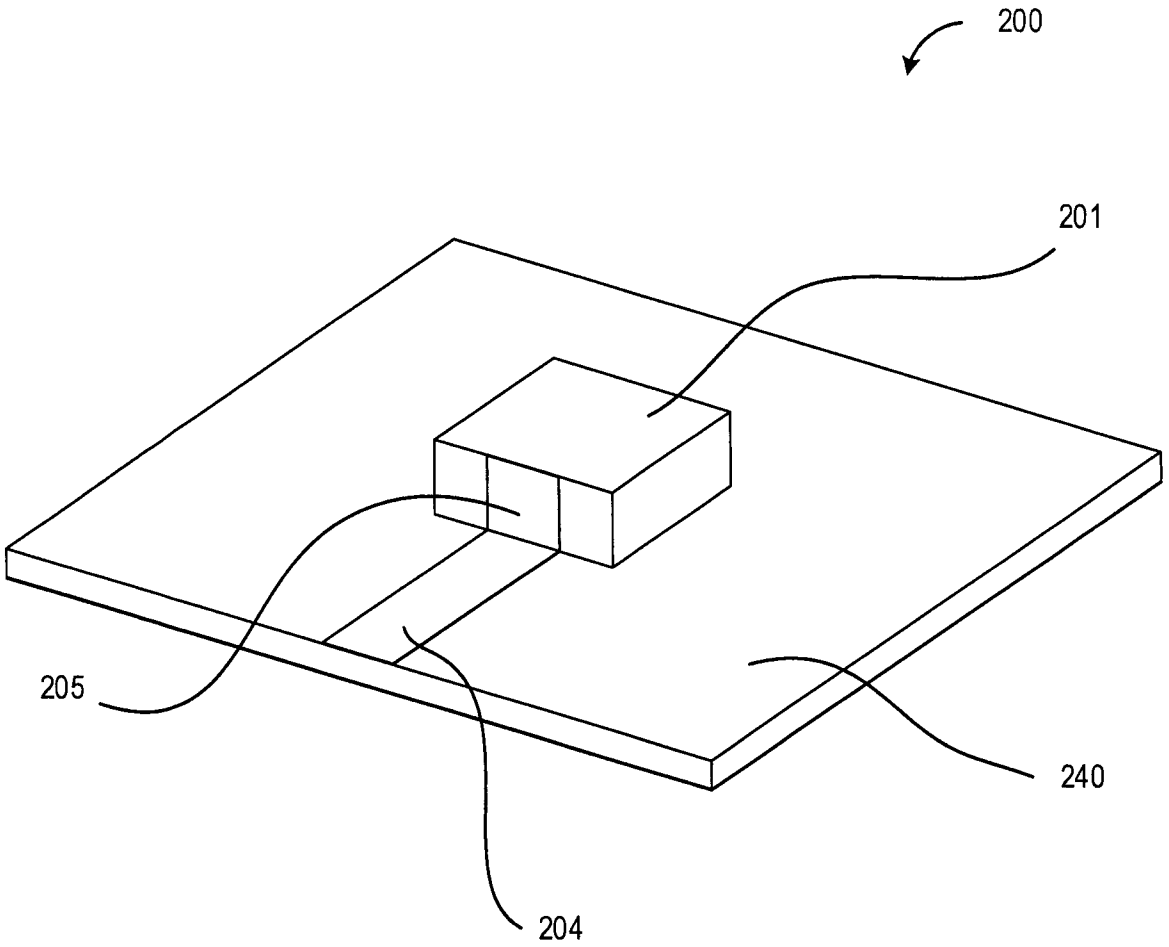
FIG. 2A is a perspective view of an example single PRA antenna element excited by a sidewall vertical strip.
Figure 3:
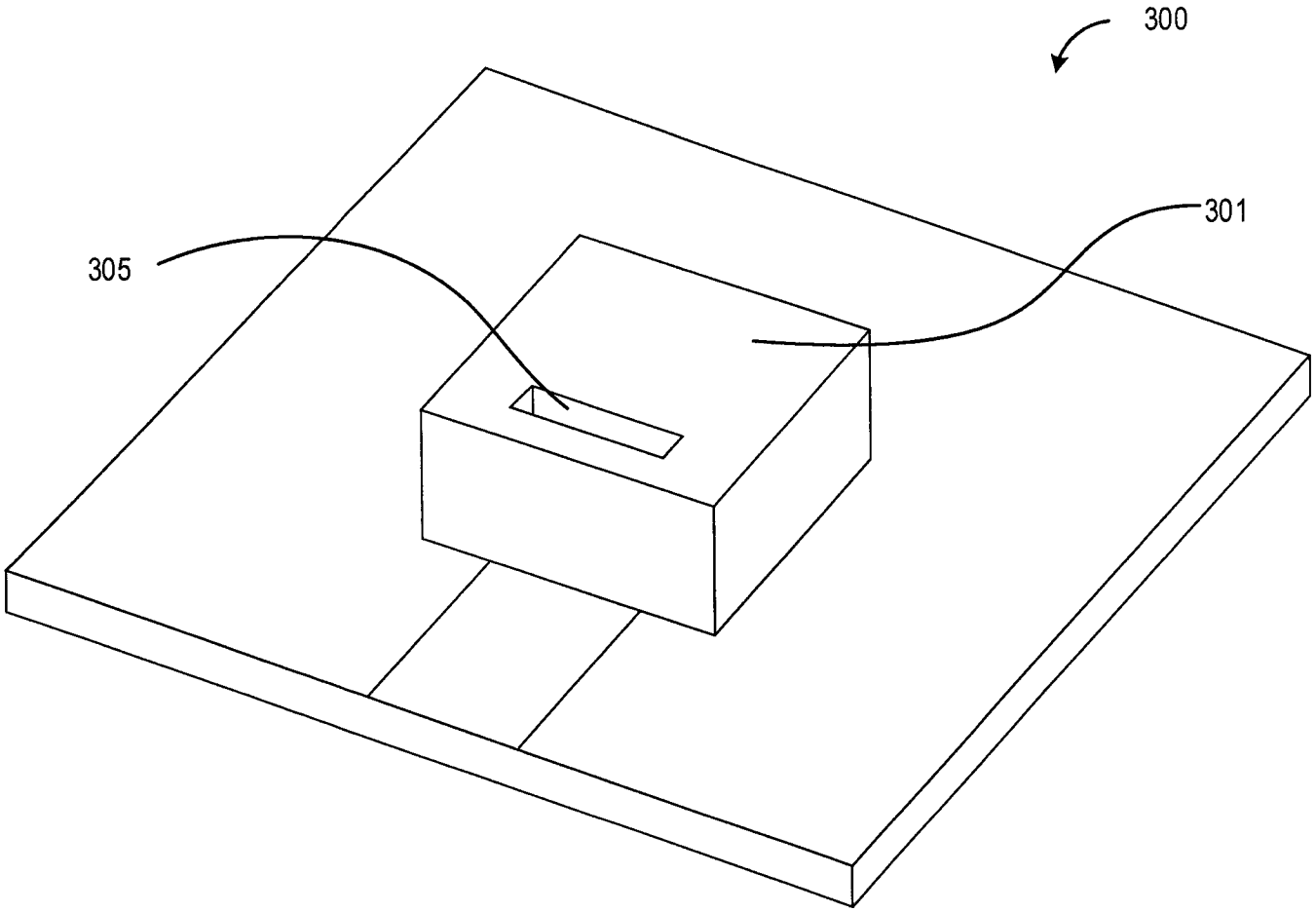
FIG. 3 is a perspective view of a PRA element with embedded vertical strip coupling.
Figure 12A:
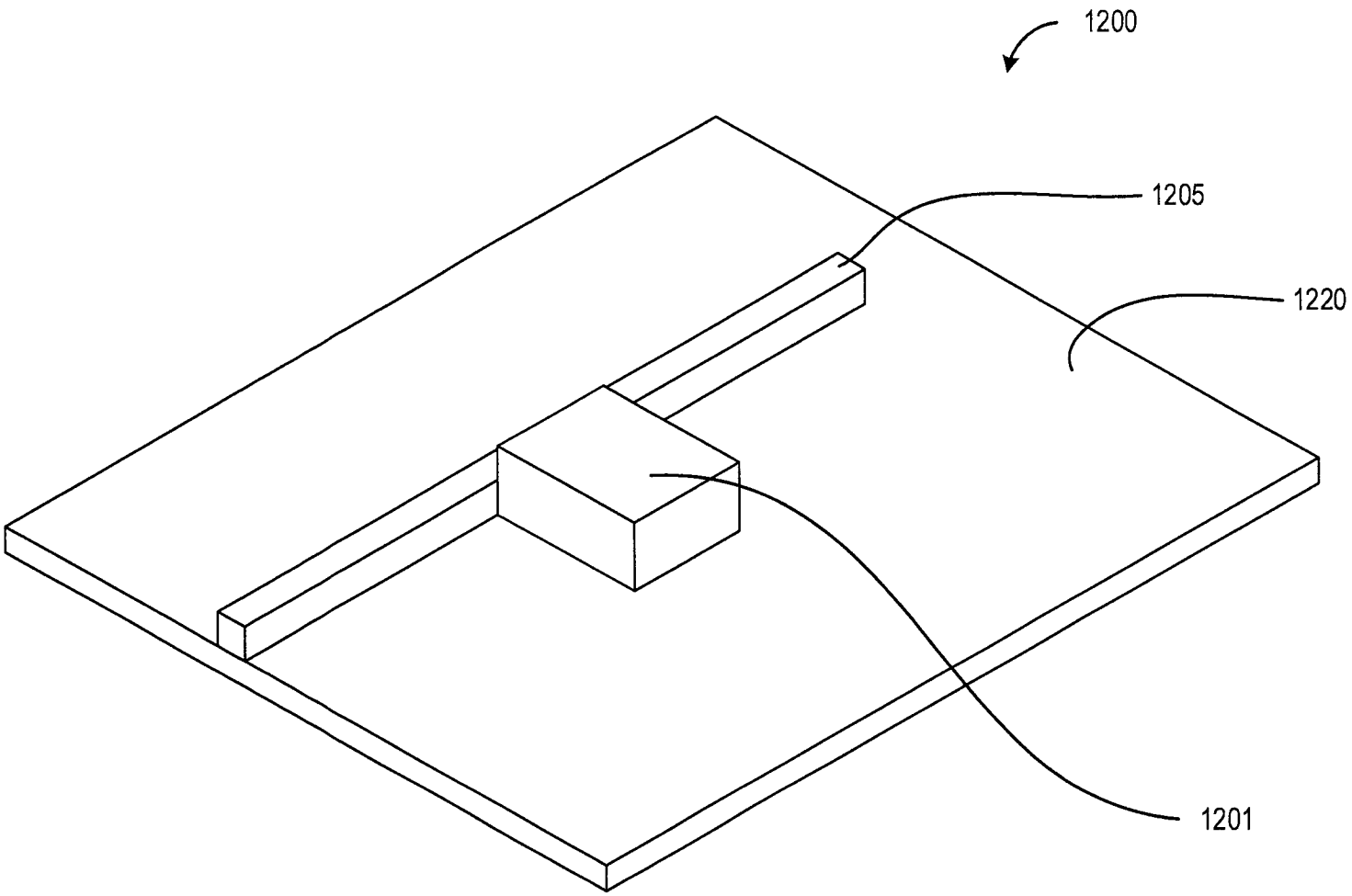
FIG. 12A is a perspective view of an antenna structure with a single PRA antenna element excited by a tall metal side coupled microstrip transmission line.
Figure 13A:
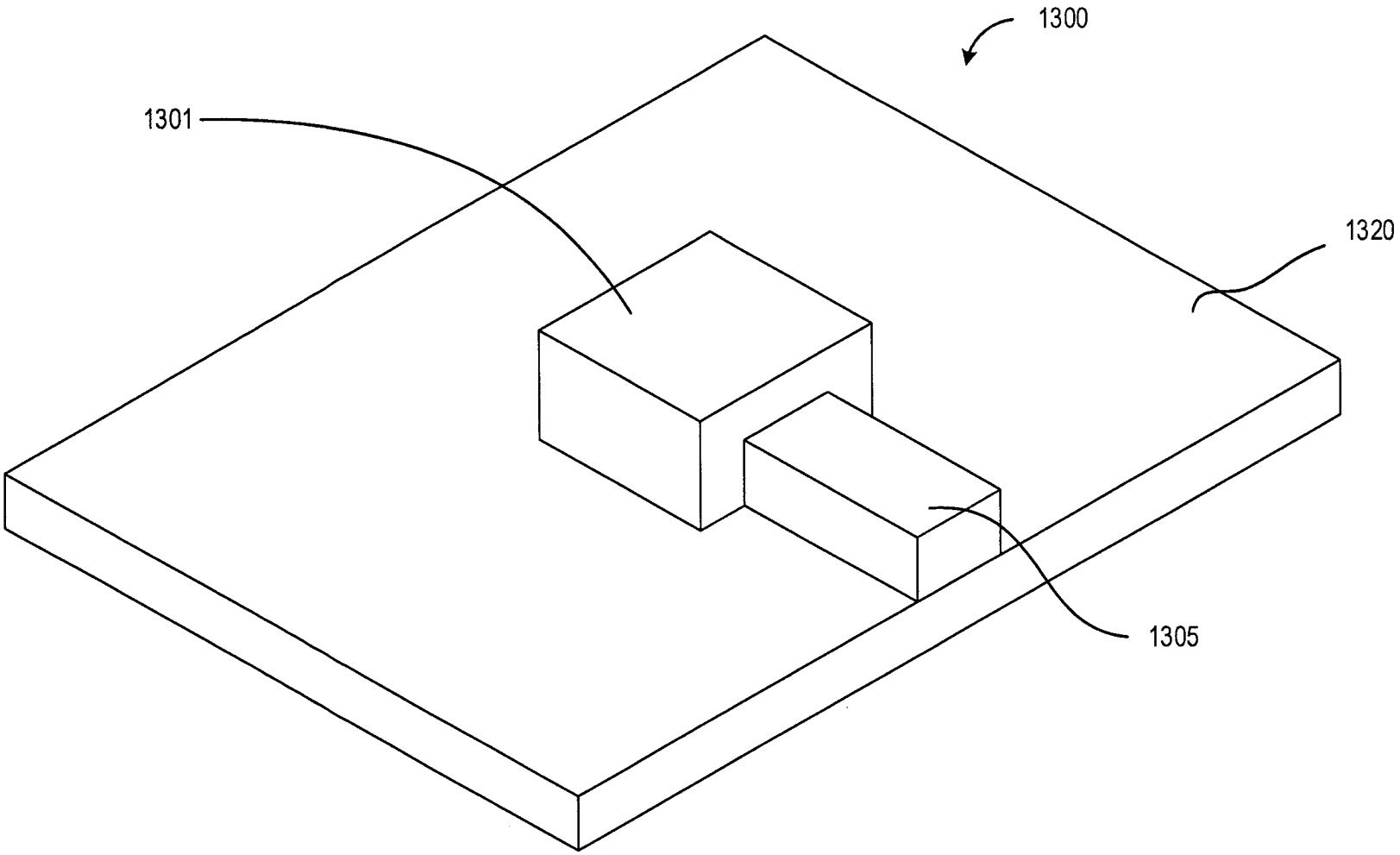
FIG. 13A is a perspective view of an antenna structure with a single PRA antenna element excited by a tall metal end coupled microstrip transmission line.
Figure 15:
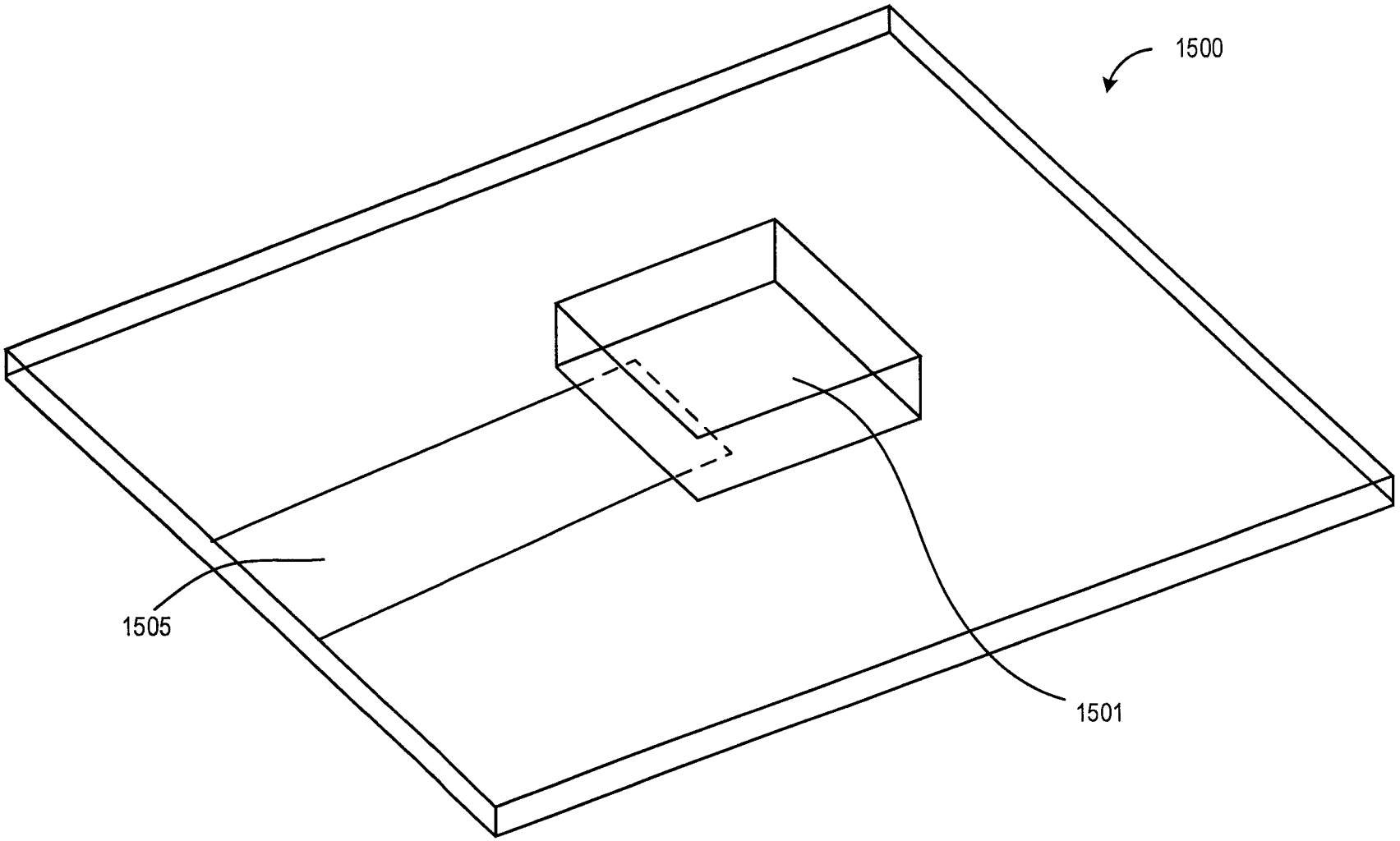
FIG. 15 is a perspective view of an example PRA element with microstrip coupling.
Figure 16:
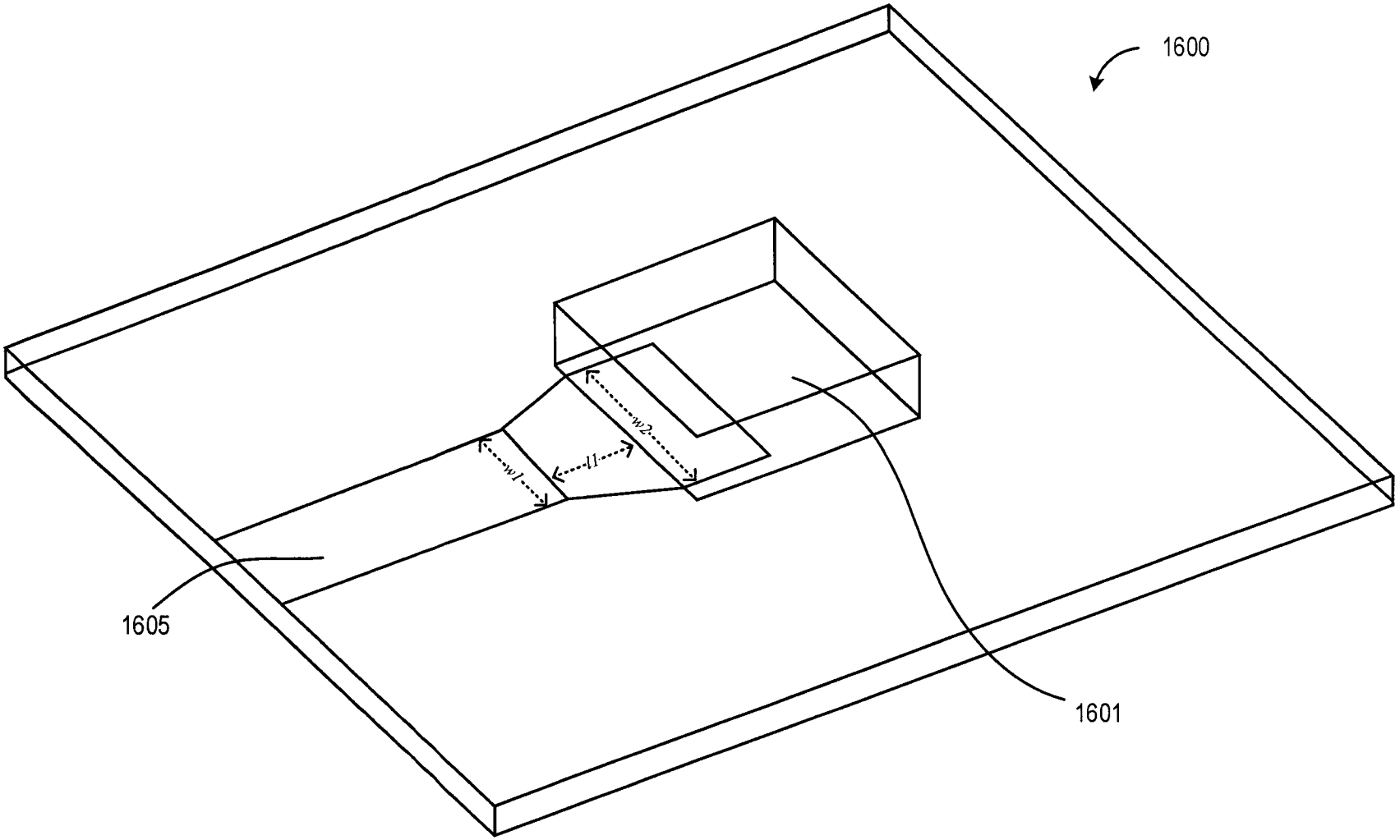
FIG. 16 is a perspective view of another example PRA element with tapered microstrip coupling.
Figure 17A:
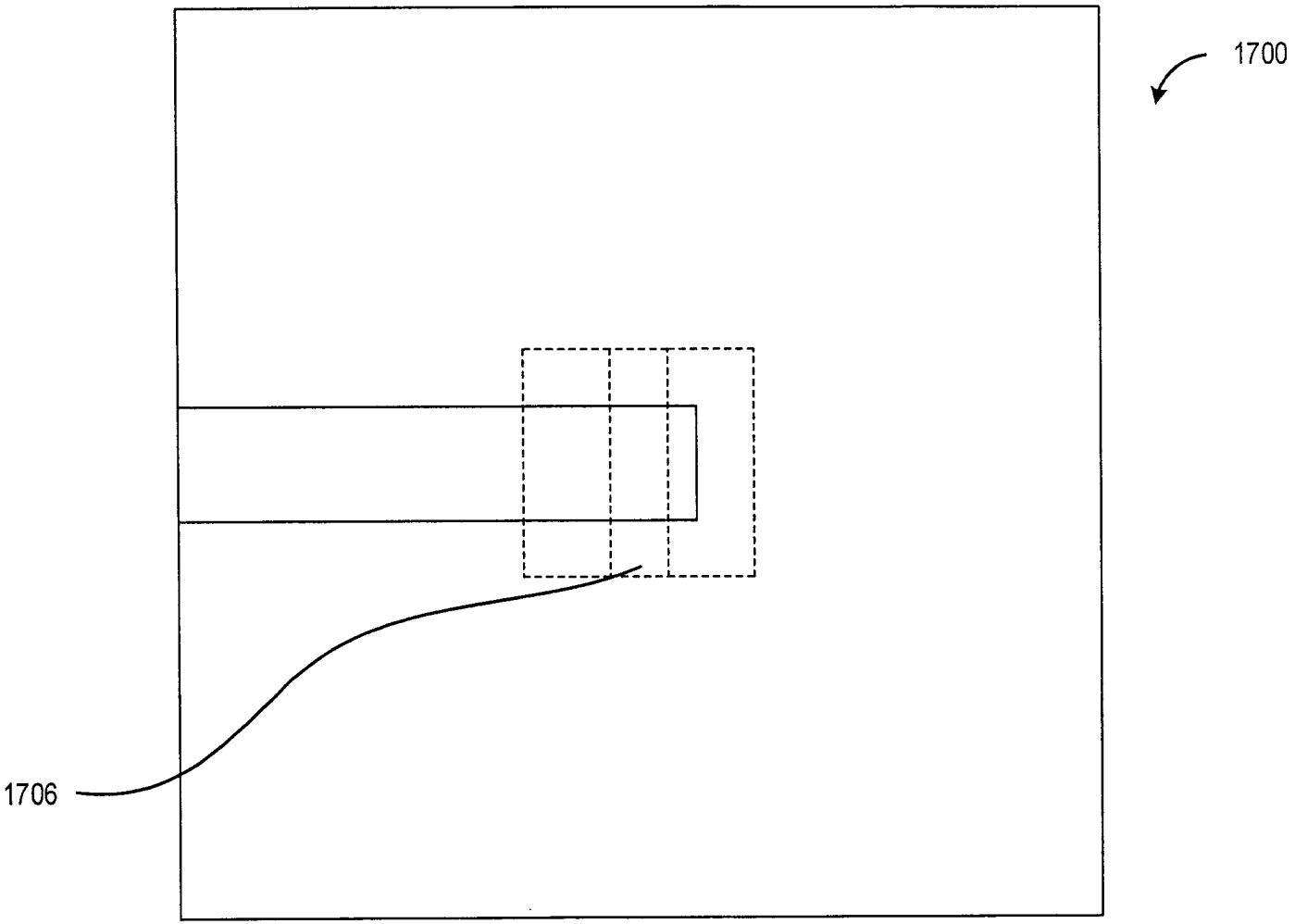
FIG. 17A is a plan view of a slot coupled single PRA element structure.
Figure 17B:
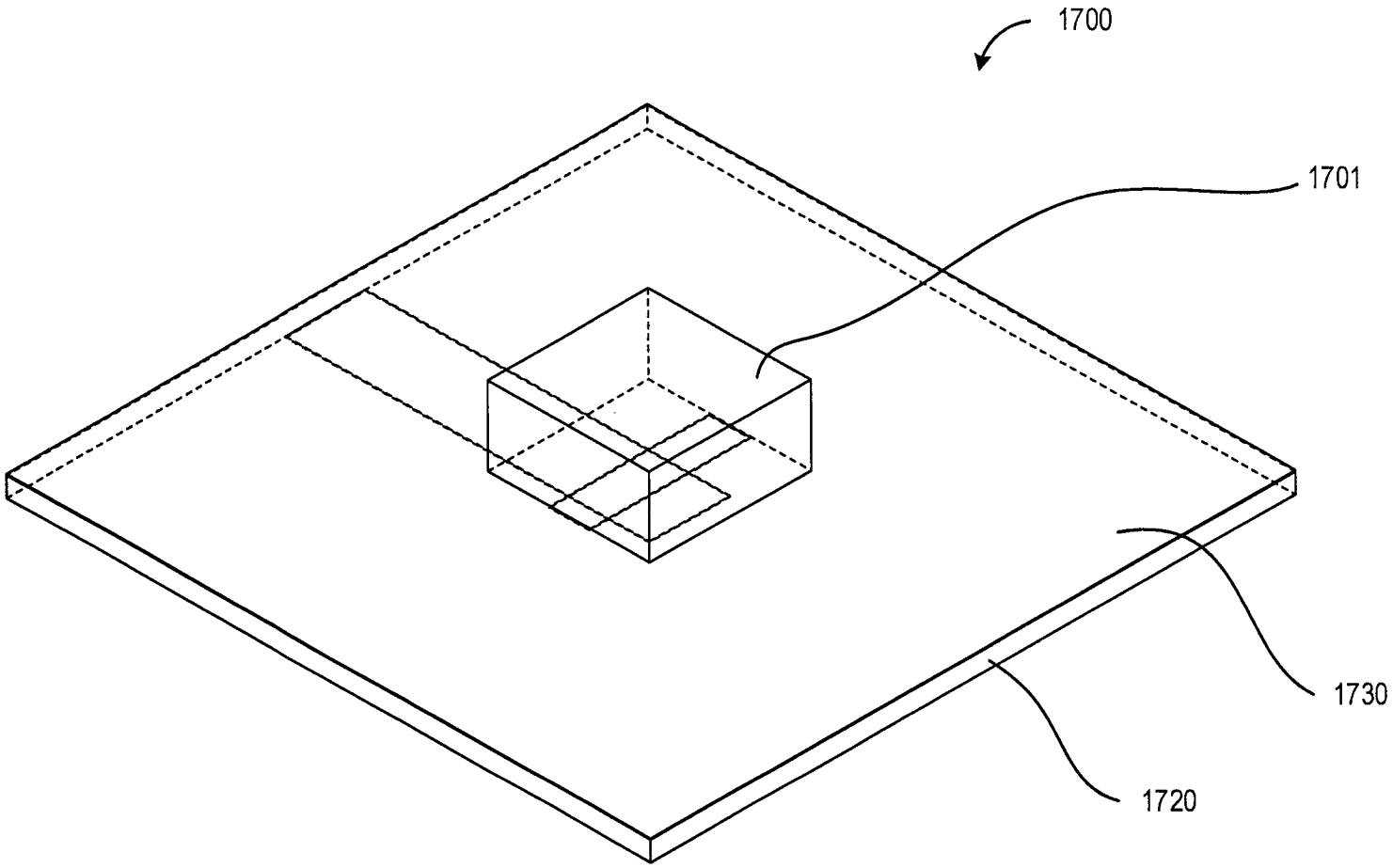
FIG. 17B is a perspective view of the PRA element of FIG. 17A.

Several types of coupling structures are shown in FIGS. 2A, 3, 12A, 13A, 15, 16, 17A and 17B, including, for example 1) a section of thin metal microstrip line 1505 under the DRA element 1501 of FIG. 15; 2) a tapered section of thin metal microstrip line 1605 under the DRA element 1601 of FIG. 16; 3) a slot 1706 in the ground plane under the DRA element 1701 of FIGS. 17A and 17B; 4) a sidewall vertical strip 205 of FIG. 2A; 5) an embedded vertical strip 305 of FIG. 3A; 6) a tall metal TL side coupled microstrip line 1205 of FIG. 12A; and 7) a tall metal TL end coupled microstrip line 1305 of FIG. 13A.

Some of these coupling structures (e.g., 200, 300, 1200, 1300, and 1600) may perform better for exciting elements made from very low permittivity dielectric materials (e.g., $\varepsilon_r<6$), although these structures also typically work for elements made from higher permittivity dielectric materials (e.g., $\varepsilon_r>6$). Some of the coupling structures (e.g., 1500 and 1700) may not perform as well for exciting elements made from very low permittivity dielectric materials and may be more appropriate for elements made from higher permittivity dielectric materials. However, these coupling structures (1500 and 1700) can be made to excite such very low permittivity elements if they are realized using very low permittivity substrates (typically with $\varepsilon_r$ substantially lower than that of the elements).

It should be noted that various different combinations of the DRA element coupling structures and TL-based signal distribution structures presented above are possible, and can be combined using TL transitions. The example combinations presented herein describe only a subset of the possible combinations to aid understanding.

As described, some of the example embodiments of the PRA arrays presented demonstrate monolithically fabricated PRA elements made of very low permittivity materials ($\varepsilon_r<6$), which are typical of polymer materials. It should be noted that the PRA arrays described herein may also be formed with various dielectric materials (e.g., composite materials made from combinations of polymers and ceramics, or other materials) of various permittivity values. The operational range of the permittivity values for the DRA arrays described herein may be approximately 3 to 12, for example.

Although the embodiments herein are generally described as radiating an input signal into space, the present teachings can be equally applied to antennas and antenna arrays used to receive signals, or to bidirectional transmitting and receiving antennas and antenna arrays.

Example 1—Arrays with Vertical Strip Coupling Structures

Reference is now made to FIG. 1A, which is a plan view of a signal distribution structure 100 for an antenna array with two antenna elements. The distribution structure 100 includes a signal input port 140 for receiving the excitation signal and a signal divider 136 electrically coupled to the signal input port 140. The signal divider 136 can divide the received excitation signal and provide the divided excitation signal to each respective feedline 132*a*, 132*b*. A simple T-divider is shown, however other types of signal dividers can also be used.

The distribution structure 100 can generally be used in DRA arrays with two resonator bodies. For PRA arrays, the distribution structure 100 may be configured to provide wideband operation. For example, the bandwidth of the signal divider 136 may be increased by providing quarter wavelength binomial (or other) impedance transformation sections between the signal divider 136 and the feedlines (132*a*, 132*b*).

Figure 1B:
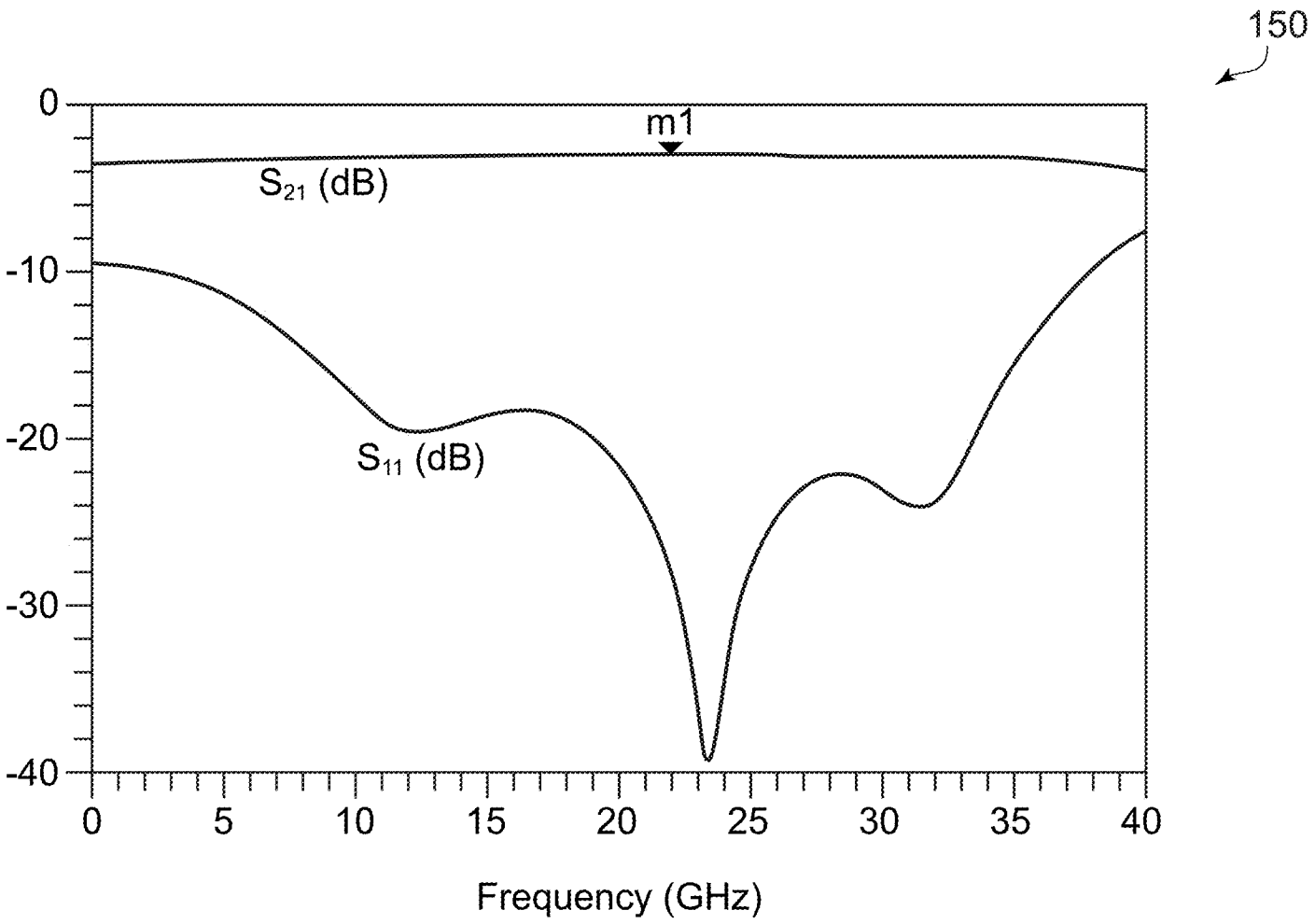
FIG. 1B is a plot of a sample frequency response using the distribution structure of FIG. 1A.

A plot 150 of a sample frequency response using the distribution structure 100 is shown in FIG. 1B. As shown in FIG. 1B, a very wideband operation is achieved in the general range of 10 GHz to 35 GHz, with S21 and S31 (not shown) very close to −3 dB, and S11 less than −15 dB. Due to similar loads (antenna elements) at the end of the feed lines, high isolation between output ports is not important for this feed network. The feed is designed so that the space between the two feedlines 132*a*, 132*b* is equal to the space required between the antenna elements in the fabricated array, in this example 8.8 mm.

Applications of the general distribution structure 100 to different types of 2-element DRA arrays, such as shown in at least FIGS. 4A, 5A and 18A, will now be described in the examples that follow.

FIG. 2A is a perspective view of an example single PRA antenna element 201 excited by a sidewall vertical strip 205. PRA element 201 may be formed, for example, of SU-8 ($\varepsilon_r$=3.8) with dimensions of 3.9 mm×3.9 mm×2 mm (L×W×H), on a 0.5 mm thick AF45 grounded glass substrate 240 with relative permittivity of approximately 6. The sidewall vertical strip 205 is substantially the same width as the microstrip feed line 204 (e.g., 0.78 mm), and extends to the top of the PRA element 201. More generally, the width of these sidewall vertical strip 205 and microstrip feed line 204 may be different and may interface at a width discontinuity, or one or both of the lines could be tapered to interface with or without discontinuity. Also, in some cases, the height of the side-wall strip may not extend to the top of the PRA element, but typically extends from 10 to 100% to the top of the PRA element 201.

It will be understood that, although not explicitly shown in perspective or plan views, a metal ground plane is also provided beneath glass substrate 240 of FIG. 2A, and in the various configurations described herein (e.g., in FIGS. 3, 4A, 5A, 6A, 6B, 8A, 9A, 12A, 13A, etc.).

Figure 2B:
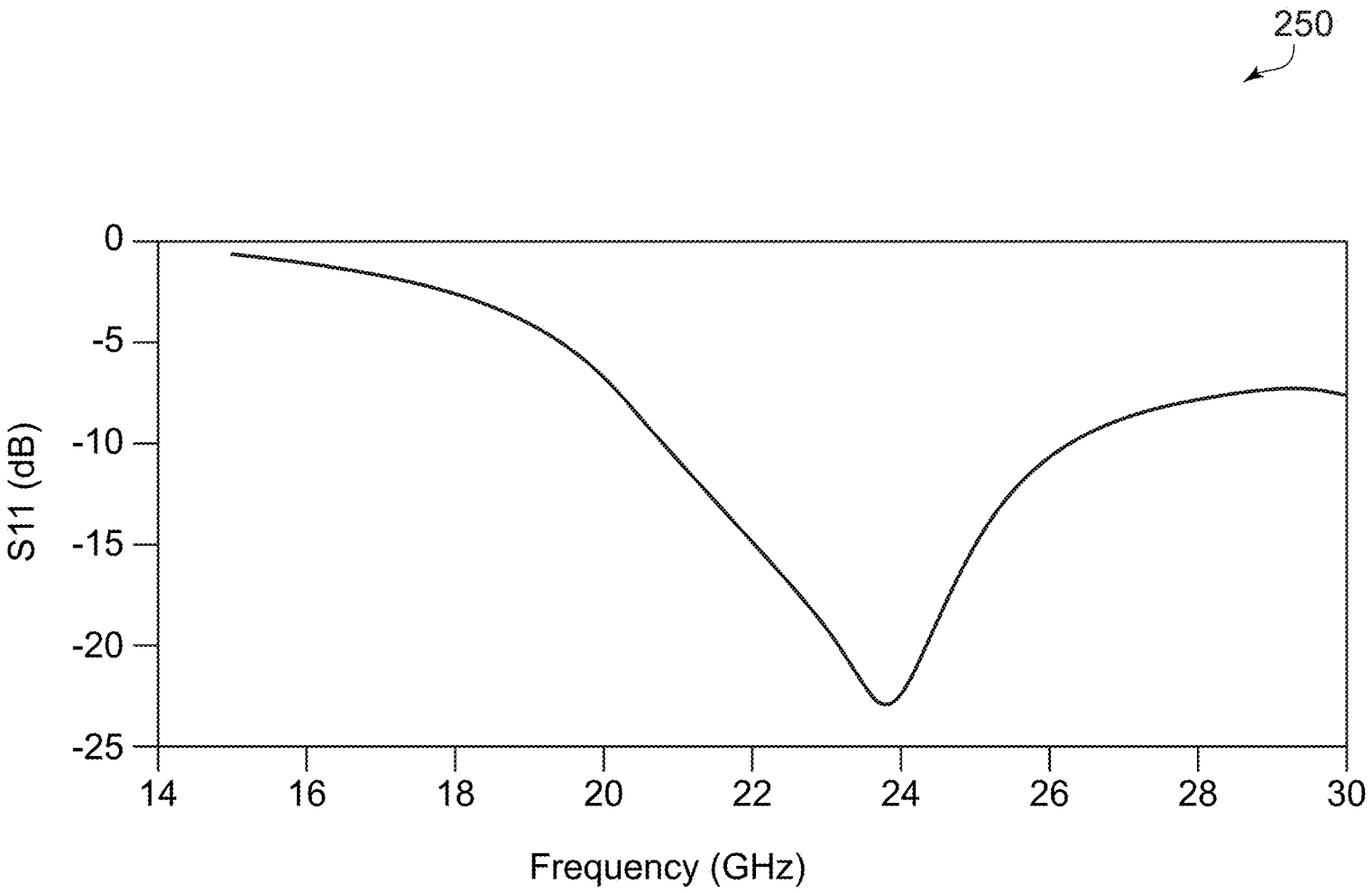
FIG. 2B is a plot of reflection coefficient as a function of frequency for the antenna element configuration shown in FIG. 2A.
Figure 2C:
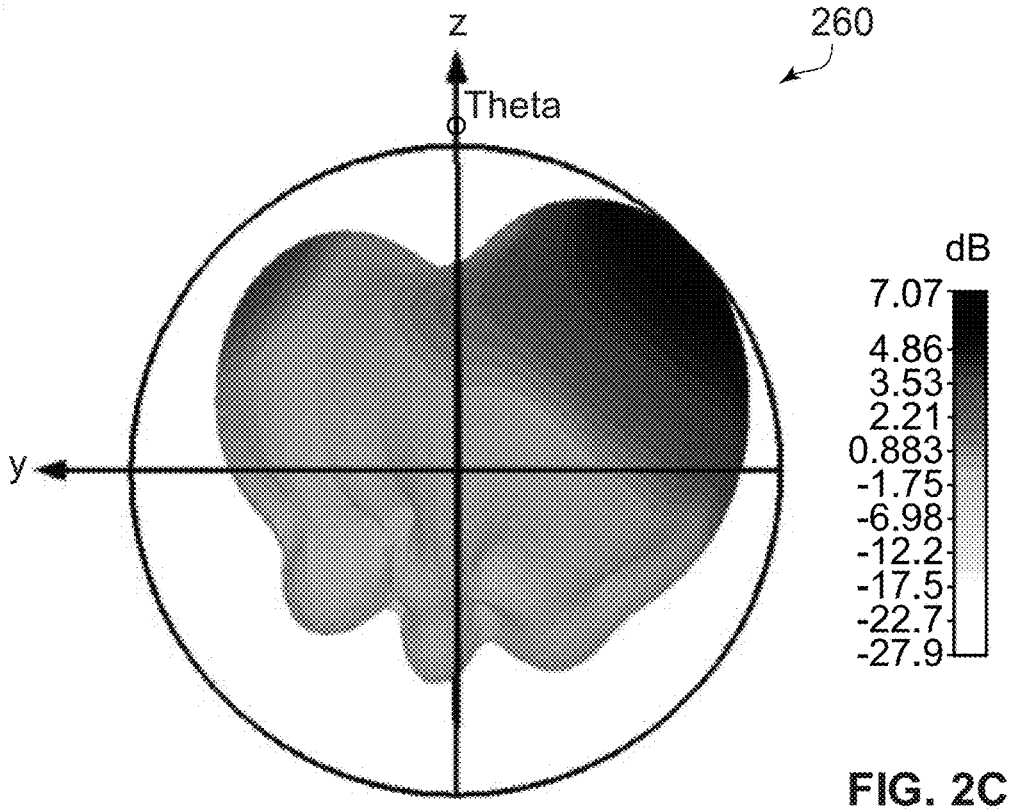
FIGS. 2C and 2D illustrate different planes perpendicular to each other and mutually perpendicular to the substrate surface, of radiation patterns showing the realized gain distribution for the element of FIG. 2A.
Figure 2D:
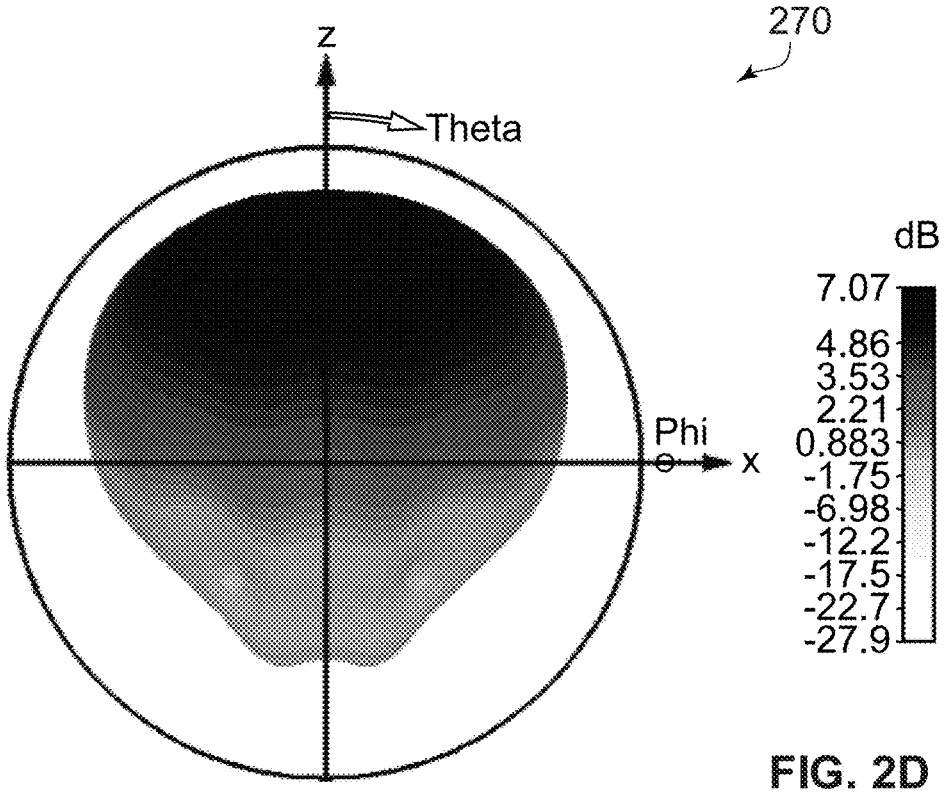

FIG. 2B is a plot 250 of reflection coefficient as a function of frequency for the antenna element configuration 200 shown in FIG. 2A. FIG. 2B demonstrates that the example single vertical strip-coupled PRA element 201 resonates at 23.8 GHz with a good match of −23 dB, and has a large −10 dB bandwidth of 23%, which suggests that the coupling structure is appropriate for successful excitation of very low permittivity single antenna array elements. The realized gain at resonance is quite high at around 7 dBi, and a slight skew in the radiation direction of maximum gain in one plane is due to the low permittivity of the PRA element 201 and the asymmetric side-coupling scheme (as illustrated at 260 in FIG. 2C and at 270 in FIG. 2D). The side-coupling configuration offers high gain for the low permittivity element.

In other embodiments, an embedded vertical strip coupling configuration such as configuration 300 illustrated in FIG. 3 can provide similar performance to the side-coupled configuration 200. Configuration 300 is generally similar to configuration 200, with the exception of a vertical strip 305 that is embedded within resonator body 301. The embedded vertical strip coupling configuration can alternatively be realized through separate patterning of the vertical strip on a second substrate material, which can be oriented at 90 degrees to the first substrate and abutted and bonded to the main PRA body.

The side-coupled configuration can be particularly effective for exciting low permittivity antenna elements in an array. The side-coupled configuration can also reduce the resonant frequency of the antenna elements as well as the side lobe radiation level and back radiation level. FIG. 4A is a perspective view of an example PRA array 400. The PRA array 400 includes two resonator bodies 420*a*, 420*b* that are each connected to the distribution structure 130 via side-coupled vertical strip structures as in configuration 200 of FIG. 2A. The resonant frequency may be reduced because the substrate 110 of the PRA array 400 is typically in such close proximity to the resonator bodies 420*a*, 420*b* that the substrate 110 may be considered to be a part of the resonator bodies 420*a*, 420*b*. In effect, the resonant frequency can be reduced as the resonator bodies 420*a*, 420*b* appear thicker. When the side-coupled configuration is applied to antenna elements with higher permittivity values, a smaller feed structure may result. The side-coupled array configuration can produce a skew in the resulting radiation pattern at a direction away from a typical broadside radiation (a typical broadside radiation is usually perpendicular to the substrate 110). The skew in the radiation pattern could be acceptable, or even an advantage in some applications, if a true broadside symmetric pattern perpendicular to the first planar surface is not required.

Figure 4A:
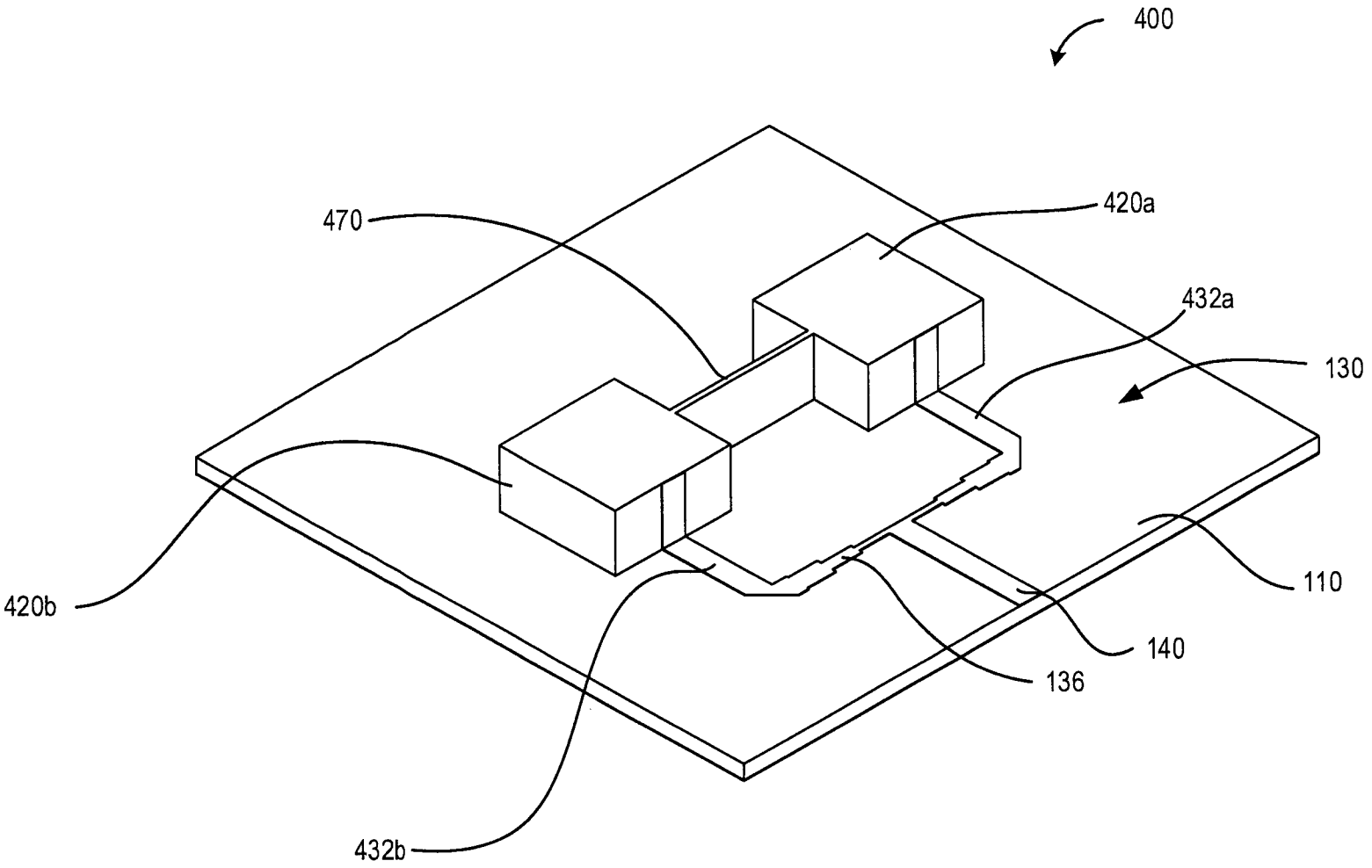
FIG. 4A is a perspective view of an example PRA array.

In the embodiment shown in FIG. 4A, the resonator bodies 420*a* and 420*b* are separated and connected by a narrow wall structure 470, generally formed of the same material as the resonator bodies 420*a* and 420*b* to form a single monolithic structure. The wall structure 470 as depicted is connected at approximately the midpoint of the sidewall of the resonator bodies 420*a* and 420*b*. However, the location of the wall structure 470 shown in FIG. 4A is only an example. The wall structure 470 can generally be connected at any position along the sidewalls, and may not necessarily be straight, but can be of arbitrary lateral geometries. The connection points and geometries can be chosen, in general, to provide minimal effect on the DRA element near-field patterns and the array radiation patterns.

As described, one of the difficulties associated with fabricating DRA arrays is the requirement for each resonator body 420*a* and 420*b* to be individually placed in a precise arrangement and bonded to the substrate 110. Instead of building an antenna array using separate antenna elements, the entire antenna array may be built as a monolithic element. That is, the antenna array may be designed with each antenna element connected to each other via a wall structure 470.

For example, the requirement to position and assemble the antenna elements individually can be eliminated. This allows for a simpler fabrication process and, from a performance perspective, allows for dielectric applications operating at high frequencies and millimeter wave frequencies that would otherwise be difficult to achieve since the positioning of the antenna elements can be more difficult and prone to errors due to the intricate features associated with those applications. Also, DRA elements and arrays with more complicated geometries can be fabricated.

Figure 4B:
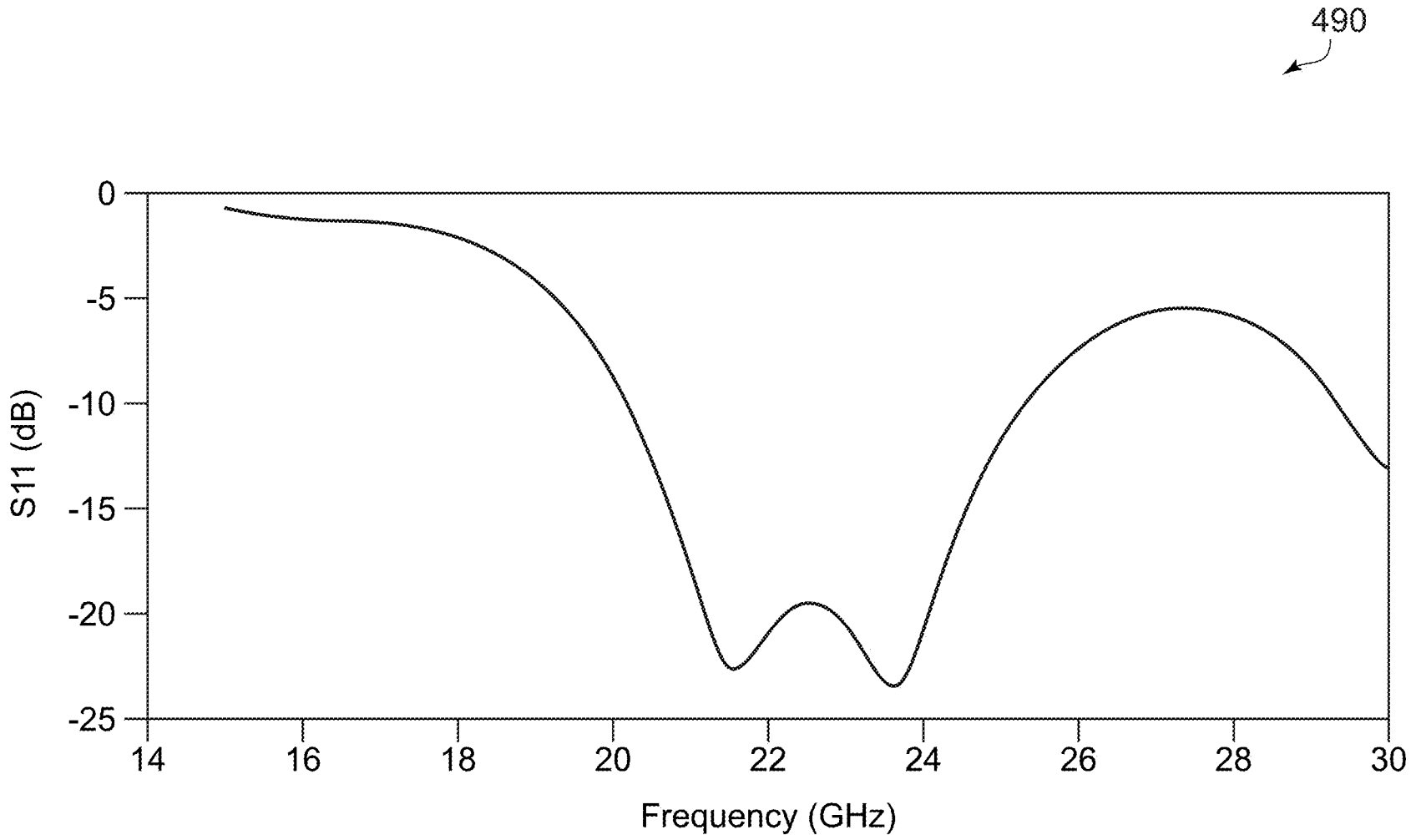
FIG. 4B is a plot of a reflection coefficient for the PRA array of FIG. 4A.
Figure 4C:
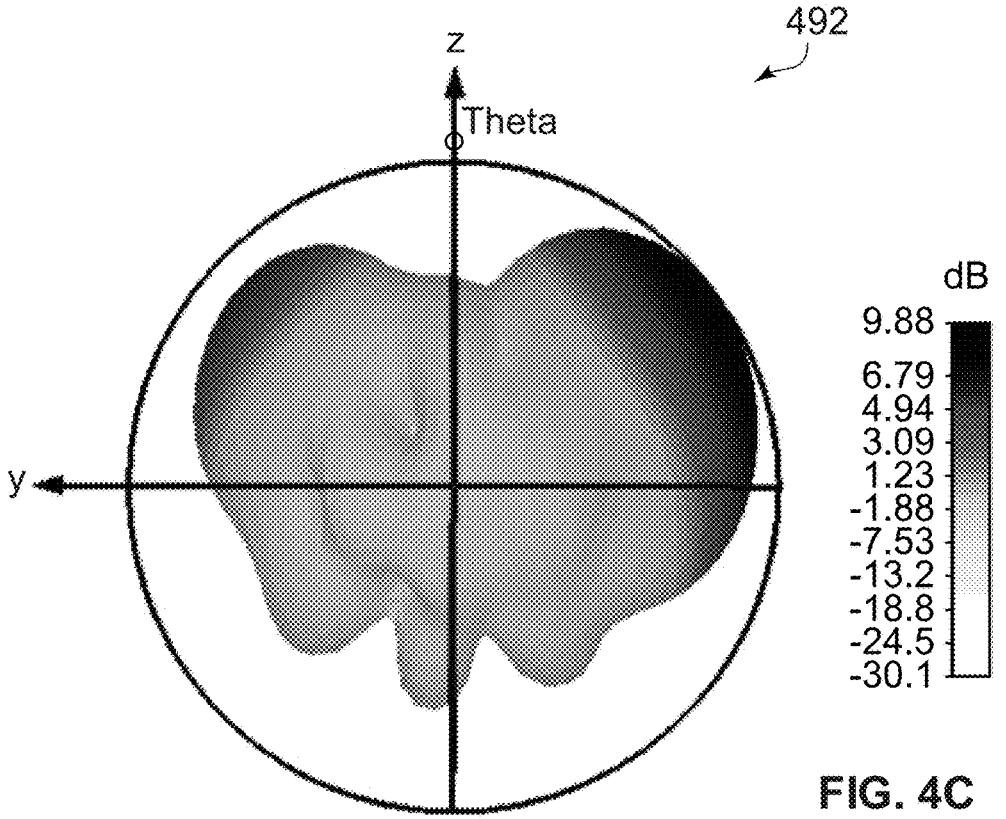
FIGS. 4C and 4D illustrate different planes perpendicular to each other and mutually perpendicular to the substrate surface, of radiation patterns showing the realized gain distribution for the PRA array of FIG. 4A.
Figure 4D:
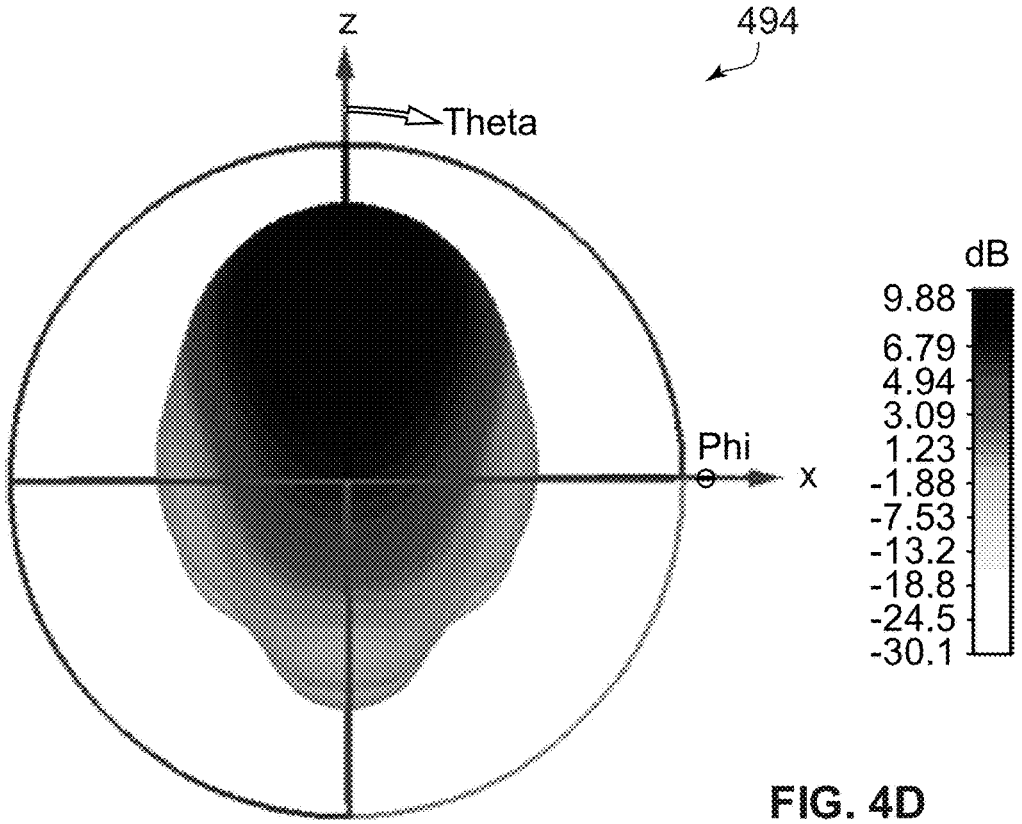

FIGS. 4B, 4C and 4D illustrate plots of sample results for the PRA array 400, when the resonator bodies 420*a*, 420*b* and wall structures 470 are made of SU-8 ($\varepsilon_r$=3.8) with element dimensions of 3.9 mm×3.9 mm×2 mm (L×W×H), on a 0.5 mm thick AF45 glass substrate (εr=6). FIG. 4B is a plot 490 of a reflection coefficient for the PRA array 400. As shown in FIG. 4B, the −10 dB bandwidth for the PRA array 400 is approximately from 20.2 GHz to 25.3 GHz, which is approximately a bandwidth of 22%. FIGS. 4C and 4D illustrate different planes 492 and 494, respectively, perpendicular to each other and mutually perpendicular to the substrate surface, of radiation patterns showing the realized gain distribution for the PRA array 400. The planes 492 and 494 are illustrated at a frequency of operation of approximately 22.5 GHz. A realized gain of 9.9 dBi is achieved with low sidelobe level for the PRA array 400, which is approximately twice the gain (3 dB higher), compared to a single array element.

Figure 5A:
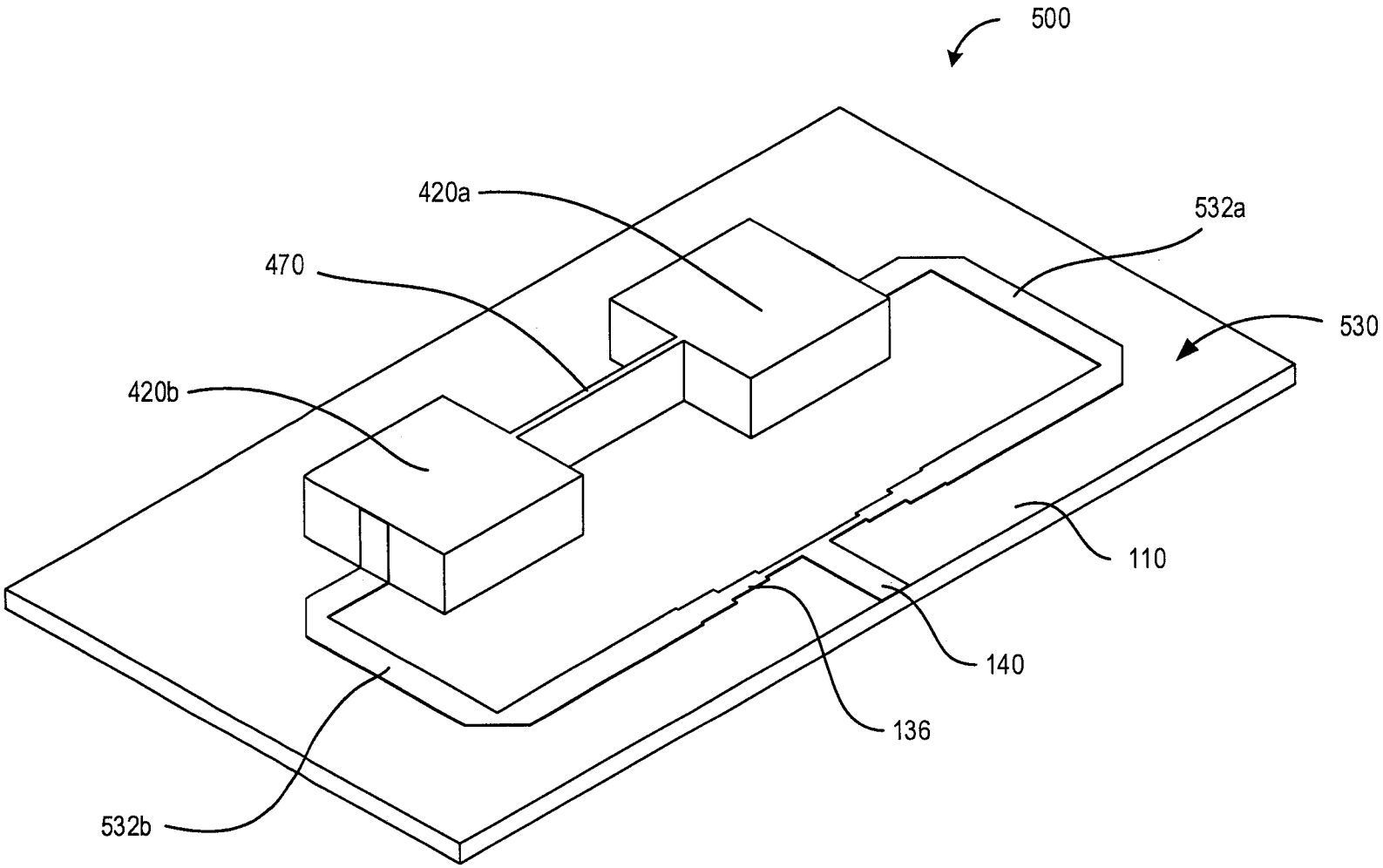
FIG. 5A is a perspective view of another example PRA array.

FIG. 5A is a perspective view of another example PRA array 500. Like the PRA array 400, the PRA array 500 includes two resonator bodies 420*a* and 420*b* that are connected via the wall structure 470 to form a single monolithic structure. Instead of the side-coupled configuration oriented as shown in PRA array 400, the PRA array 500 uses an opposite side-coupled configuration which requires a modified distribution structure 530. The modified distribution structure 530 is generally based on the distribution structure 100 of FIG. 1A but is slightly adjusted at the feedlines 532*a* and 532*b* to accommodate the dimensions of the opposite side-coupled configuration.

Figure 5B:
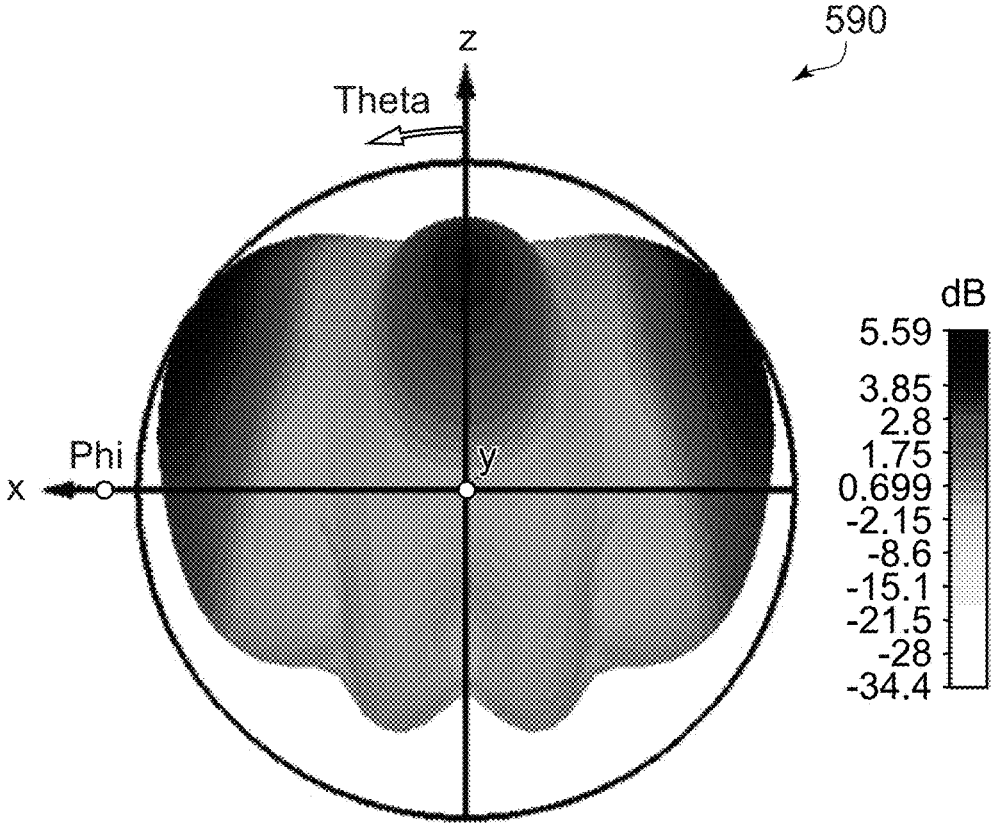
FIGS. 5B and 5C illustrate different planes perpendicular to each other and mutually perpendicular to the substrate surface, of radiation patterns showing the realized gain distribution for the PRA array of FIG. 5A.
Figure 5C:
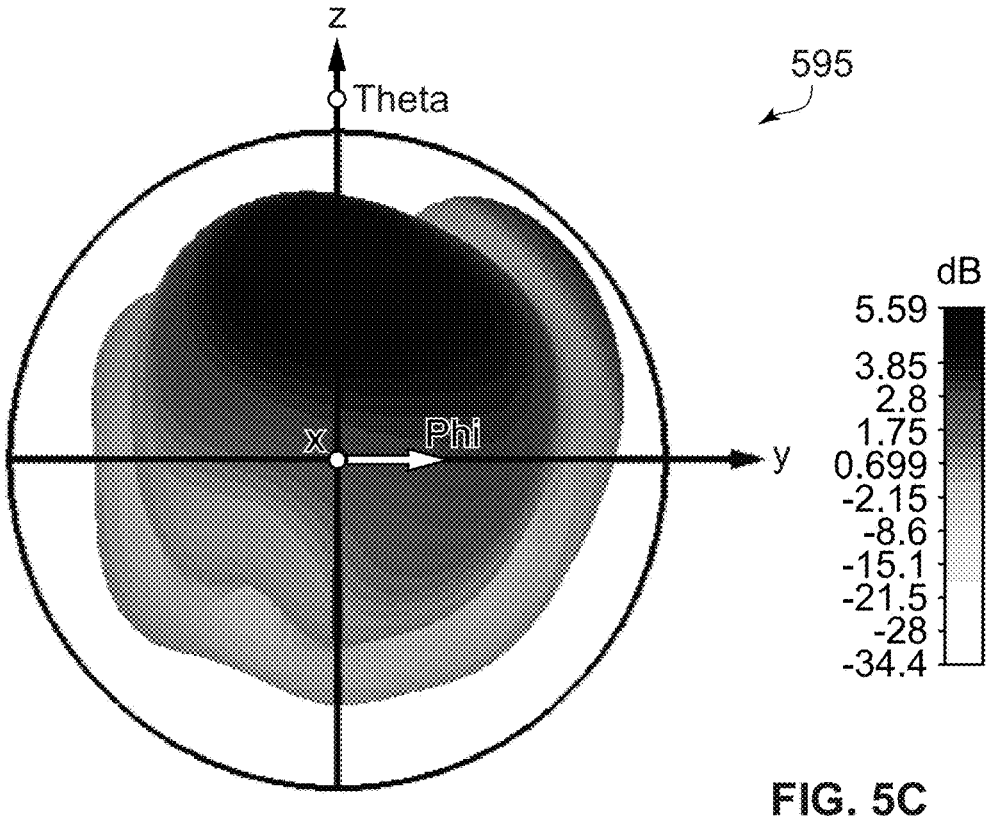

FIGS. 5B and 5C illustrate different planes 590 and 595, respectively, perpendicular to each other and mutually perpendicular to the substrate surface, of radiation patterns showing the realized gain distribution for the PRA array 500. The planes 590 and 595 are illustrated at a frequency of operation of approximately 22.5 GHz. As shown in FIGS. 5B and 5C, the opposite-side-coupled scheme of PRA array 500 acts to remove the skew in the radiation pattern apparent with the side-coupled configuration oriented as shown in PRA array 400, which results in a more symmetric main-lobe pattern as shown in plots 590 and 595, with a gain of 5.6 dBi.

Figure 6A:
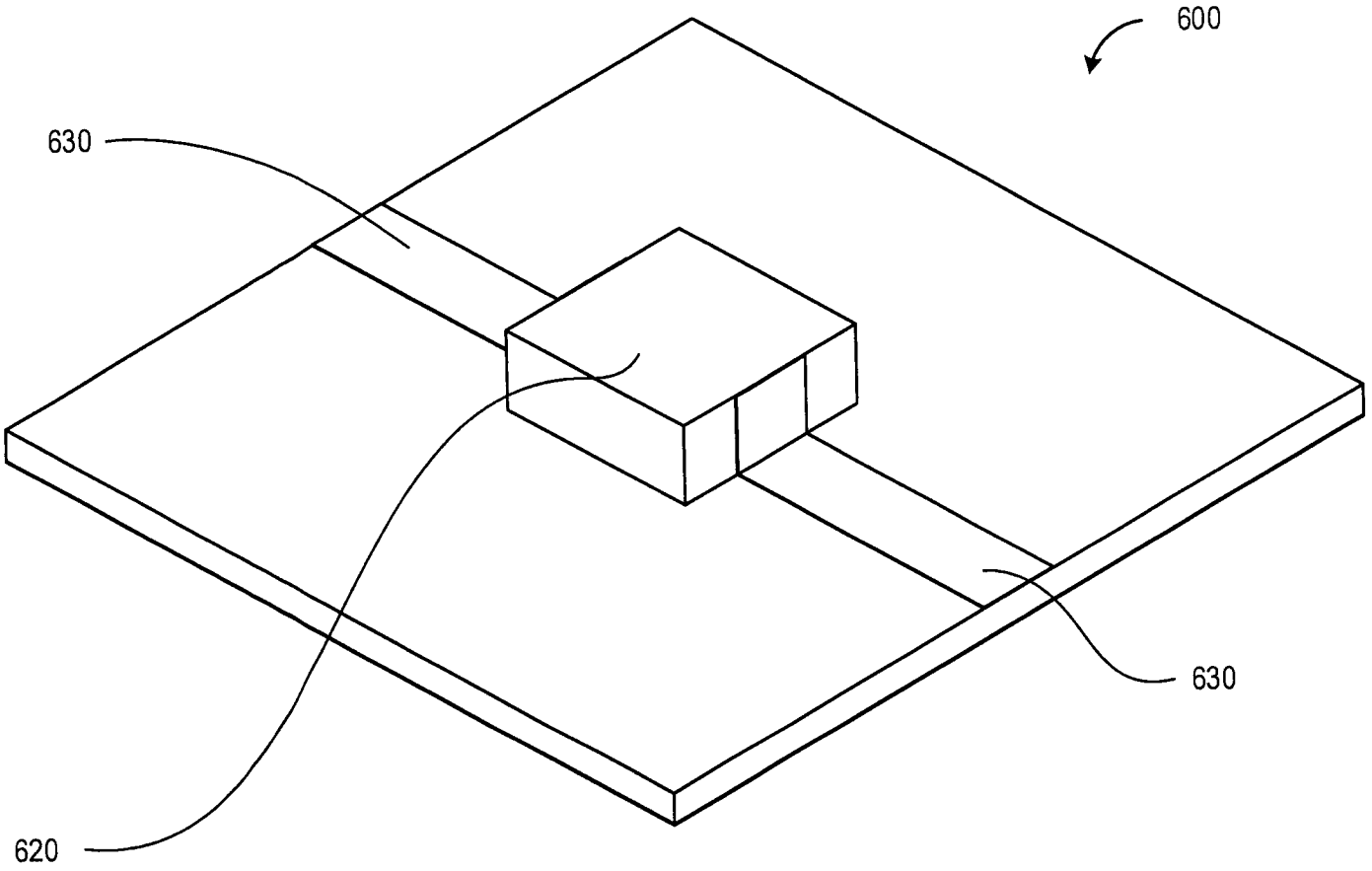
FIG. 6A is a perspective view of an example PRA element with a dual feed structure provided in opposite sidewalls.
Figure 6B:
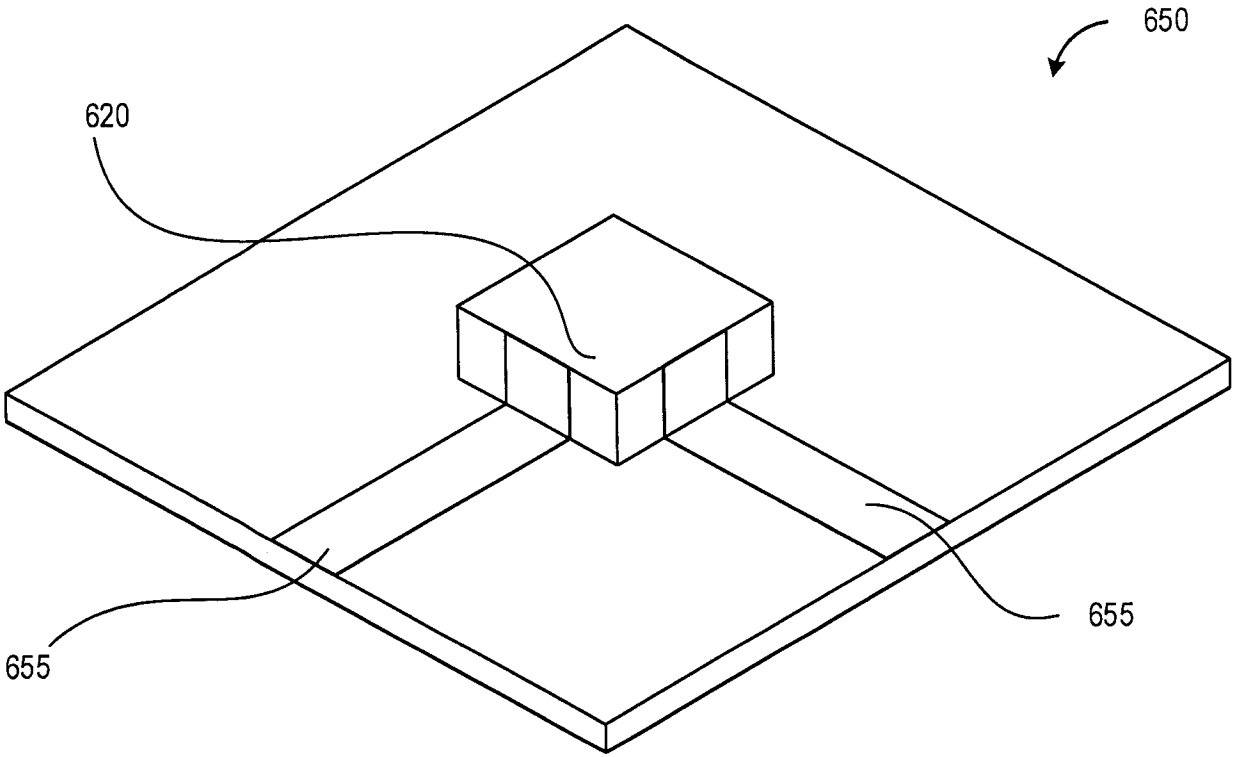
FIG. 6B is a perspective view of an example PRA element with a dual feed structure provided in adjacent sidewalls.

PRA elements can also, in general, be fed simultaneously by multiple coupling structures with the same or different amplitudes or phases which could produce different effects on the radiation characteristics. FIG. 6A is a perspective view of an example PRA 600 with a dual feed structure 630 provided in opposite sidewalls. The vertical metal strip arrangement is demonstrated here, however other coupling structures discussed in various embodiments could also be used. FIG. 6B is a perspective view of an example PRA 650 with a dual feed structure 655 provided in adjacent sidewalls. In FIG. 6B, providing signals with a 90 degree phase difference (for instance by using a quadrature or Lange coupler, or other techniques known in the art) can produce substantially circular polarization in the radiated signal. In the embodiments shown in FIGS. 6A and 6B, only one resonator body 620 is shown for ease of exposition. In other embodiments, a multiple feed structure may be applied to a PRA array with multiple resonator bodies.

The opposite double side-coupled configuration shown in FIG. 6A can provide a PRA element with a more broadside radiation pattern, if fed by signals with a 180 degree phase difference (for instance by using a rat-race or ring coupler, or other techniques known in the art).

Figure 6C:
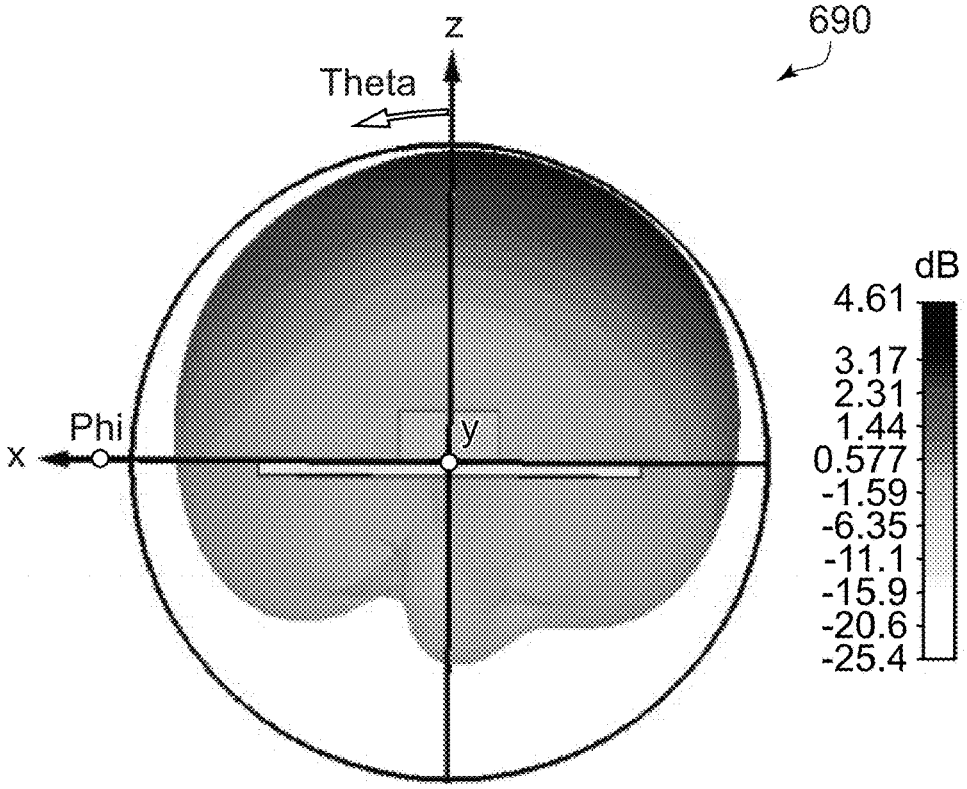
FIGS. 6C and 6D illustrate different planes perpendicular to each other and mutually perpendicular to the substrate surface, of radiation patterns showing the realized gain distribution for the PRA of FIG. 6A.
Figure 6D:
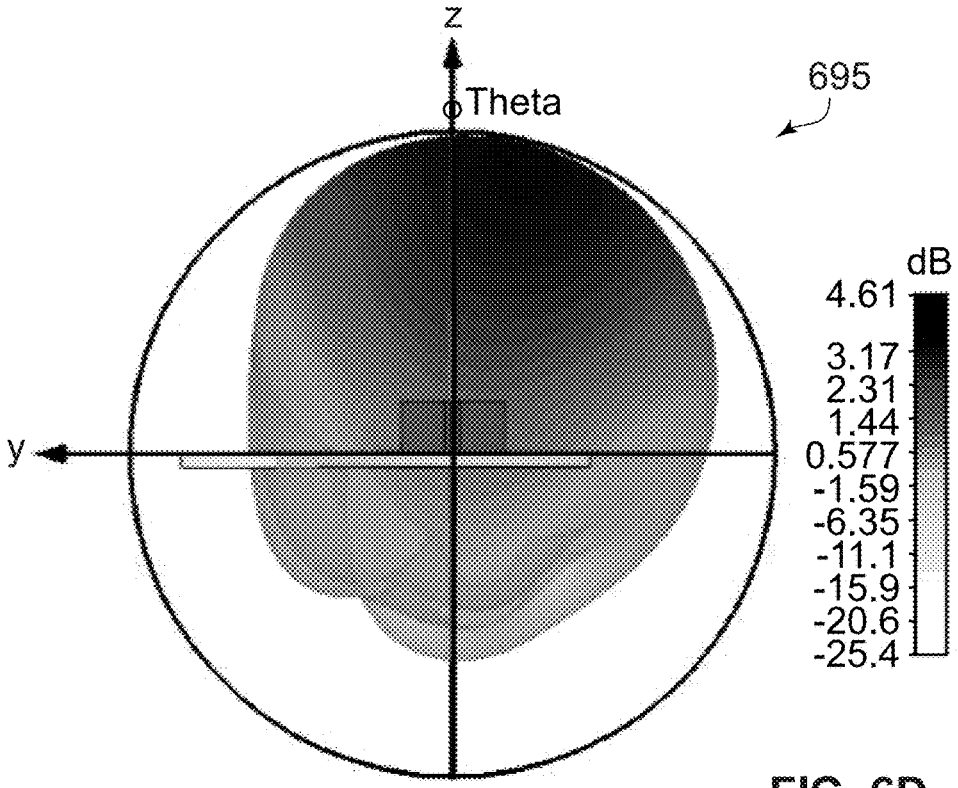

FIGS. 6C and 6D illustrate different planes 690 and 695, respectively, perpendicular to each other and mutually perpendicular to the substrate surface, of radiation patterns showing the realized gain distribution for the 180 degree dual fed PRA 600 assuming the resonator body 620 is made of SU-8 ($\varepsilon_r$=3.8) with element dimensions (L×W×H) of 3.9 mm×3.9 mm×2 mm, on a 0.5 mm thick AF45 glass substrate (εr=6). The planes 690 and 695 are illustrated at a frequency of operation of approximately 19 GHz. This scheme provides a balanced feed (nominal 180 degree phase shift) to simultaneously feed both sides of the array elements with two vertical strips (opposite side-walls). This scheme will result in a more symmetric and broad pattern, as shown in plots 690 and 695, at the expense of slightly lower gain (4.6 dBi in this case).

The distribution structure 100 of FIG. 1A, which has a general 1-2 port structure, can be expanded to support PRA arrays with a larger number of elements, both in one-dimensional patterns (1×N elements) or two-dimensional patterns (N×N elements). The simplest approach is to cascade the 1-2 port structure as many times as required to obtain the required number of feed ports. This approach works for an even or odd number of ports, and is demonstrated in FIG. 9A for an even number of ports which can be used to distribute signals to a 1×4 element PRA array, and in FIG. 19A for an odd number of ports with distribution structure 1900, which can be used to distribute signals to a 1×3 element PRA array.

Figure 7A:
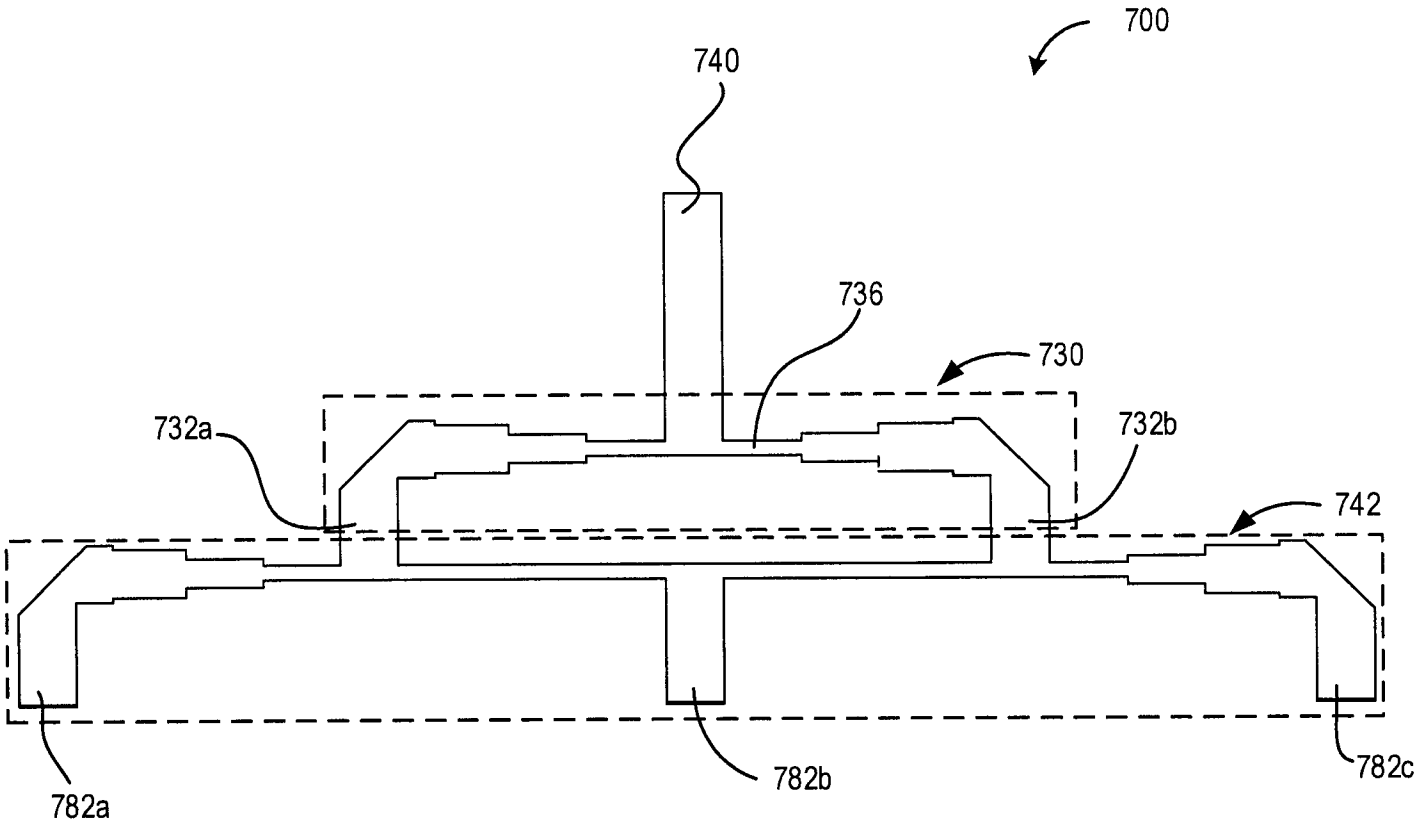
FIG. 7A is a plan view of an example embodiment of a distribution structure.

Reference is now made to FIG. 7A, which is a plan view of an example embodiment of a distribution structure 700 that can be used to distribute signals to the feed structures of a 1×3 element PRA array, in a more balanced structure compared to distribution structure 1900, and which may be preferred from a layout perspective.

A distribution structure for an antenna array with an odd number of antenna elements, such as distribution structure 700, can be more difficult to design than a distribution structure for an even number of antenna elements, such as distribution structure 100, since the feedlines to the antenna element coupling structures would no longer be symmetrical. As shown in FIG. 7A, the design of the distribution structure 700 relies on a signal combining approach that can be extrapolated to antenna arrays with an odd number of antenna elements, in general. By removing one of the feedlines 132*a* or 132*b* in the first cascade of the 1-2 port structures of distribution structure 100 and replacing them with 100 Ohm lines combined in a middle feedline 782*b*, a 1-2-3 distribution structure 700 can be provided. By selecting the length of the feedlines 782*a*, 782*b* and 782*c*, first the phases of all three ports are matched, and then the port end points are aligned. Finally, the spacing between them is set to the desired distance, in this example 8.8 mm.

The distribution structure 700 includes a signal port 740 for receiving the excitation signal, a first sub-structure 730 based on the distribution structure 100 of FIG. 1A and a second sub-structure 742 coupled to the first sub-structure 730. Similar to the distribution structure 100, the first sub-structure 730 includes a signal divider 736 that is electrically connected to the signal port 740. The signal divider 736 can divide the received excitation signal and provide the divided excitation signal to respective feedlines 732*a* and 732*b*. The second sub-structure 742 includes feedlines 782*a*, 782*b* and 782*c* that are coupled to the feedlines 732*a* and 732*b* for receiving the excitation signal.

The distribution structure 700 may be used for providing a non-uniform signal amplitude and/or phase distribution. For example, a phase of the excitation signal at each of the feedlines 782*a*, 782*b* and 782*c* can be adjusted in design by adjusting relative feedline lengths. Also, the space between each of the feedlines 782*a*, 782*b* and 782*c* can also be adjusted accordingly.

Figure 7B:
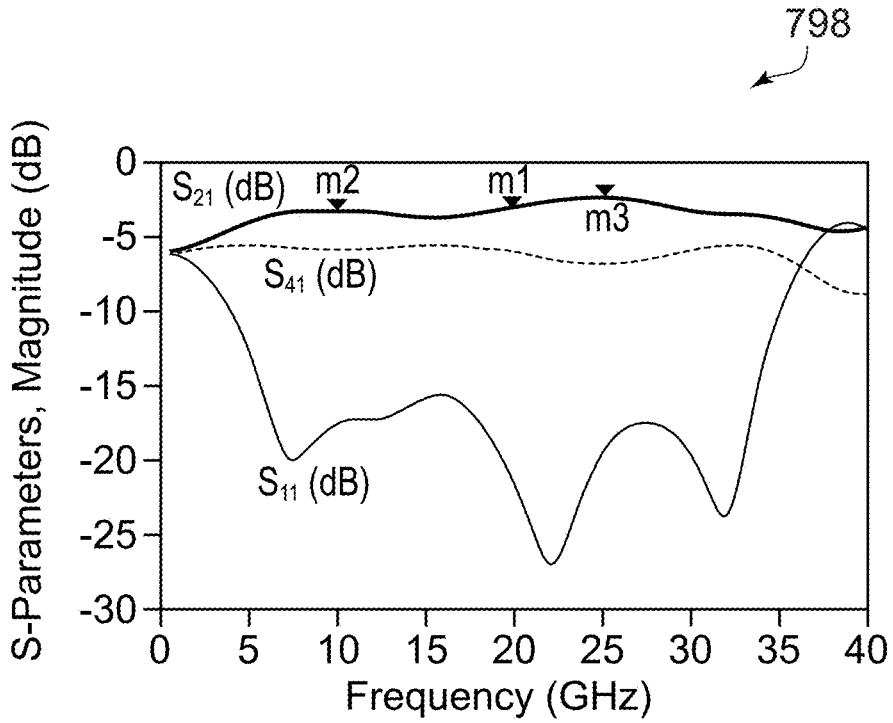
FIGS. 7B and 7C are plots of magnitude and phase of scattering parameters (S21, S41, S11) for the distribution structure of FIG. 7A.
Figure 7C:
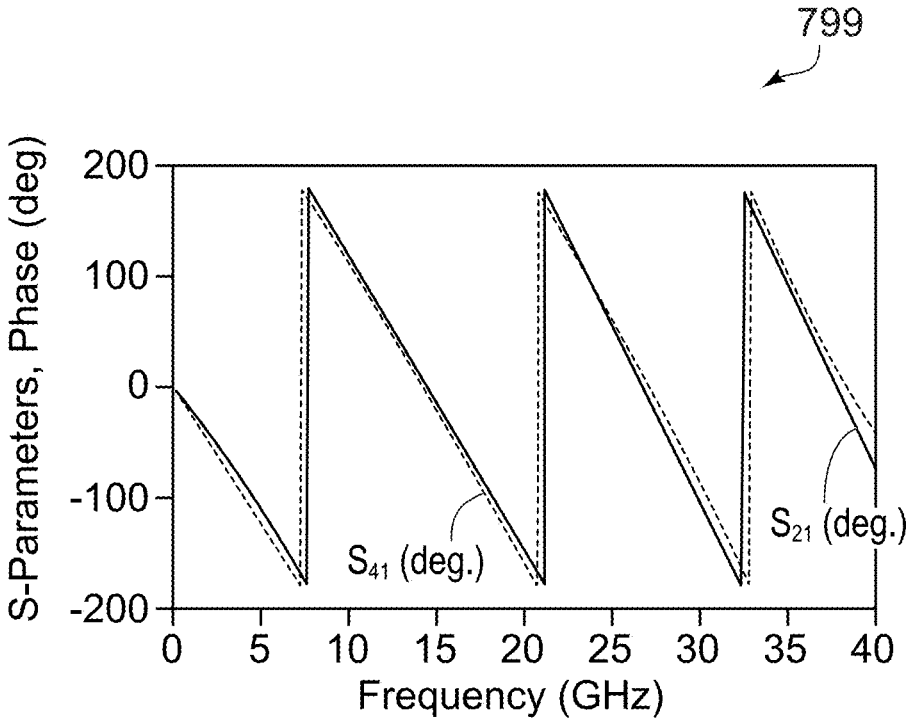

FIGS. 7B and 7C are plots 798 and 799 of magnitude and phase of scattering parameters (S21, S41, S11), respectively, for the distribution structure 700. As shown in FIG. 7B, a very wideband operation in the general range of 4 GHz to 35 GHz can be obtained.

Figure 8A:
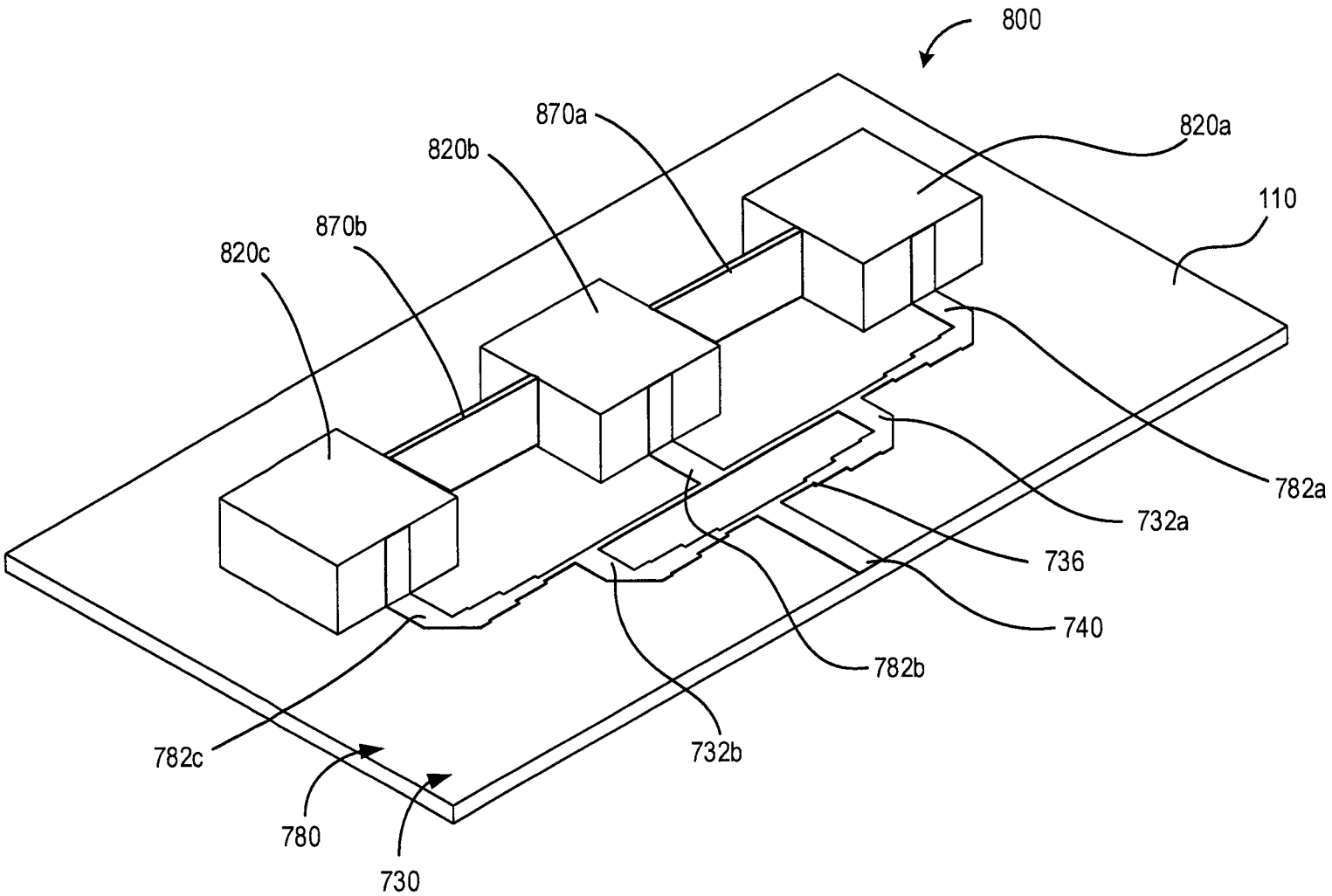
FIG. 8A is a perspective view of an example PRA array.

FIG. 8A is a perspective view of an example PRA array 800. The monolithic PRA element array structure in this example embodiment is formed of a low permittivity material, SU-8, with a permittivity of 3.8 at microwave frequencies with element dimensions (L×W×H) of 3.9 mm×3.9 mm×2 mm, on a 0.5 mm thick AF45 glass substrate (εr=6). The monolithic PRA element array structure includes three resonator bodies 820*a*, 820*b* and 820*c* that are each connected to the feed structure 700 via a side-coupled configuration. The elements are connected together using narrow connecting structures 870*a* and 870*b* made of the SU-8 material, to form the monolithic structure.

Figure 8B:
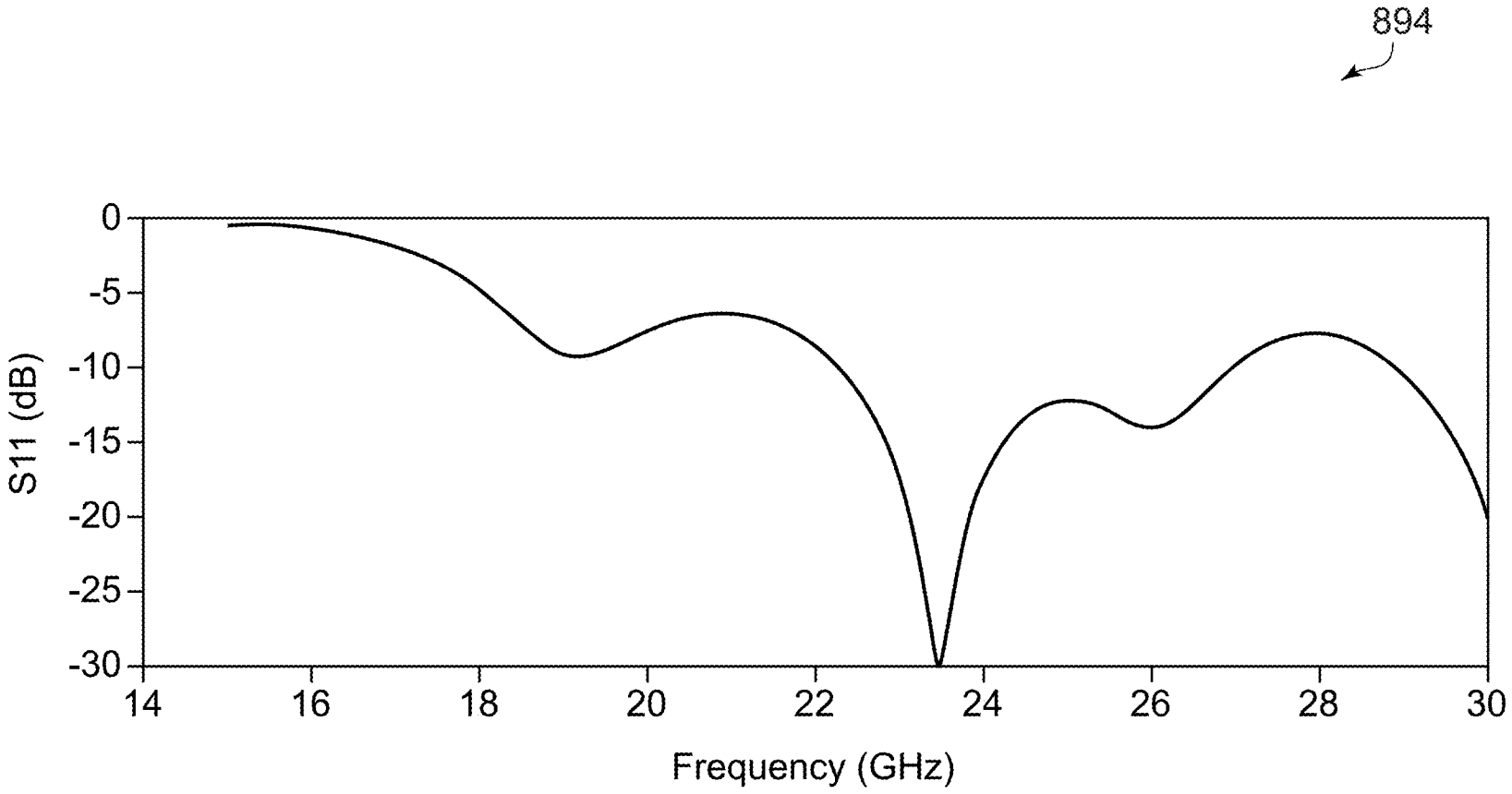
FIG. 8B is a plot of a reflection coefficient for the PRA array of FIG. 8A.
Figure 8C:
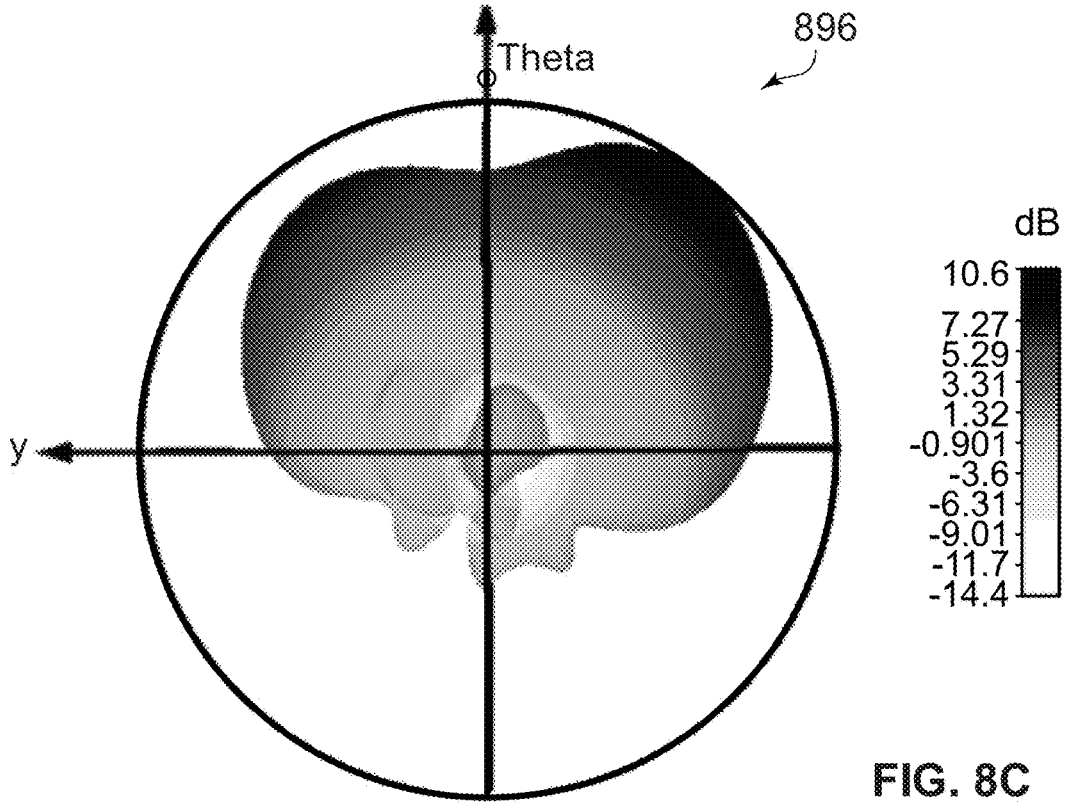
FIGS. 8C and 8D illustrate different planes perpendicular to each other and mutually perpendicular to the substrate surface, of radiation patterns showing the realized gain distribution for the PRA array of FIG. 8A.
Figure 8D:
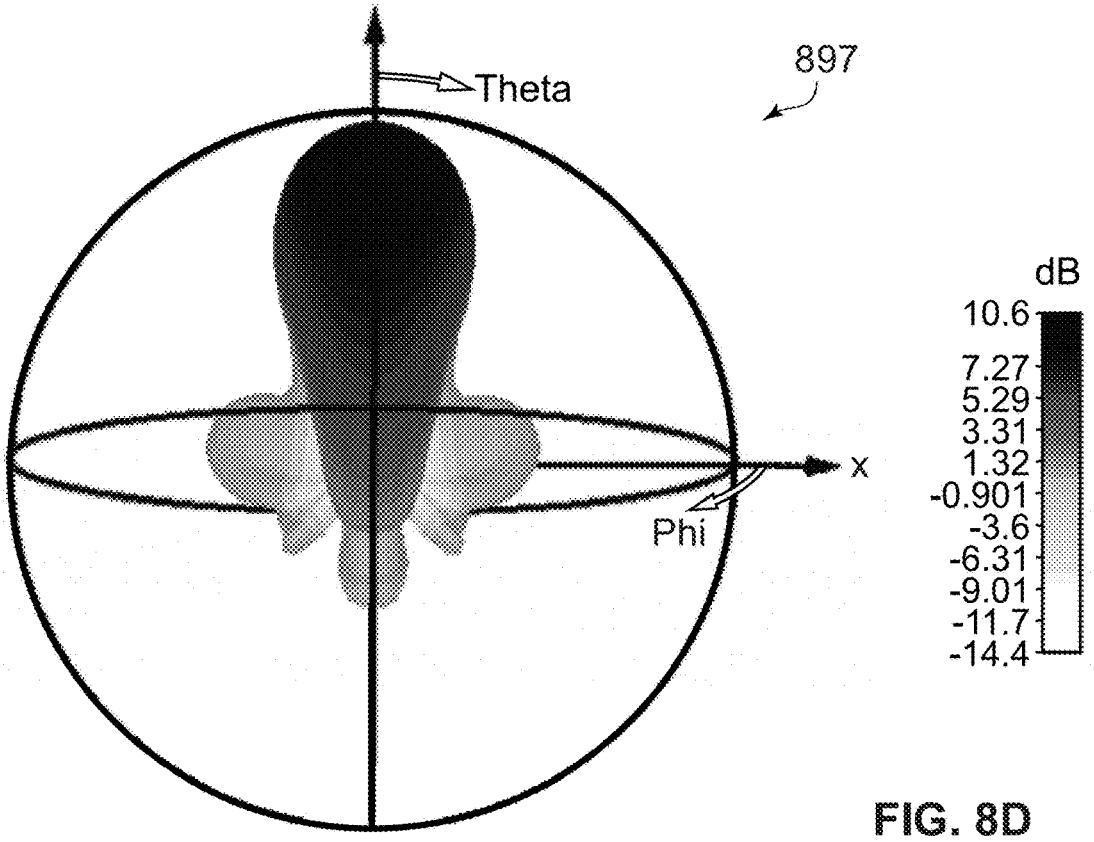

FIGS. 8B, 8C and 8D are plots of sample results for the PRA array 800. FIG. 8B is a plot 894 of a reflection coefficient for the PRA array 800. As shown in FIG. 8B, the −10 dB bandwidth for the PRA array 800 is approximately from 22.3 GHz to 27 GHz, which is approximately 19% bandwidth. FIGS. 8C and 8D illustrate different planes 896 and 897, respectively, perpendicular to each other and mutually perpendicular to the substrate surface, of radiation patterns showing the realized gain distribution for the PRA array 800. The planes 896 and 897 are illustrated at a frequency of operation of approximately 24.5 GHz. A realized gain of 10.6 dBi is achieved for the PRA array 800 with a low sidelobe level. The realized gain is roughly 1 dB more than that of the PRA array 400 of FIG. 4A (with two resonator bodies 420*a* and 420*b*). This is slightly less than expected and may be due to additional loss and radiation in the larger distribution structure 700, for instance the various corners, and also possible sub-optimal signal distribution and spatial combining from the non-symmetric distribution structure 700.

The configuration shown in PRA array 800 may also be used for exciting PRA elements with higher permittivity, for example, those made from polymer-ceramic composite materials rather than lower permittivity pure polymer materials. A sample of a monolithic PRA element array structure formed of composite material with higher permittivity of 7 at microwave frequencies with element dimensions (L×W×H) of 3.9 mm×3.9 mm×1 mm, on a 0.5 mm thick AF45 glass substrate (εr=6) provides similar performance to the previous example, and slightly higher gain (12.2 dBi) at a frequency of operation of approximately 24.5 GHz.

Figure 8E:
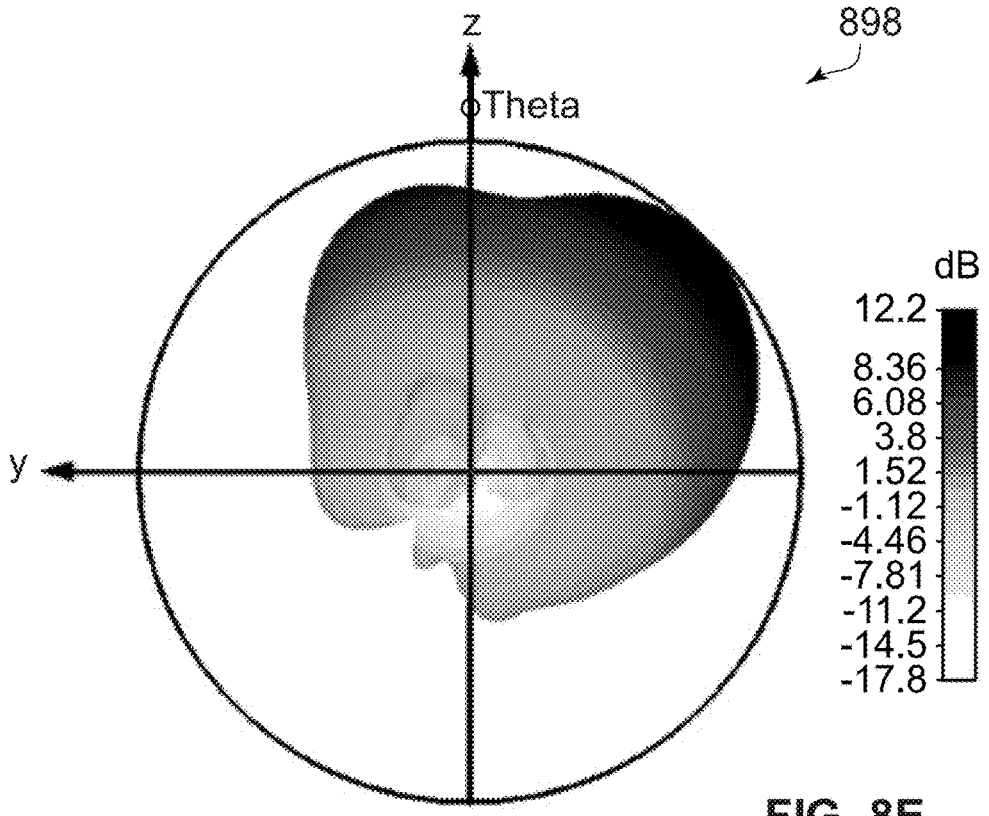
FIGS. 8E and 8F illustrate different planes perpendicular to each other and mutually perpendicular to the substrate surface, of radiation patterns showing the realized gain distribution for the PRA array of FIG. 8A when formed of a material with a permittivity of 7.
Figure 8F:
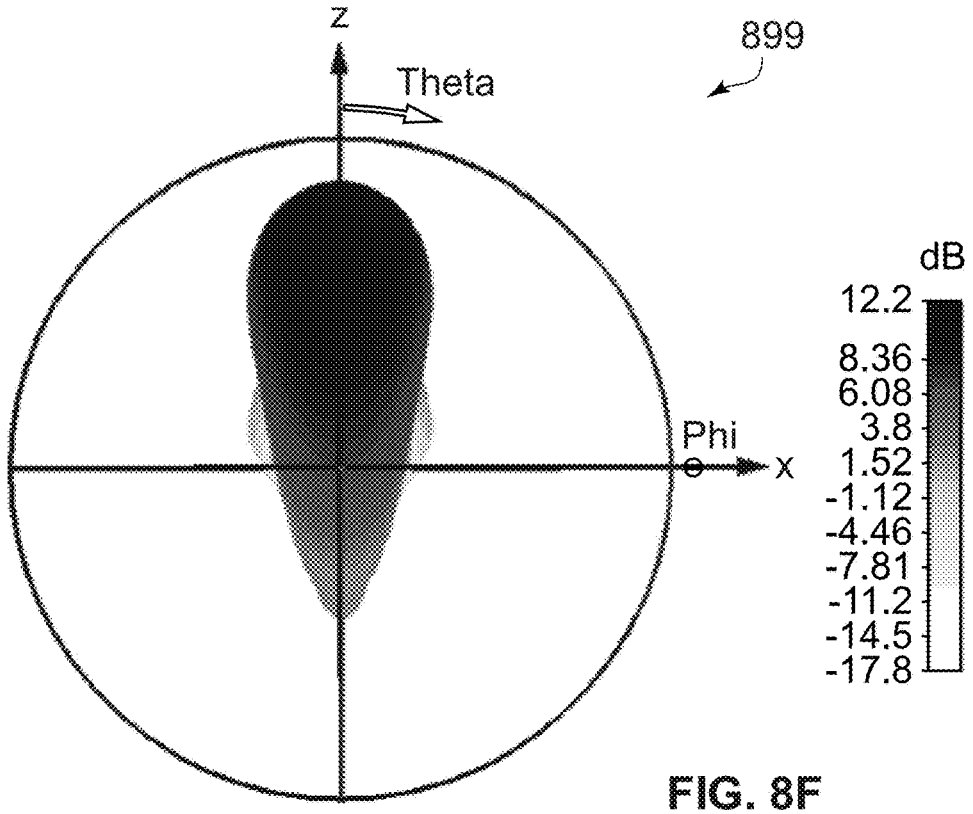

FIGS. 8E and 8F illustrate different planes 898 and 899, respectively, perpendicular to each other and mutually perpendicular to the substrate surface, of radiation patterns showing the realized gain distribution for the PRA array 800 formed of a material with a permittivity of 7. The planes 898 and 899 are illustrated at a frequency of operation of approximately 24.5 GHz. Also, in comparing FIG. 8D with FIG. 8F, it can be seen that the radiation pattern associated with the higher permittivity materials is a more directive pattern.

Example 2—Arrays with Microstrip Coupling Structures

Microstrip coupling to PRA array elements using a portion of the microstrip TL directly under the PRA elements is an alternative coupling structure that may be easier to fabricate than the sidewall coupled structure demonstrated in FIG. 4A, for example. However, this approach typically results in less miniaturization effect. The basic configuration shown in FIG. 15 is generally more effective for exciting higher permittivity (typically $\varepsilon_r$>6) PRA arrays. The modified configuration shown in FIG. 16 employs a tapered microstrip TL transition, which functions as an impedance transformer to more effectively excite lower permittivity (typically $\varepsilon_r$<6) PRA arrays. Similar signal distribution networks can typically be employed to those presented elsewhere herein.

Figure 9A:
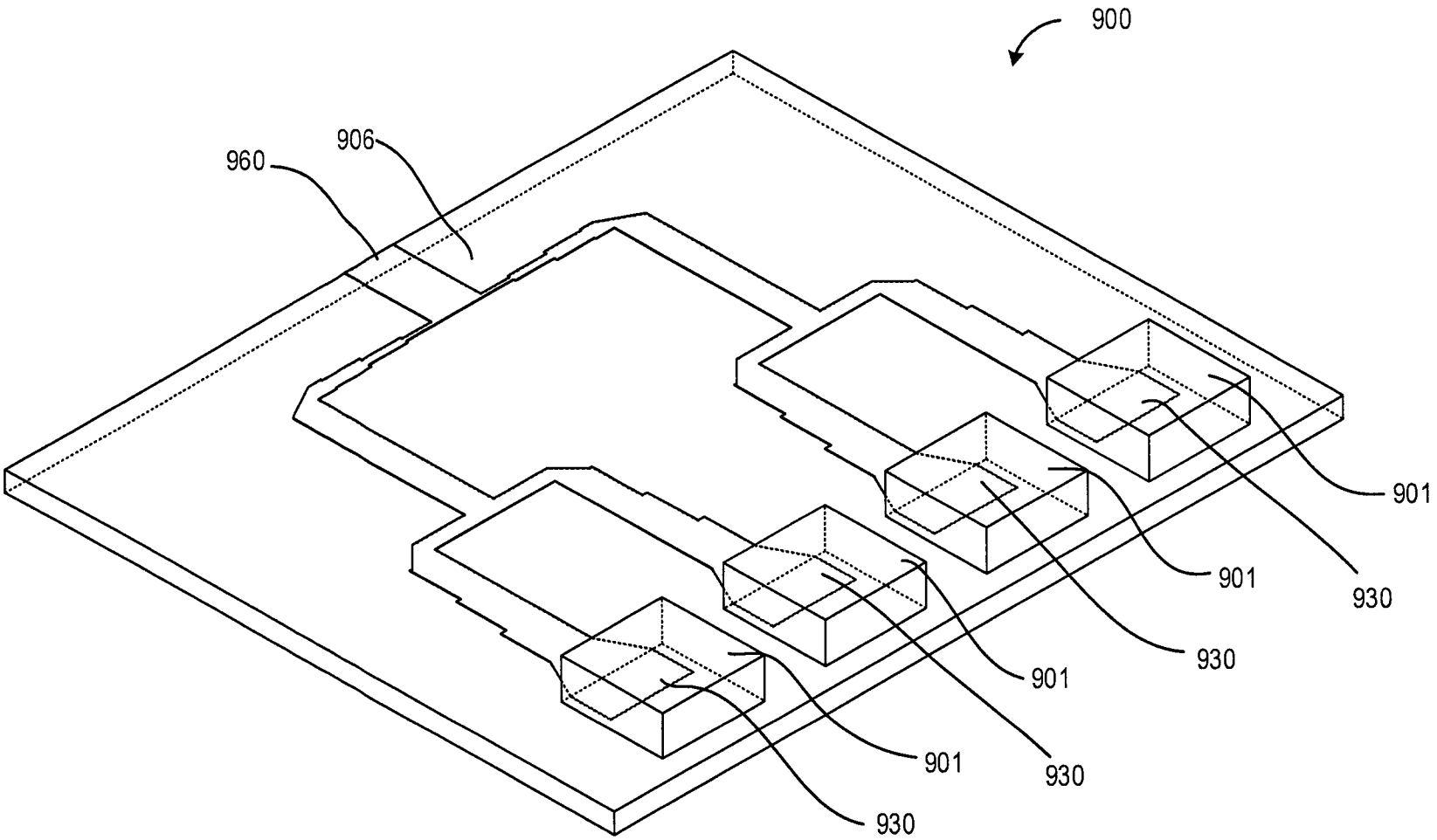
FIG. 9A is a perspective view of an example 4 element microstrip coupled PRA array structure.

FIG. 9A is a perspective view of an example 1×4 element microstrip coupled PRA array structure 900, which has tapered sections of thin metal microstrip line 930 extending at least partially under the PRA elements. In this example, the dimensions of the tapered section are $w_1$=2 mm, $w_2$=4 mm, $l_1$=2 mm (see FIG. 16) and the overlap with the PRA is 2 mm. Similar to PRA arrays 400, 800, and others presented herein, the PRA array structure 900 includes resonator bodies 901 that are typically connected via wall structures (not shown in FIG. 9A). The PRA array structure 900 includes a 1-4 distribution structure 906 that is based on a 2-level cascade of 1-2 distribution structures similar to those shown in distribution structure 100.

Figure 9B:
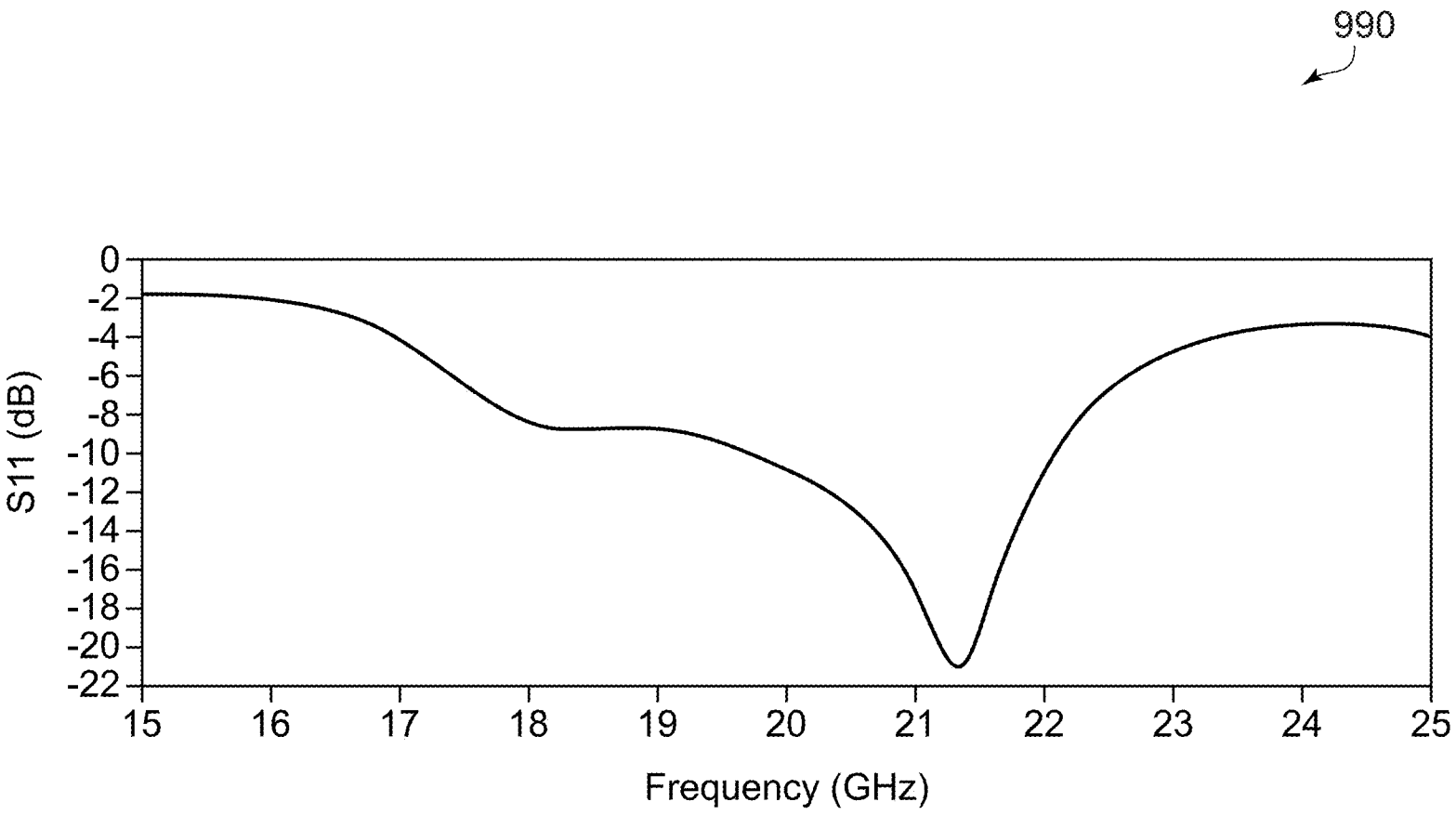
FIG. 9B is a plot of a reflection coefficient for the PRA array of FIG. 9A.
Figure 9C:
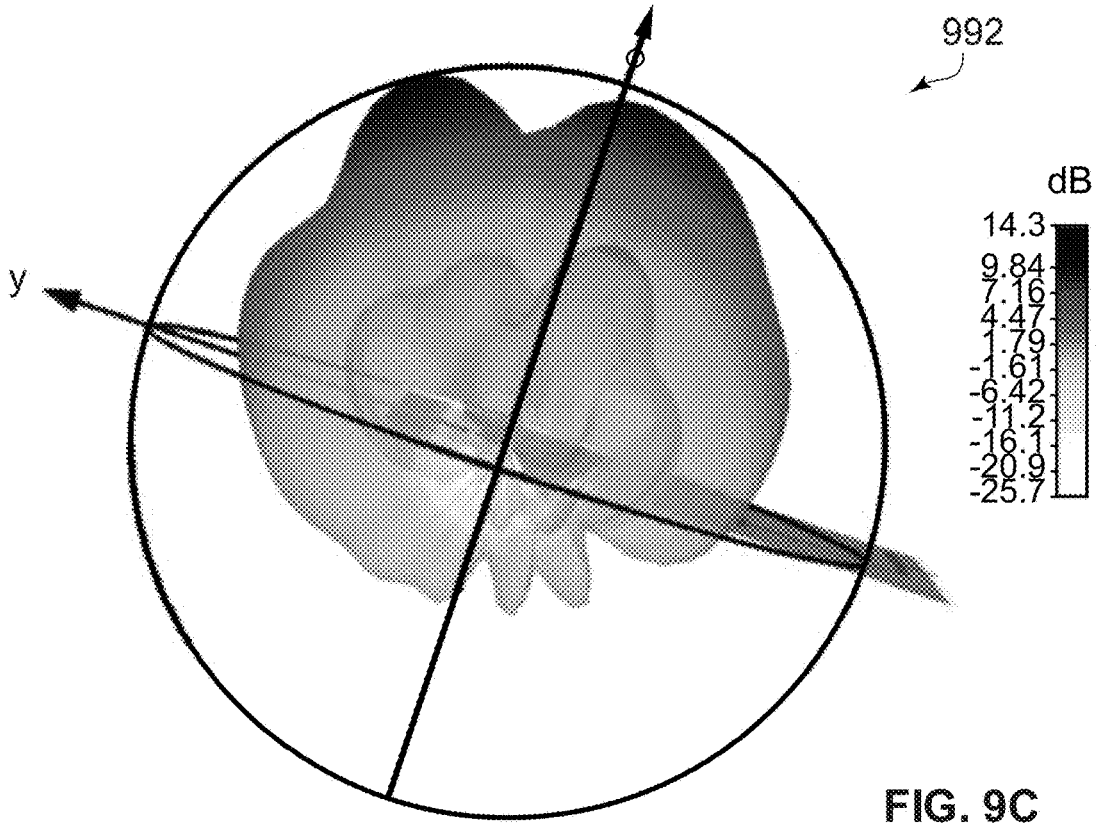
FIGS. 9C and 9D illustrate different planes perpendicular to each other and mutually perpendicular to the substrate surface, of radiation patterns showing the realized gain distribution for the PRA array of FIG. 9A.
Figure 9D:
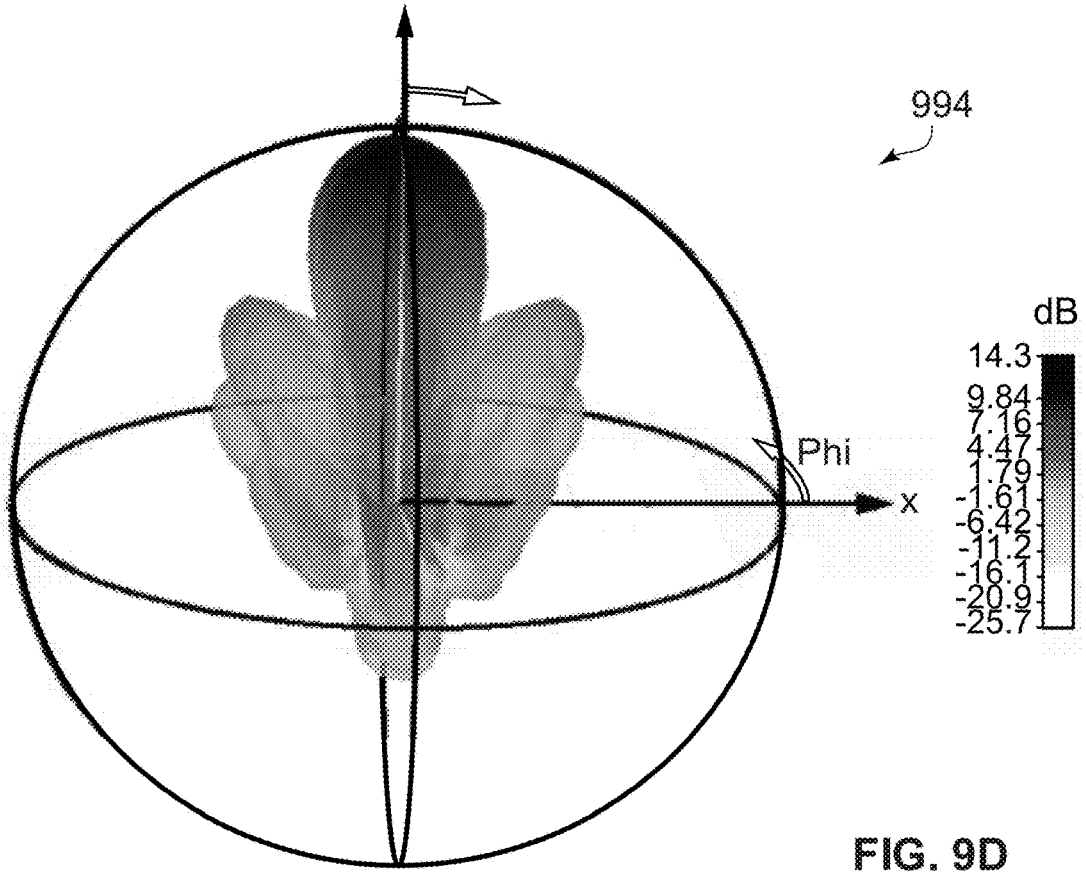

FIGS. 9B, 9C and 9D are plots of sample results for the PRA array structure 900 when the resonator bodies 901 and wall structures are made of SU-8 ($\varepsilon_r$=3.8) with element dimensions (L×W×H) of 5 mm×5 mm×2 mm, on a 0.5 mm thick substrate (permittivity=1.2).

FIG. 9B is a plot 990 of a reflection coefficient for the PRA array structure 900. As shown in FIG. 9B, the −10 dB bandwidth for the PRA array structure 900 is approximately from 19.7 GHz to 22.1 GHz, which is approximately a bandwidth of 11%.

FIGS. 9C and 9D illustrate different planes 992 and 994, respectively, perpendicular to each other and mutually perpendicular to the substrate surface, of radiation patterns showing the realized gain distribution for the PRA array structure 900. The planes 992 and 994 are illustrated at a frequency of operation of approximately 21.0 GHz. The realized gain is 14.3 dBi at the peak of the main lobe. Compared with the 2-element sidewall coupled array (see e.g., FIGS. 4C and 4D), the 4-element tapered microstrip coupled PRA array structure 900 has more than double the gain and also a slight skew in the main lobe radiation pattern.

The distribution structure 906 includes a signal port 960 for receiving the excitation signal of the antenna array and sub-structures based on the general distribution structure 100 of FIG. 1A.

Example 3—Arrays with Slot Coupling Structures

Slot coupling may generally be more suitable for higher permittivity (typically $\varepsilon_r$>6) PRA arrays, however it may also be suitable for lower permittivity, pure polymer arrays implemented on relatively low permittivity substrates. Similar signal distribution networks can be employed, however, these are typically in an inverted configuration to those presented in Example 1 above, with the distribution lines on the opposite side of the substrate to the monolithic PRA array structure which sits on the ground plane side of the substrate. PRA elements are excited through slots in the ground plane, as shown in FIGS. 17A (bottom view) and 17B (top perspective view) for a microstrip configuration.

The slot-coupled configuration can be used to generate a substantially broadside radiation pattern, approximately symmetrical and perpendicular to the ground plane, and typically without the skew sometimes present in the side-coupled schemes presented in Example 1.

FIG. 17B is a perspective view of an example single PRA element structure 1700 of 3.9 mm×3.9 mm×2 mm (L×W×H), which may be made of SU-8 ($\varepsilon_r$=3.8) and placed on a ground plane 1730 of a 0.5 mm thick substrate 1720 ($\varepsilon_r$=4). In this case, the microstrip feed is 1 mm wide, is on the backside of the substrate 1720, and extends 1.8 mm past the middle of the element 1701. The PRA element 1701 is excited by a 0.7 mm×4 mm slot 1706 in the metallic ground plane beneath the PRA element 1701. The size of the extension line and the slot 1706 are determined by an optimization process to maximize the coupling, while suppressing the excitation of the slot 1706, which can distort the radiation pattern and reduce the gain.

Figure 17C:
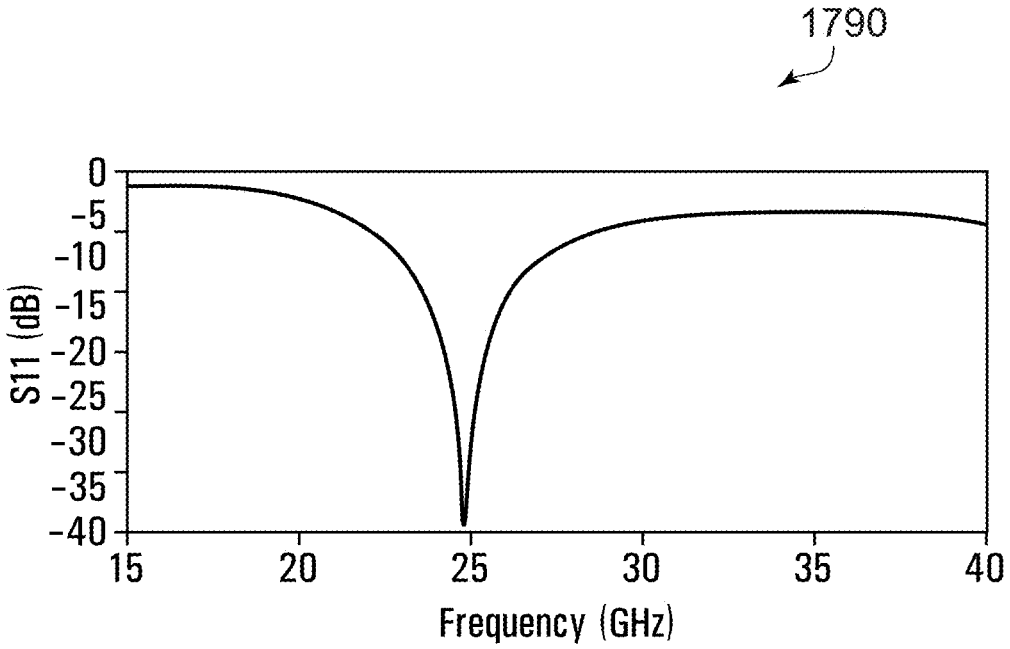
FIG. 17C is a plot of a reflection coefficient for the PRA of FIG. 17A.
Figure 17D:
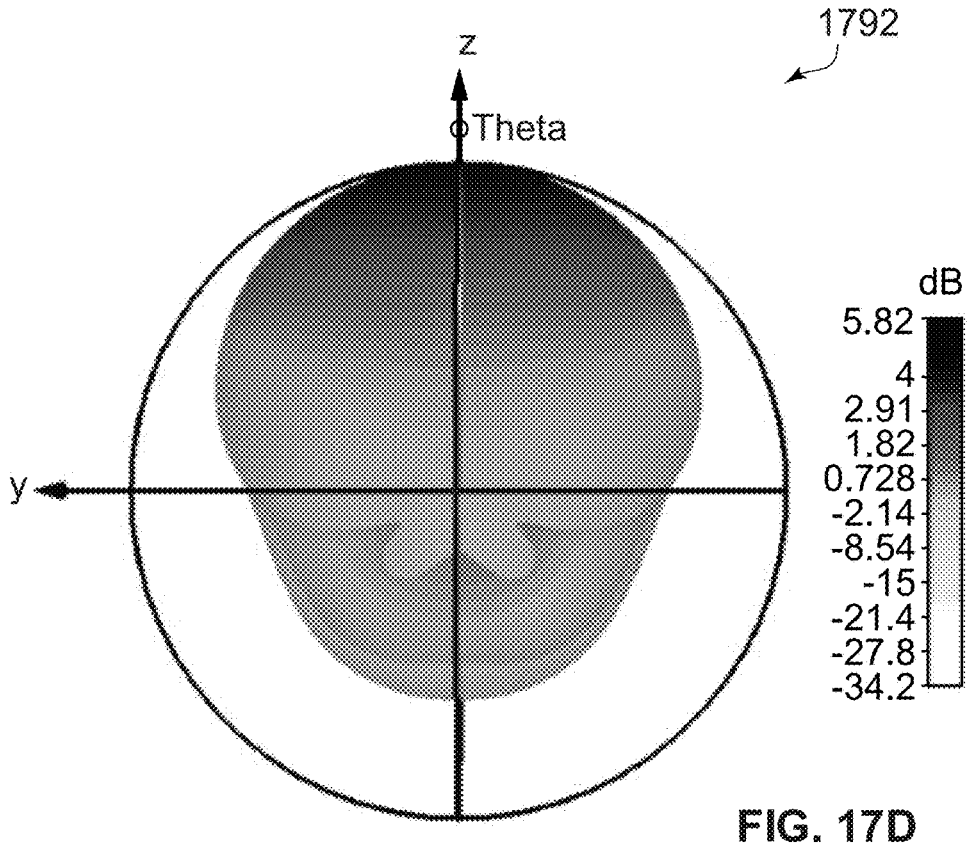
FIGS. 17D and 17E illustrate different planes perpendicular to each other and mutually perpendicular to the substrate surface, of radiation patterns showing the realized gain distribution for the PRA of FIG. 17A.
Figure 17E:
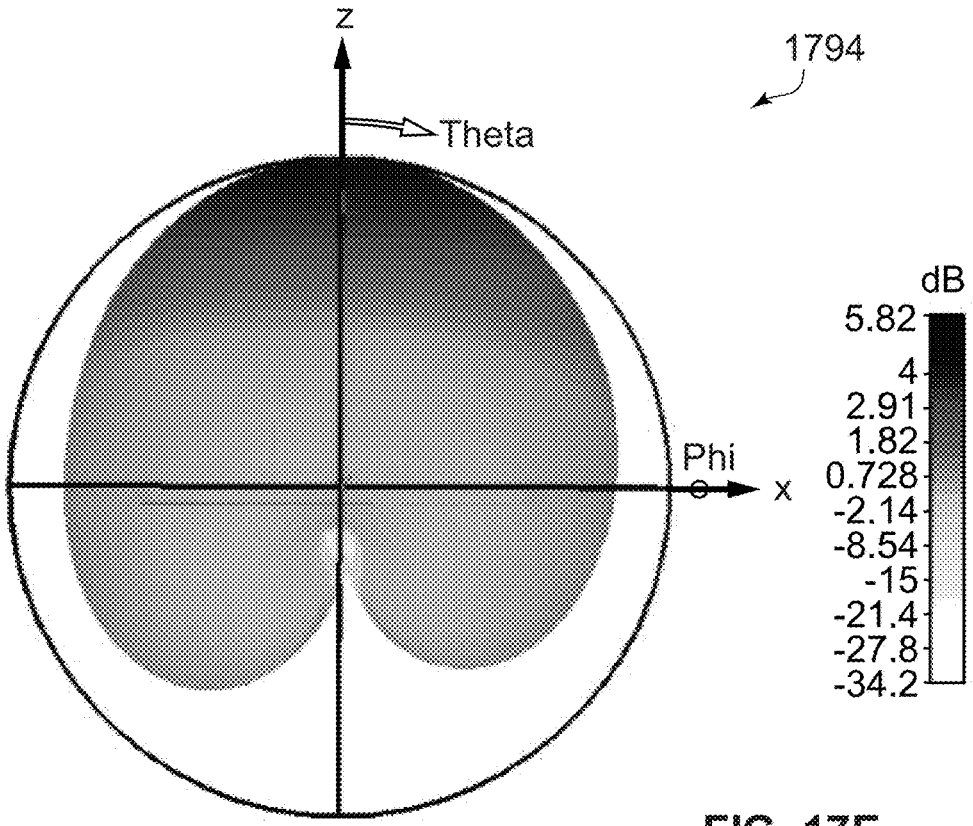

FIG. 17C is a plot 1790 of a sample frequency response using the coupling structure 1700. Plot 1790 demonstrates that the sample slot coupled PRA element resonance is at 24.8 GHz and the element 1701 has a −10 dB bandwidth of 16%. A broadside symmetric pattern shown at 1792 in FIG. 17D and at 1794 in FIG. 17E is achieved with a realized gain of 5.8 dBi. The resonance occurs at a slightly higher frequency than the similar side-coupled antenna array element, which can be contributed to the miniaturization properties of the side-coupled scheme which make the PRA element appear effectively larger.

Figure 18A:
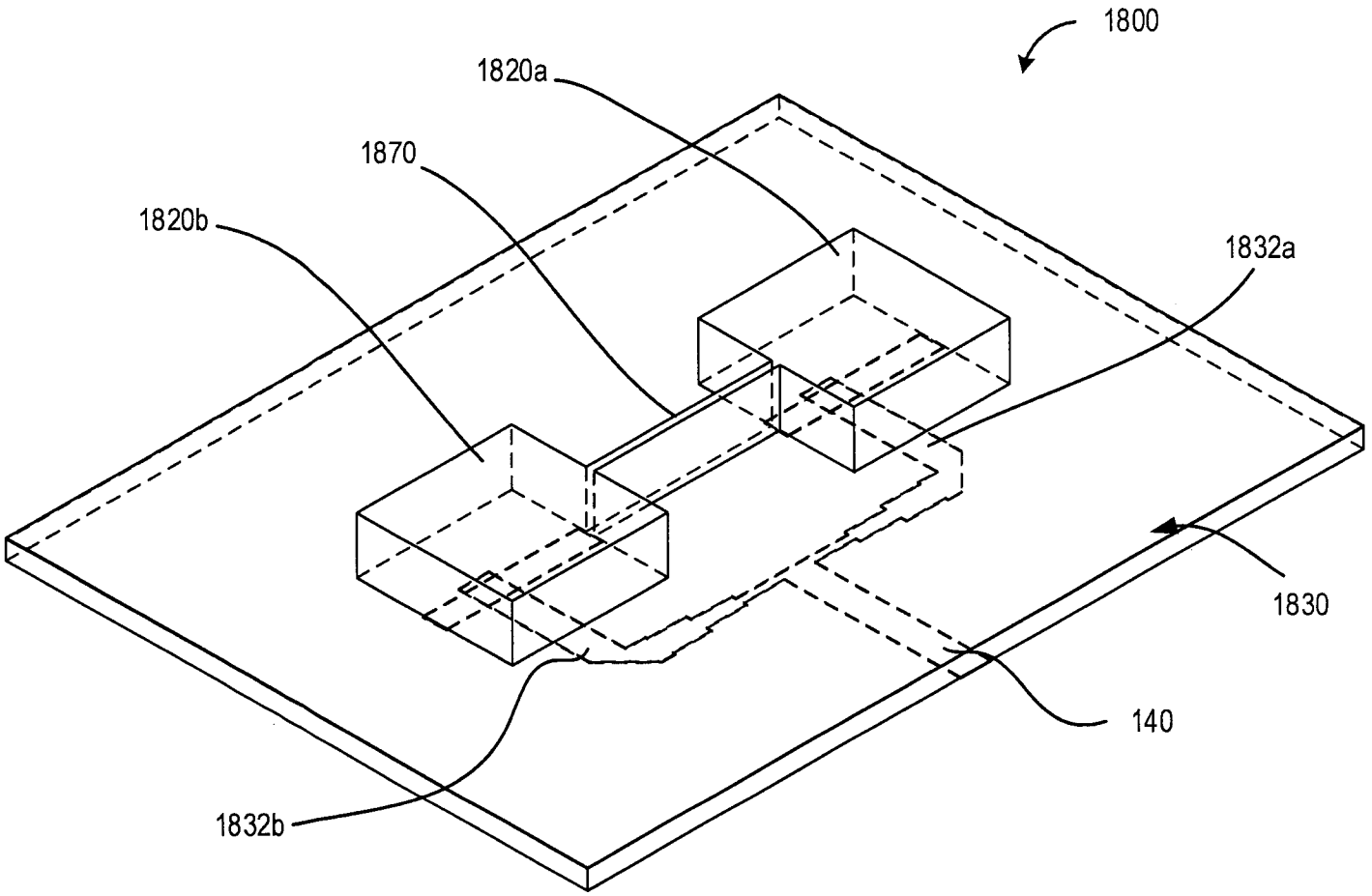
FIG. 18A is a perspective view of an example slot-coupled PRA array.

FIG. 18A is a perspective view of an example slot-coupled PRA array 1800, with distribution structure on the backside of the substrate and coupling through the slots under the PRA elements. Similar to both PRA arrays 400 and 500, the PRA array 1800 includes two resonator bodies 1820*a* and 1820*b* that are connected via the wall structure 1870. The PRA array 1800 includes a distribution structure 1830 that is based on a slot-coupled configuration. The distribution structure 1830 is generally based on the distribution structure 100 of FIG. 1A but appears on the backside of the substrate and includes modified feedlines 1832*a* and 1832*b* to accommodate the slot-coupled configuration.

Figure 18B:
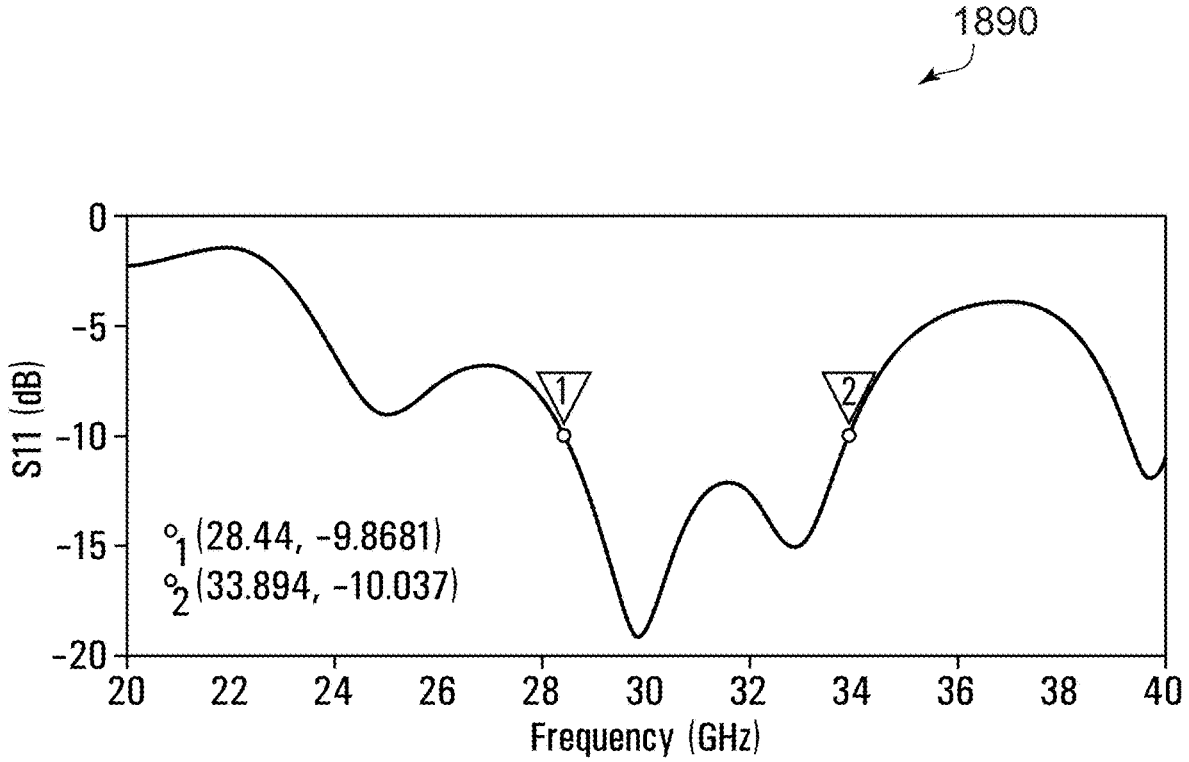
FIG. 18B is a plot of a reflection coefficient for the PRA array of FIG. 18A.
Figure 18C:
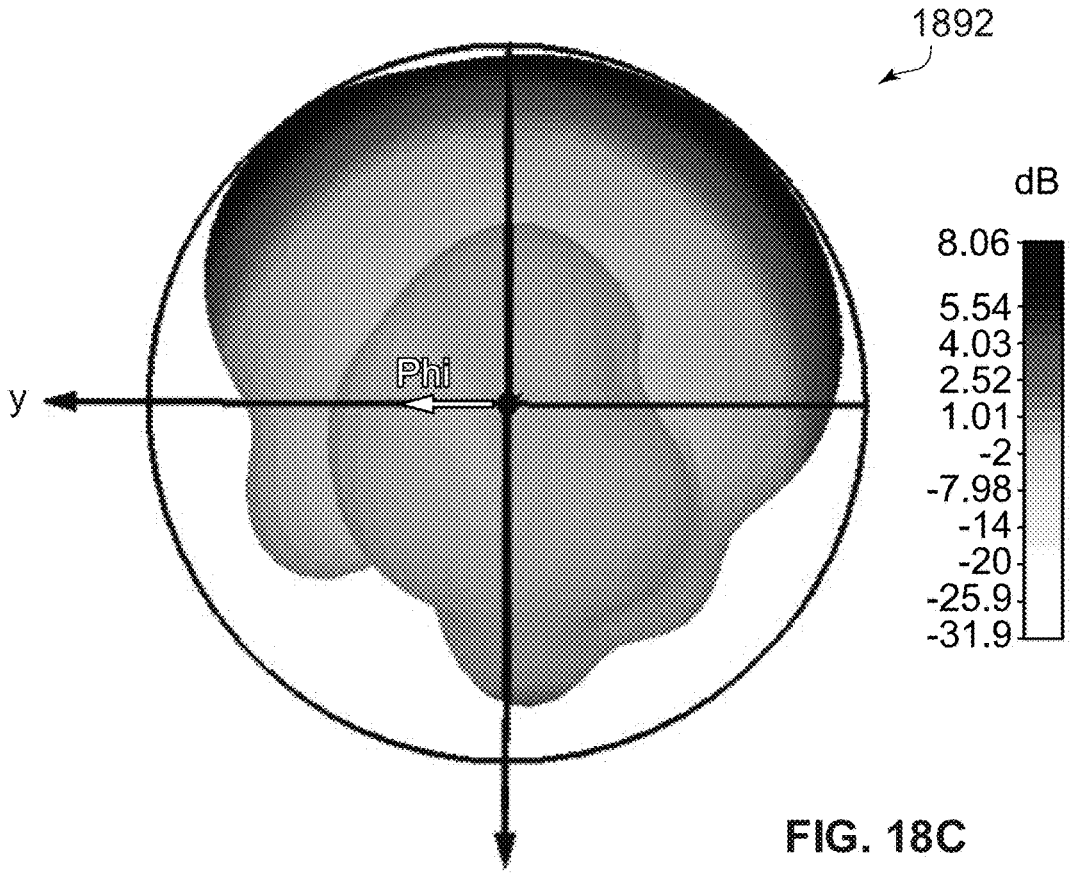
FIGS. 18C and 18D illustrate different planes perpendicular to each other and mutually perpendicular to the substrate surface, of radiation patterns showing the realized gain distribution for the PRA array of FIG. 18A.
Figure 18D:
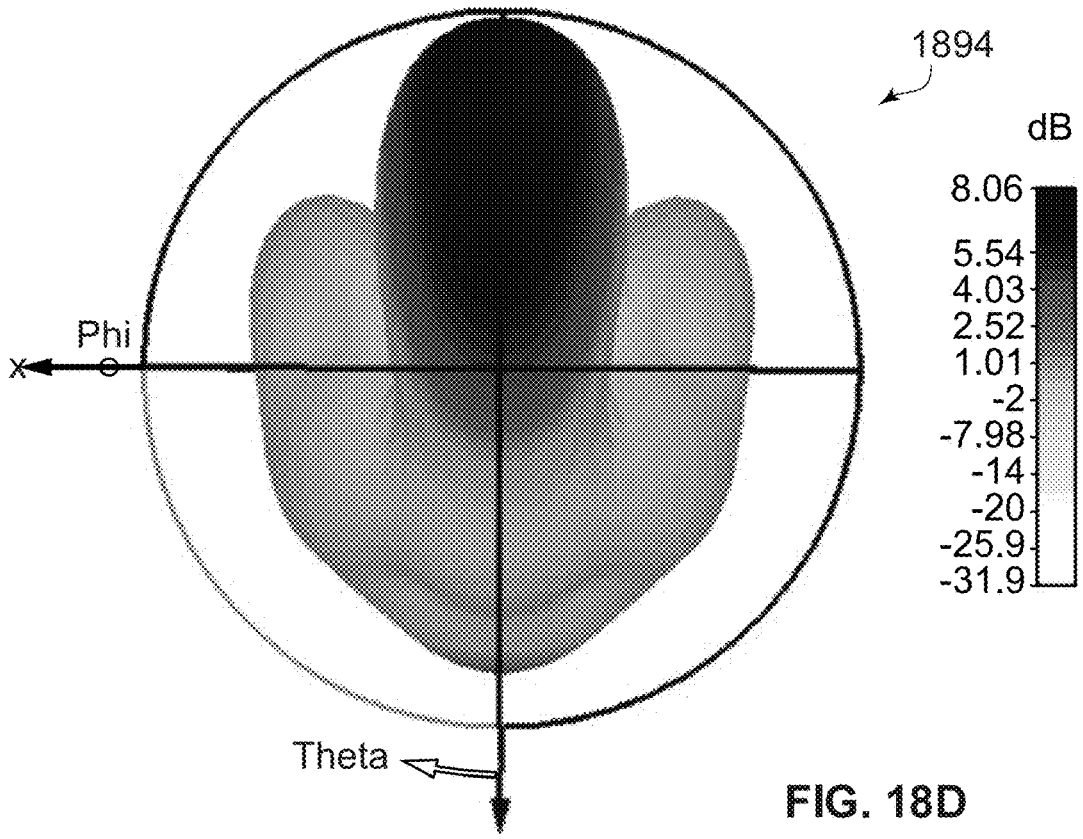

FIGS. 18B, 18C and 18D illustrate plots of sample results for the PRA array 1800 when the resonator bodies 1820*a*, 1820*b* and wall structure 1870 are made of SU-8 ($\varepsilon_r$=3.8) with element dimensions (L×W×H) of 3.9 mm×3.9 mm×2 mm, on a 0.5 mm thick substrate ($\varepsilon_r$=4).

FIG. 18B is a plot 1890 of a reflection coefficient for the PRA array 1800. As shown in FIG. 18B, the −10 dB bandwidth for the PRA array 1800 is approximately from 28.4 GHz to 33.9 GHz, which is approximately a bandwidth of 18%. As compared with FIG. 4B, the frequencies associated with the PRA array 1800 are higher than the frequencies of the PRA array 400.

FIGS. 18C and 18D illustrate different planes 1892 and 1894, respectively, perpendicular to each other and mutually perpendicular to the substrate surface, of radiation patterns showing the realized gain distribution for the PRA array 1800. The planes 1892 and 1894 are illustrated at a frequency of operation of approximately 29.5 GHz. The realized gain is 8.1 dBi which is again roughly twice (3 dB more) than that of a slot coupled single PRA element. Compared with the side-coupled array of FIG. 4A, the slot-coupled PRA array 1800 has a more broadside radiation pattern, and because of this, a slightly lower gain in the main lobe.

The general 1-2 port distribution structure 1830 can be expanded to support PRA arrays with a larger number of elements, both in 1 dimensional patterns (1×N elements) or 2 dimensional patterns (N×N elements). The simplest approach is to cascade the 1-2 port structure (like structure 1830) as many times as required to obtain the required number of feed ports. This approach works for an even or odd number of ports.

Figure 19A:
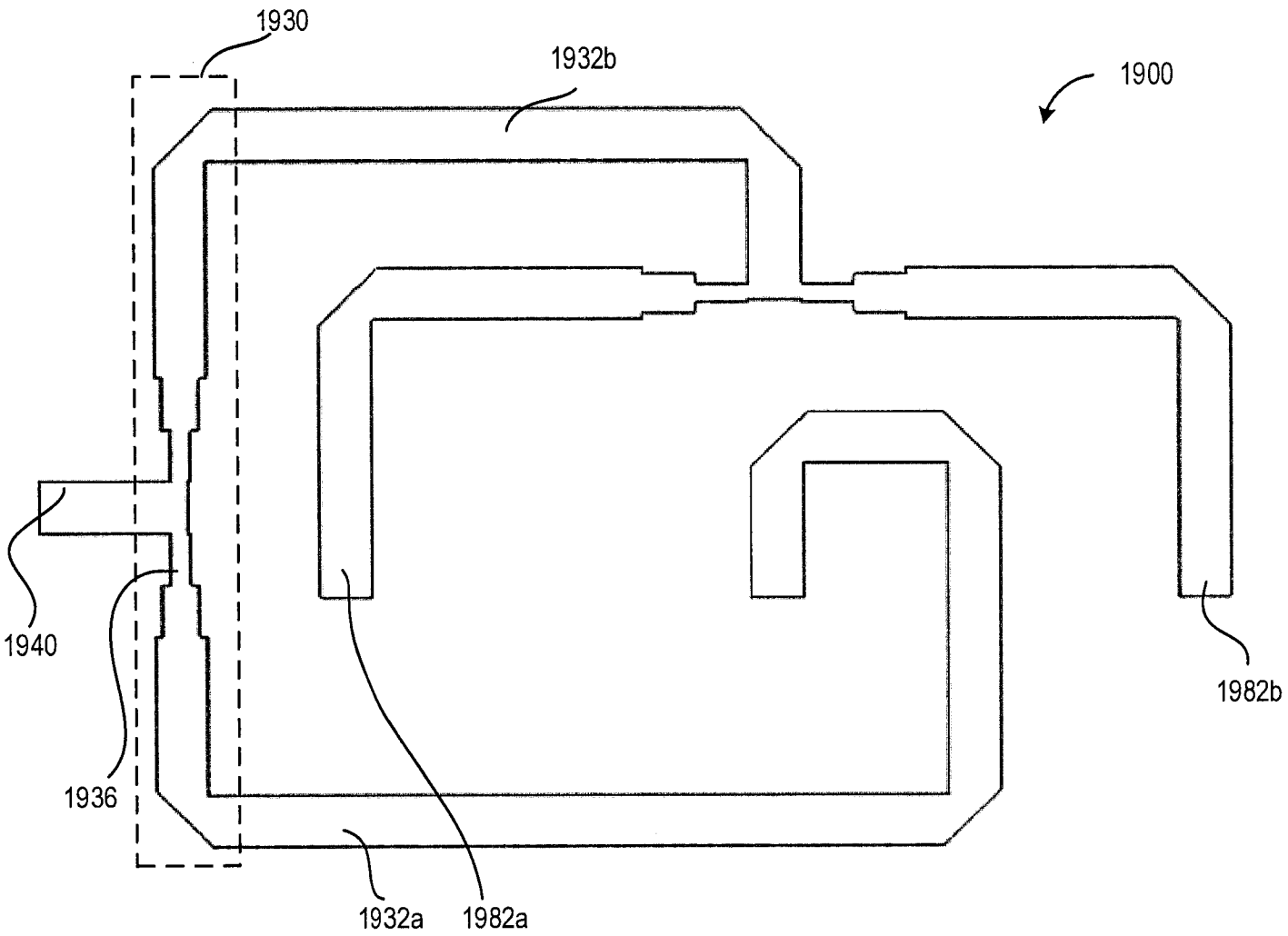
FIG. 19A is a plan view of an example distribution structure with an odd number of ports.

Referring now to FIG. 19A, there is illustrated a plan view of a distribution structure 1900 with an odd number of ports, which can be used to distribute signals to a 1×3 element PRA array, for example.

The distribution structure 1900 includes a signal port 1940 for receiving the excitation signal of the antenna array and a sub-structure 1930 based on the general distribution structure 100 of FIG. 1A.

Similar to the distribution structure 100, the sub-structure 1930 includes a signal divider 1936 that is electrically connected to the signal port 1940. A microstrip T-type structure which is efficient from a layout perspective is illustrated. However, it should be understood that other types of transmission line or waveguide signal dividers may be used. The signal divider 1936 can divide the received excitation signal and provide the divided excitation signal to each respective feedlines 1932*a* and 1932*b*. For an odd number of PRA elements, one of the feedlines, such as feedline 1932*b*, is further divided into two sub-feedlines 1982*a* and 1982*b*. For an even number of PRA elements, feedline 1932*a* could also be further divided into two sub-feedlines. This process could be repeated by cascading further dividers in a similar manner for larger numbers of PRA elements.

The distribution structure 1900 is described herein to demonstrate slot-coupled configurations, however, balanced distribution structures similar to 700 of FIG. 7A can also be used.

Figure 19B:
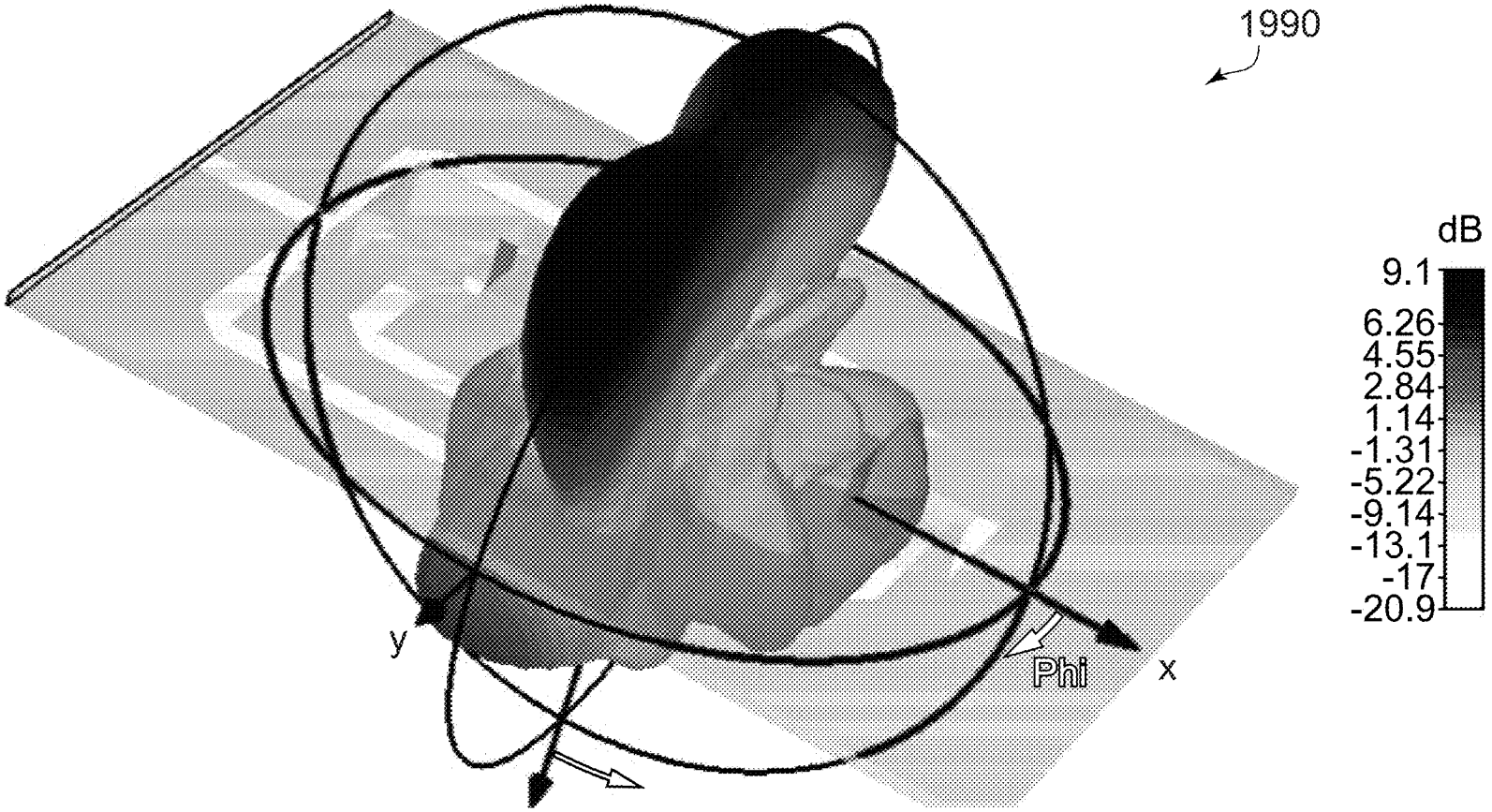
FIG. 19B is a plot of a three-dimensional radiation pattern showing the realized gain distribution of a PRA array that uses the distribution structure of FIG. 19A in a slot-coupled configuration.

FIG. 19B is a plot 1990 of a three-dimensional radiation pattern showing the realized gain distribution of a PRA array that uses the distribution structure 1900 in a slot-coupled configuration. The realized gain is approximately 9.1 dBi, which is slightly less than the realized gain for a similar PRA with the side-coupled configuration (e.g., realized gain associated with the PRA array 800). This is the result of the slot-coupled configuration providing a more broadside radiation pattern. Similar to the PRA 800, the realized gain shown in the plot 1990 corresponding to a three-element PRA monolithic array is approximately 1 dB more than that of the PRA array 1800 of FIG. 18A (with two-element PRA monolithic array).

The PRA arrays described so far have generally been 1×N element one-dimensional arrays in which the resonator bodies in the monolithic PRA array structure are provided along a generally straight line (although the bodies may be offset slightly with respect to this line). In other embodiments, the resonator bodies in the monolithic PRA array structure may be provided in different configurations, such as M×N element two-dimensional arrays in which the resonator bodies in the monolithic PRA array structure are provided along a generally uniform grid structure (although one or more resonator bodies may be offset slightly with respect to this grid), or particular configurations such as a substantially quadrilateral configuration or a substantially elliptical configuration. In each of these configurations, the resonator bodies may be uniformly or non-uniformly spaced apart from each other. In other configurations, groups of monolithic PRA sub-array structures (all with similar or different configurations) along with appropriate signal coupling and distribution structures can be further functionally grouped together and fed by another level of signal distribution structures to form a larger array consisting of several smaller sub-arrays. In this case, the PRA sub-array structures could be fabricated as separate monolithic pieces, and then assembled into the larger array, or the larger array fabricated as a single monolithic piece containing all the separate PRA sub-arrays. These separate PRA sub-arrays can be connected together by narrow wall connecting structures in a similar manner as internally within the PRA sub-arrays, to form a single monolithic piece for the multi-PRA array structure. An example of the PRA sub-array concept is shown by the configuration in FIGS. 20A (plan view) and 20B (perspective view).

Figure 20A:
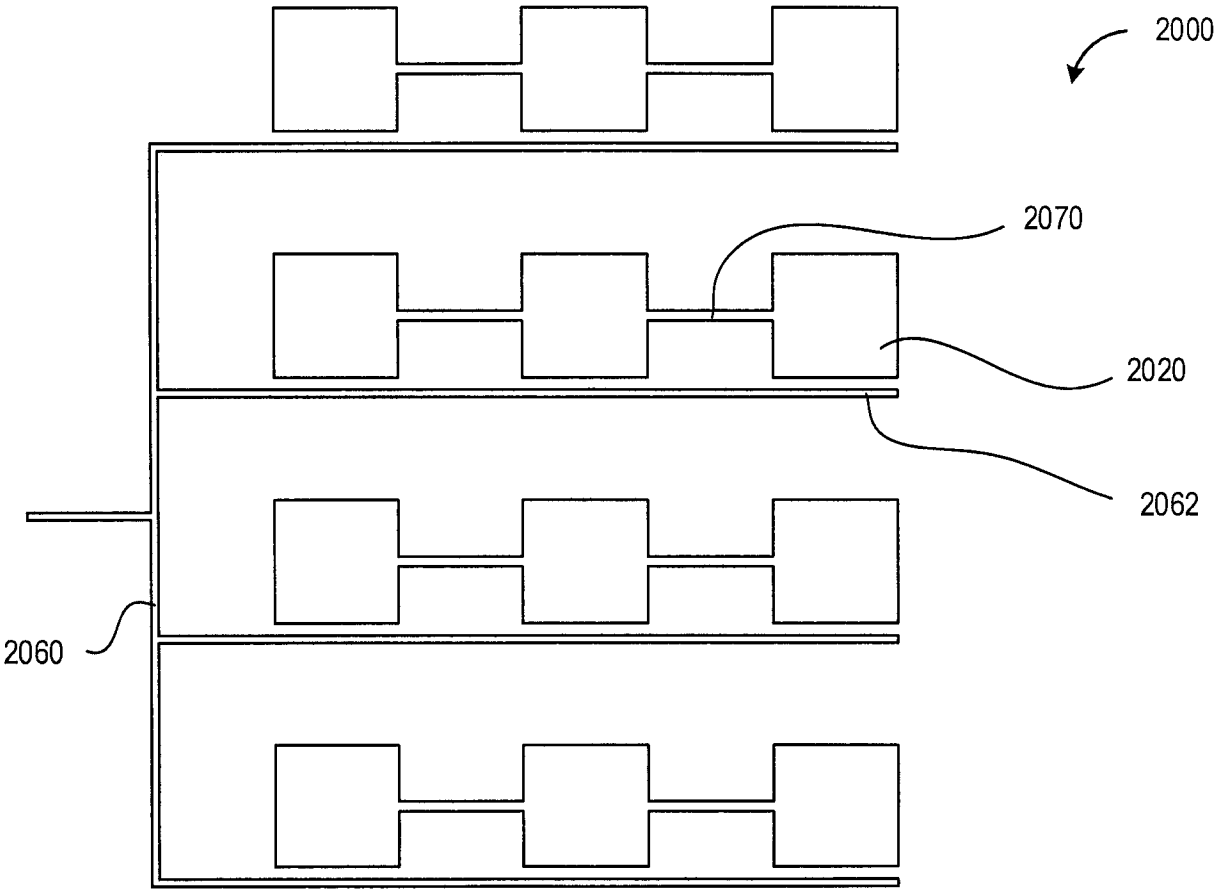
FIG. 20A is a plan view of a PRA array formed from 4, 1×3 element sub-arrays.
Figure 20B:
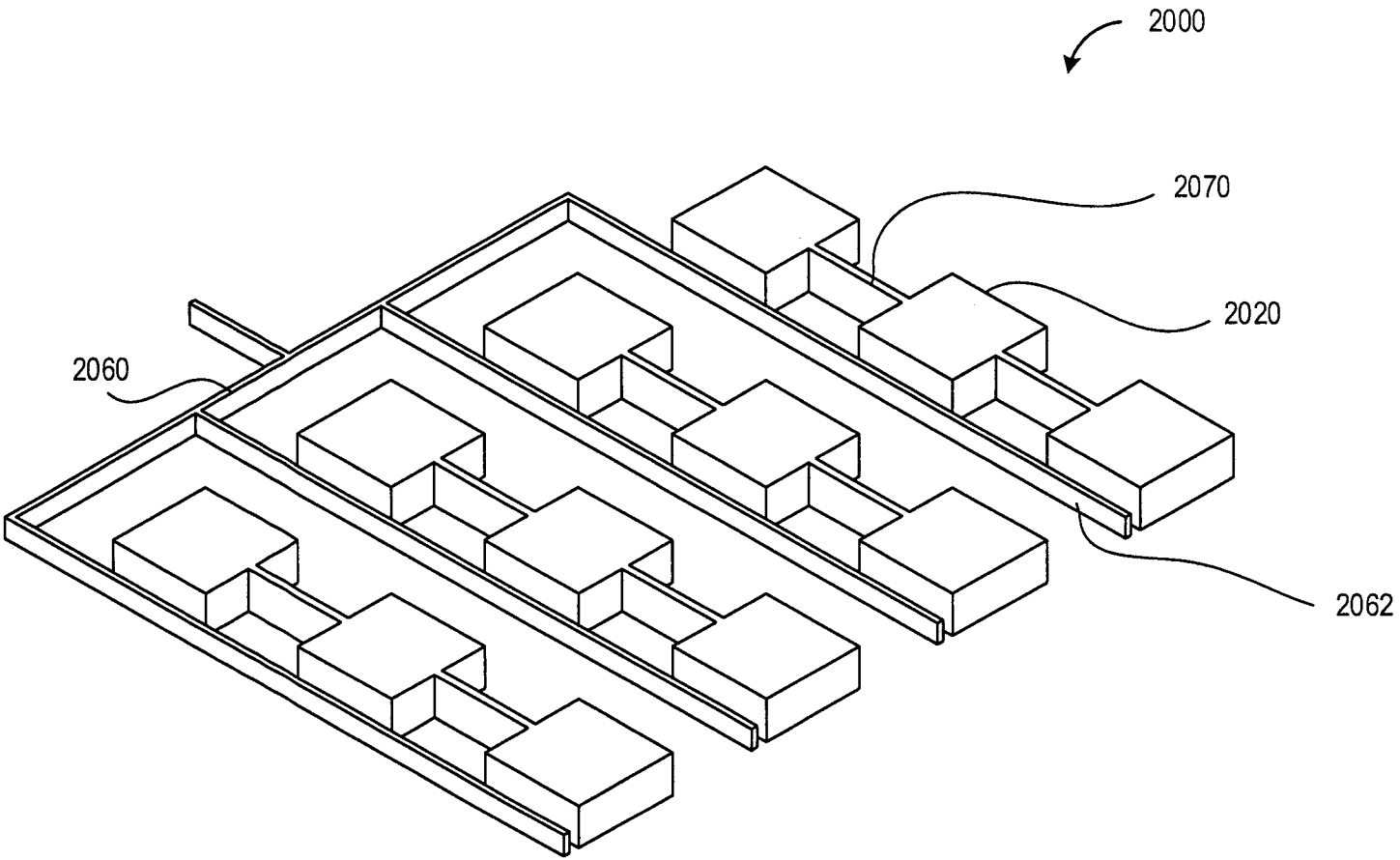
FIG. 20B is a perspective view of the PRA array of FIG. 20A showing distribution to the sub-arrays by a tall metal microstrip transmission line network and feeding by periodically loaded tall metal side coupled microstrip transmission lines.

Referring now to FIGS. 20A and 20B, there is illustrated an example PRA array based on sub-arrays. FIG. 20A is a plan view of a PRA array 2000 with 4, 1×3 element sub-arrays, in which the resonator bodies 2020 in each sub-array are provided along a generally uniform grid structure. Sub-arrays with 1×N elements are shown, however sub-arrays with M×N elements could also be used. FIG. 20B is a perspective view of PRA array 2000. PRA array 2000 has a four arm distribution and coupling structure 2060, in which each arm 2062 feeds a 1×3 sub-array of resonator bodies 2020 using the periodically loaded TL concept described herein, for example with reference to FIGS. 11A, 12F, 22A, 22B, 22F and 22G. The tall side-coupled microstrip TL is shown, however other distribution and couple structures discussed in other embodiments presented could also be used. The resonator bodies are connected via narrow wall connecting structures 2070. The PRA sub-array structures can be fabricated as separate monolithic pieces, and then assembled into the larger array, or the larger array fabricated as a single monolithic piece containing all the separate PRA sub-arrays. Although not shown, these separate PRA sub-arrays also can be connected together by narrow wall connecting structures in a similar manner as within the PRA sub-arrays, to form a single monolithic piece for the multi-PRA array structure.

Figure 10A:
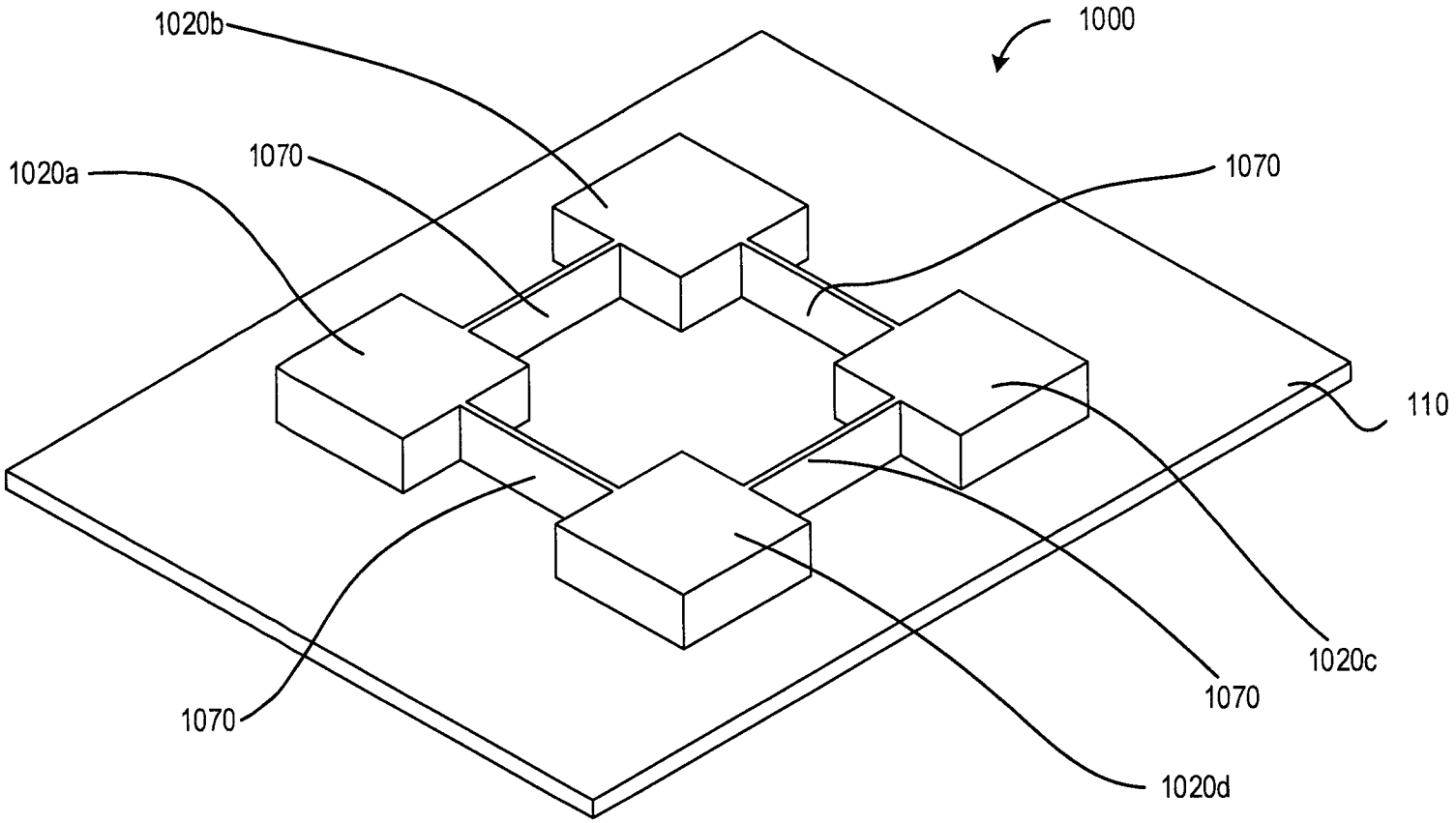
FIG. 10A is a perspective view of an example PRA array.

An example quadrilateral array configuration is described with reference to FIGS. 10A to 10D. FIG. 10A is a perspective view of an example PRA array 1000. The distribution structure is on the bottom of the substrate (not shown), and is similar to the 1×3 distribution structure 1900, but in this case with feedport 1932*a* further divided into two sub-feedlines similar to 1982*a* and 1982*b* to realize a 1×4 distribution structure, for distributing signals to a PRA element monolithic array (2×2 quadrilateral grid) in a slot-coupled configuration.

As shown in FIG. 10A, the PRA array 1000 includes four resonator bodies 1020*a*, 1020*b*, 1020*c* and 1020*d* in a quadrilateral 2×2 grid configuration. Similar to the PRA array 800 of FIG. 8A, the monolithic PRA array resonator bodies 1020 of the PRA array 1000 in this example embodiment also may be formed of a low permittivity material, such as SU-8, with a permittivity of 3.8 at microwave frequencies and with element dimensions (L×W×H) of 3.9 mm×3.9 mm×2 mm, on a 0.5 mm thick substrate ($\varepsilon_r$=4). Each of the resonator bodies 1020*a*, 1020*b*, 1020*c* and 1020*d* may be located at a corner of the quadrilateral configuration. A wall structure 1070 typically formed of the same material also may be provided to connect each adjacent resonator body 1020 to form a single monolithic PRA array structure. The PRA array 1000 could also be used as a sub-array in a larger PRA array distribution structure.

Figure 10B:
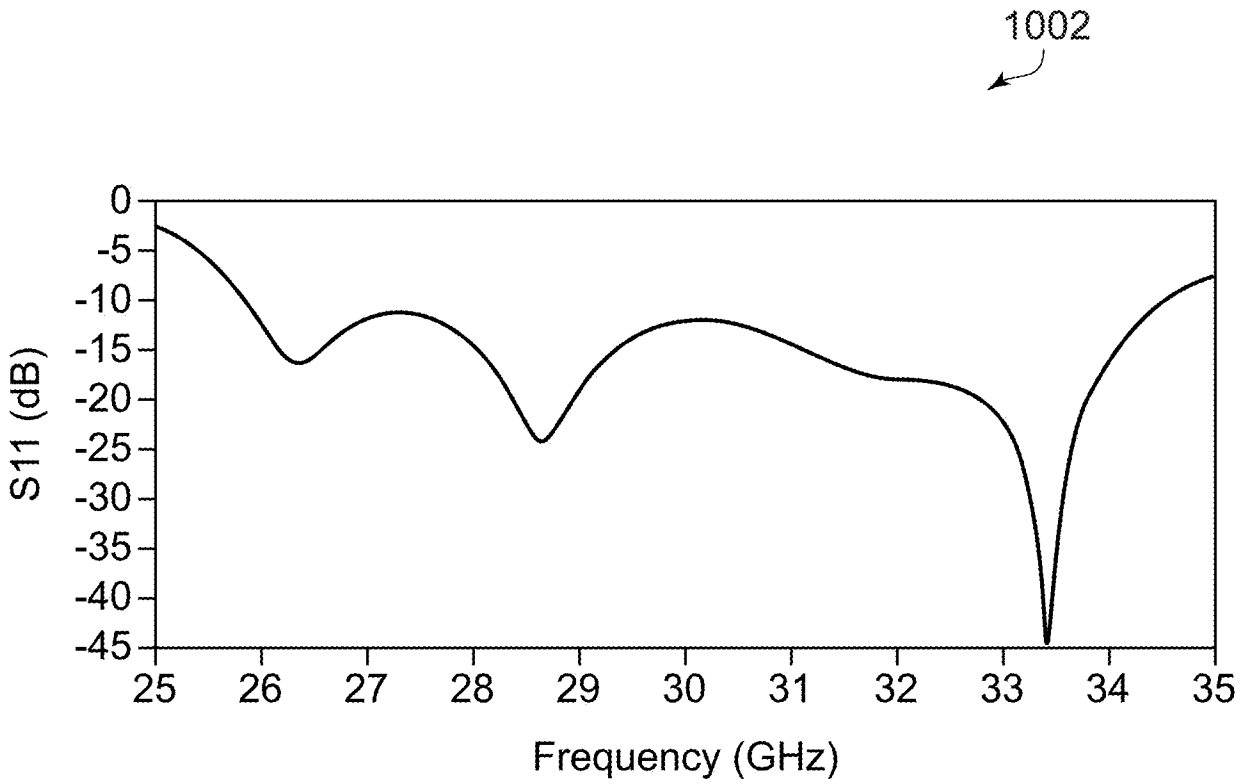
FIG. 10B is a plot of a reflection coefficient for the PRA array of FIG. 10A.
Figure 10C:
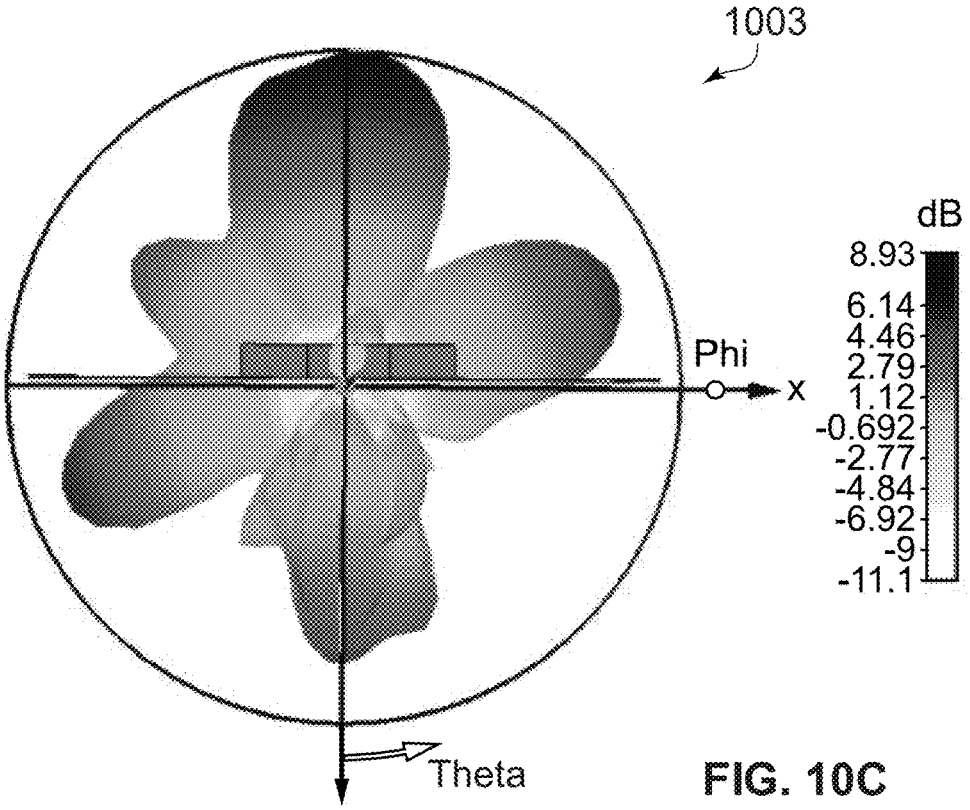
Figure 10D:
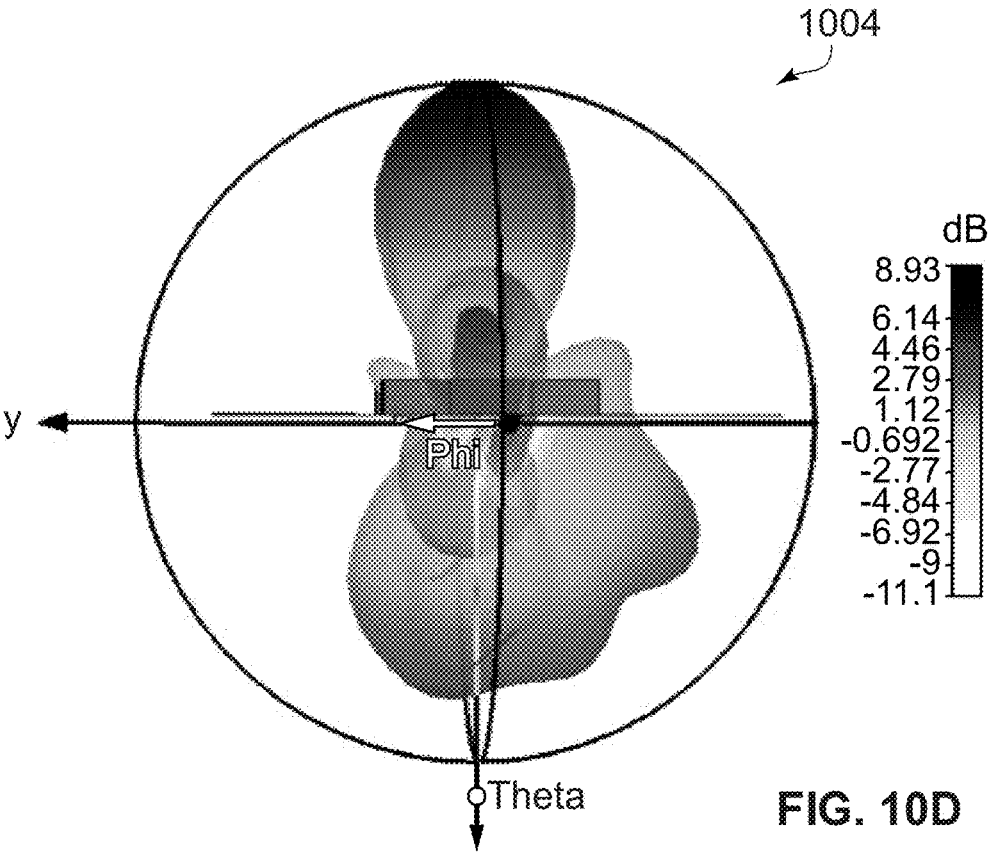

FIGS. 10B, 10C and 10D are plots of sample results for the PRA array 1000. FIG. 10B is a plot 1002 of a reflection coefficient for the PRA array 1000. As shown in FIG. 10B, the −10 dB bandwidth for the PRA array 1000 is approximately from 25.8 GHz to 34.6 GHz, which is approximately a 29% bandwidth. FIGS. 10C and 10D illustrate different planes 1003 and 1004, respectively, perpendicular to each other and mutually perpendicular to the substrate surface, of radiation patterns showing the realized gain distribution for the PRA array 1000. The planes 1003 and 1004 are illustrated at a frequency of operation of approximately 26 GHz. The realized gain is approximately 8.9 dBi and with a substantially broadside radiation pattern for the PRA array 1000.

By comparing the radiation pattern associated with the PRA array 1800 (slot-coupled PRA array with two resonator bodies 1820*a* and 1820*b*) shown in FIGS. 18C and 18D and that of the PRA array 1000 in FIGS. 10C and 10D, it can be seen that additional side lobes are present in the radiation pattern for PRA array 1000. The additional side lobes can be caused by the use of separation distances in PRA elements that correspond to more than half wavelength at the corresponding frequencies. Further tuning of the PRA array 1000 to adjust the separation distances may reduce the additional side lobes while retaining the realized gain and mainlobe broadside radiation pattern. The higher backlobe radiation is typical of slot-coupling methods, and can be reduced by the addition of a second ground plane, or other techniques.

Figure 11A:
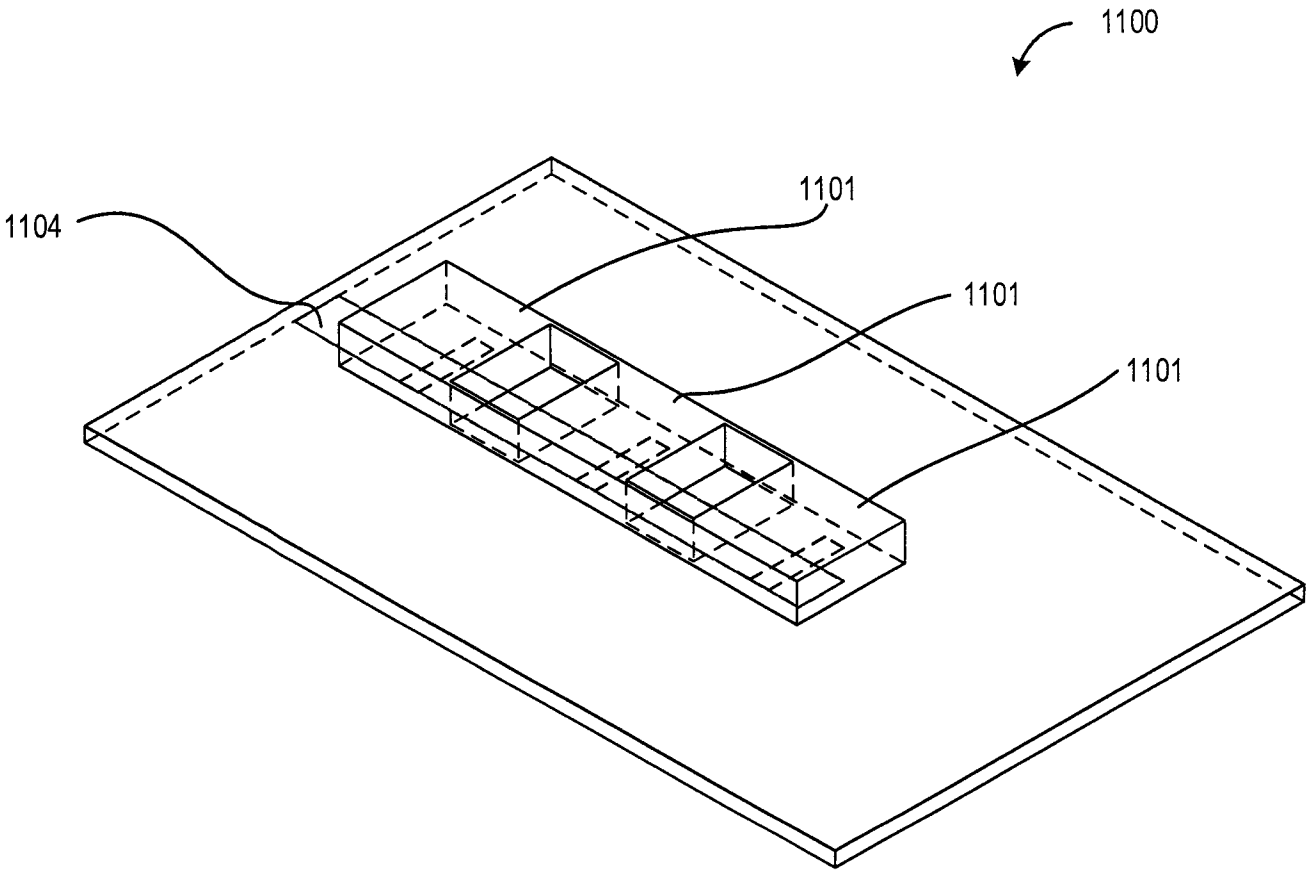
FIG. 11A is a perspective view of an example 3 element PRA array with periodically loaded distribution structure.

Referring now to FIG. 11A, there is illustrated a perspective view of an example periodically loaded distribution structure 1104, which is an alternative to distribution structures (such as structures 100, 700, and 1900) in which the signal power is divided by TL networks and transferred individually to PRA array elements from separate TLs. Slot coupling may work well with signal distribution structures where the TL is periodically loaded by the PRA array elements, in which signal power is transferred to the elements from the common TL as it travels down the loaded TL as described with reference to FIG. 11A. This approach can allow for a much simpler signal distribution structure, which can provide better performance at higher frequencies due to less loss in the divider structures and associated TL discontinuities.

The periodically loaded single TL PRA array 1100 is fabricated as a single monolithic piece, in this example with narrow line connecting structures joining the individual array bodies 1101 at the corners rather than in the middle as described elsewhere herein. This type of monolithic array structure from a fabrication perspective can practically be viewed as a single structure with holes between the PRA elements, rather than connecting walls between PRA elements. Such periodically loaded single TL PRA array structures 1104 can also be sub-arrays, and generally assembled in a larger distribution scheme employing distribution structures such as structure 1830 of FIG. 18A for a slot coupled configuration applied in a similar way as shown in FIGS. 20A and 20B for the tall side-coupled configuration at a higher level. In this configuration, periodically loaded single TL PRA arrays such as array 1100 can be placed in the feed arms, for example modified versions of feedlines 1832*a* and 1832*b* overlapping multiple ground plane slots for the multiple PRA elements in the sub-arrays. Alternatively, multiple periodically loaded single TL sub-arrays could be fabricated together as a single monolithic piece containing all the separate periodically loaded single TL PRA sub-arrays, these separate PRAs sub-arrays being connected together by narrow wall connecting structures, to form a single monolithic piece for the periodically loaded multi-PRA array structure, as described, for example, in reference to FIGS. 20A and 20B.

Figure 11B:
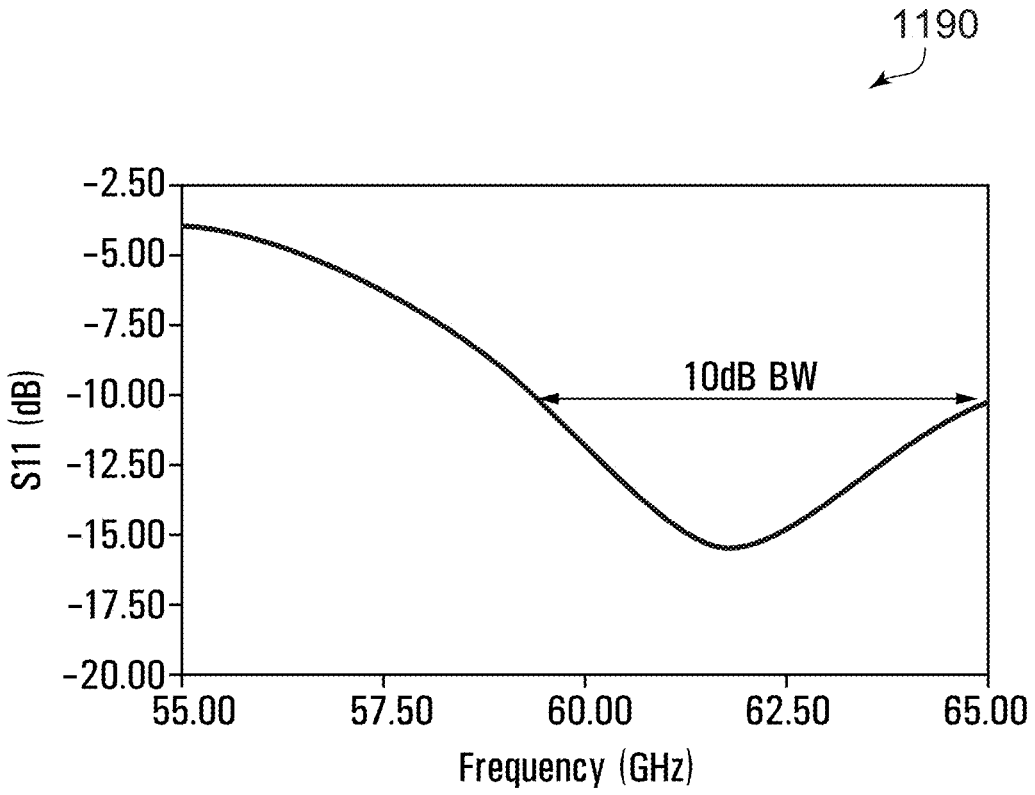
FIG. 11B is a plot of a reflection coefficient for a two-element PRA array similar to that of PRA array of FIG. 11A.
Figure 11C:
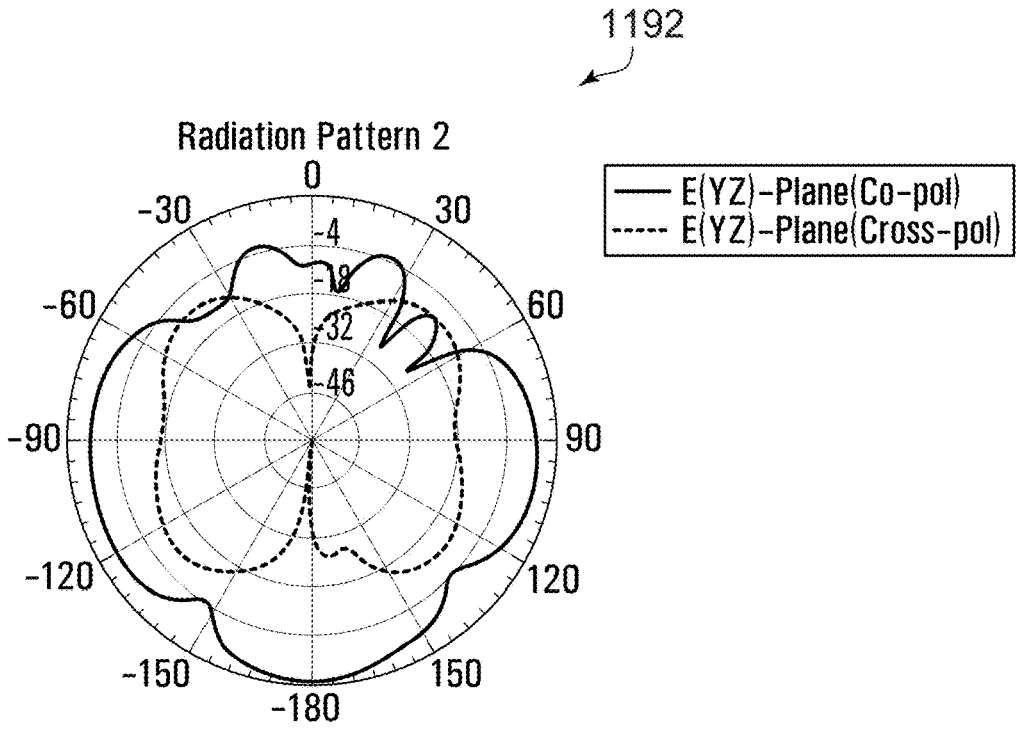
FIGS. 11C and 11D illustrate different planes perpendicular to each other and mutually perpendicular to the substrate surface, of radiation patterns showing the realized gain distribution for a two-element PRA array similar to that of FIG. 11A.
Figure 11D:
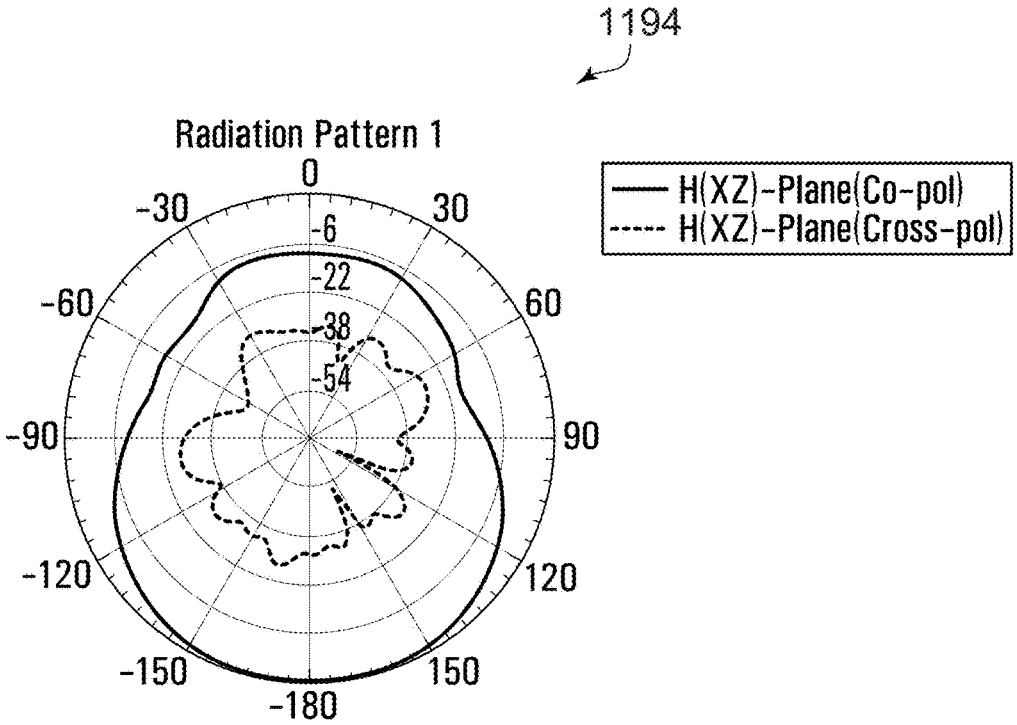

FIGS. 11B, 11C and 11D illustrate plots of sample results for a 2-element example of the general monolithic periodically loaded single TL PRA array similar to array 1100. In this example, the PRA elements are made of low permittivity dielectric material ($\varepsilon_r$=4) with element dimensions (L×W×H) of 1.75 mm×1.75 mm×1.05 mm, on a 0.127 mm thick substrate (permittivity=2.2).

FIG. 11B is a plot 1190 of a reflection coefficient for an example 2-element PRA array similar to PRA array 1100. As shown in FIG. 11B, the −10 dB bandwidth for the PRA array is approximately from 59.4 GHz to 65.1 GHz, which is approximately a 9.2% bandwidth. FIGS. 11C and 11D illustrate different planes 1192 and 1194, respectively, perpendicular to each other and mutually perpendicular to the substrate surface, of radiation patterns showing the realized gain distribution for the PRA array. The planes 1192 and 1194 are illustrated at a frequency of operation of approximately 61.8 GHz. The realized gain is approximately 8.7 dBi and with a substantially broadside radiation pattern for the PRA array. The additional sidelobes and higher backlobe radiation typical of slot-coupling methods are also apparent.

Figure 11E:
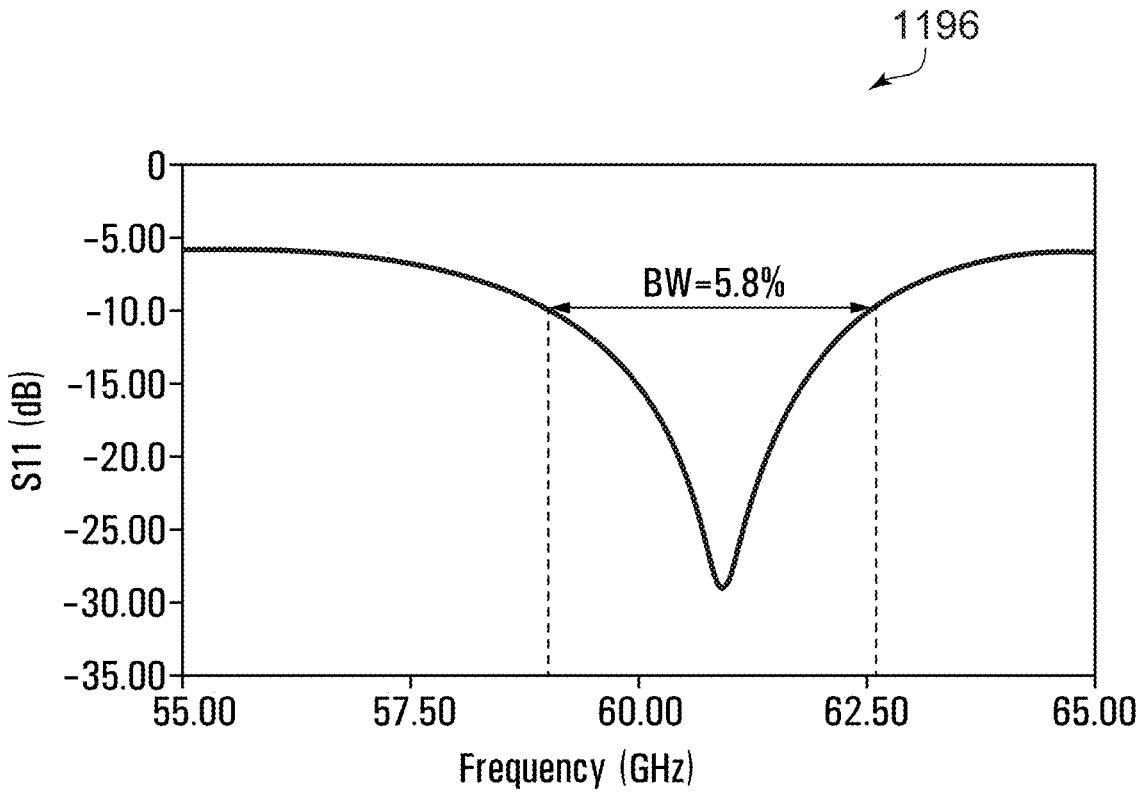
FIG. 11E is a plot of a reflection coefficient for the PRA array of FIG. 11A.
Figure 11F:
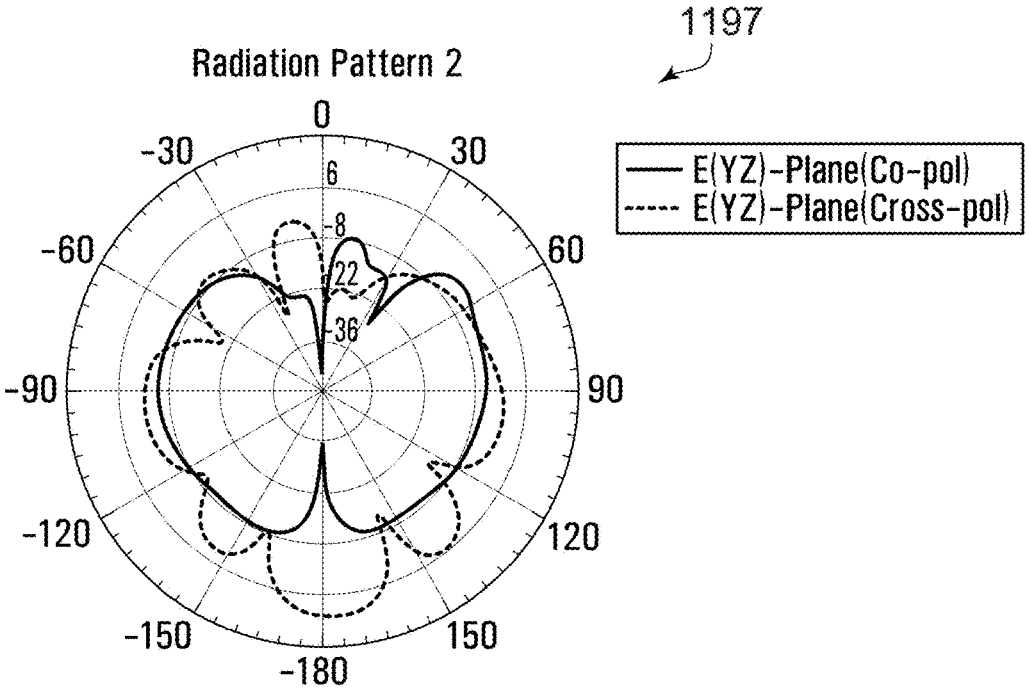
FIGS. 11F and 11G illustrate different planes perpendicular to each other and mutually perpendicular to the substrate surface, of radiation patterns showing the realized gain distribution for the three-element PRA array of FIG. 11A.
Figure 11G:
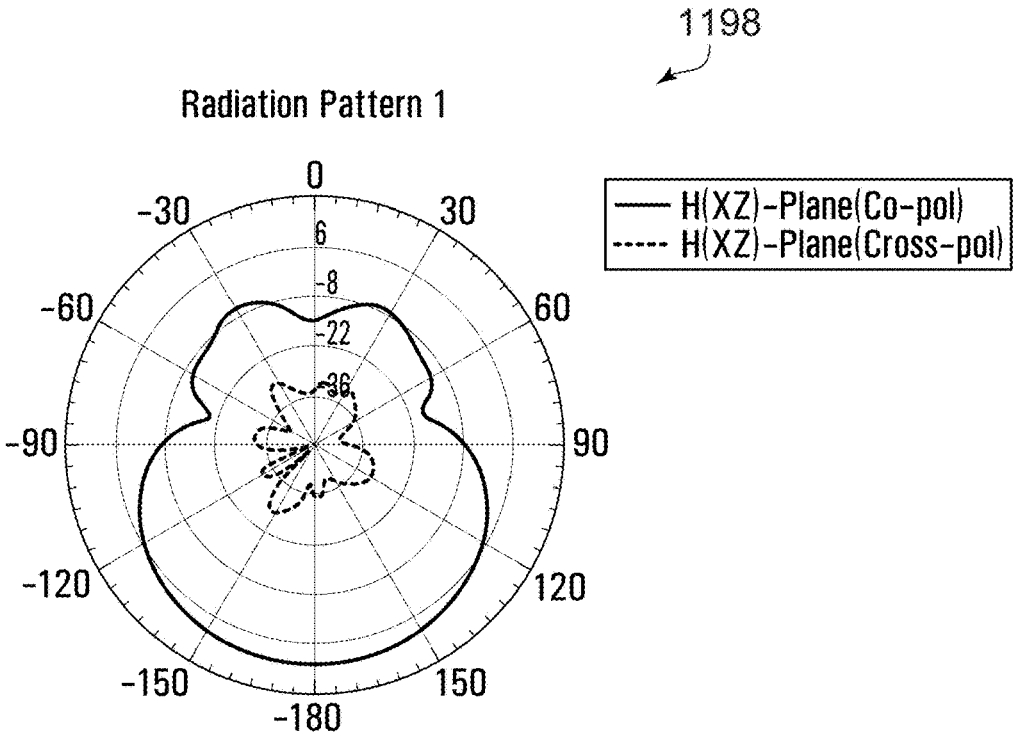

FIGS. 11E, 11F and 11G illustrate plots of sample results for a 3-element example of the general monolithic periodically loaded single TL PRA array 1100. In this example, the PRA elements are made of a higher permittivity dielectric material ($\varepsilon_r$=8) with element dimensions (L×W×H) of 1.23 mm×1.23 mm×0.65 mm, on a 0.127 mm thick substrate (permittivity=2.2).

FIG. 11E is a plot 1196 of a reflection coefficient for the PRA array 1100. As shown in FIG. 11E, the −10 dB bandwidth for the PRA array 1100 is approximately from 59.0 GHz to 62.5 GHz, which is approximately a 5.8% bandwidth. FIGS. 11F and 11G illustrate different planes 1197 and 1198, respectively, perpendicular to each other and mutually perpendicular to the substrate surface, of radiation patterns showing the realized gain distribution for the PRA array 1100. The planes 1197 and 1198 are illustrated at a frequency of operation of approximately 60.8 GHz. The realized gain is approximately 11.3 dBi and with a substantially broadside radiation pattern for the PRA array 1100. The additional sidelobes and higher backlobe radiation typical of slot-coupling methods are also apparent.

Figure 22A:
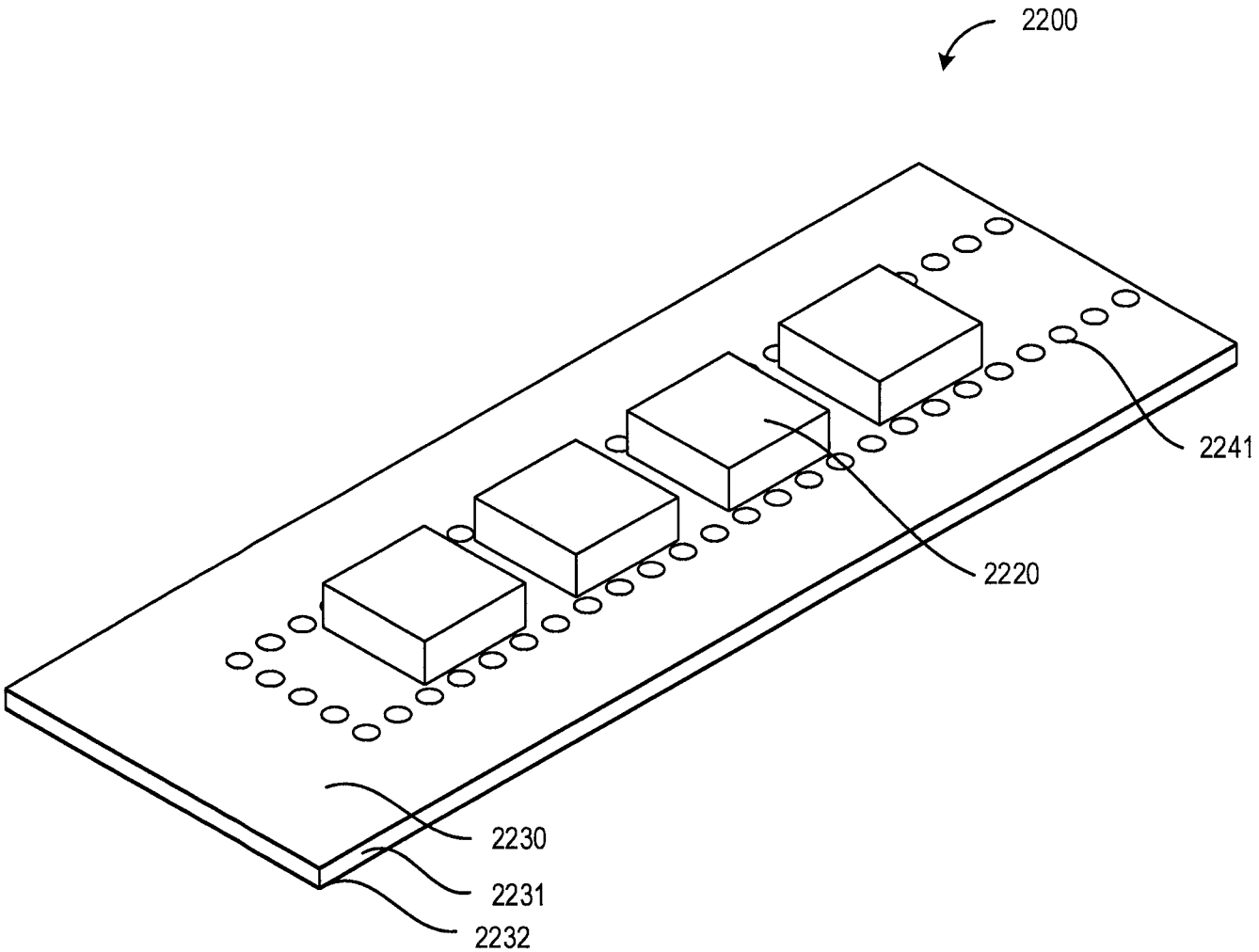
FIG. 22A is a perspective view of a substrate integrated waveguide slot-coupled PRA array.
Figure 22B:
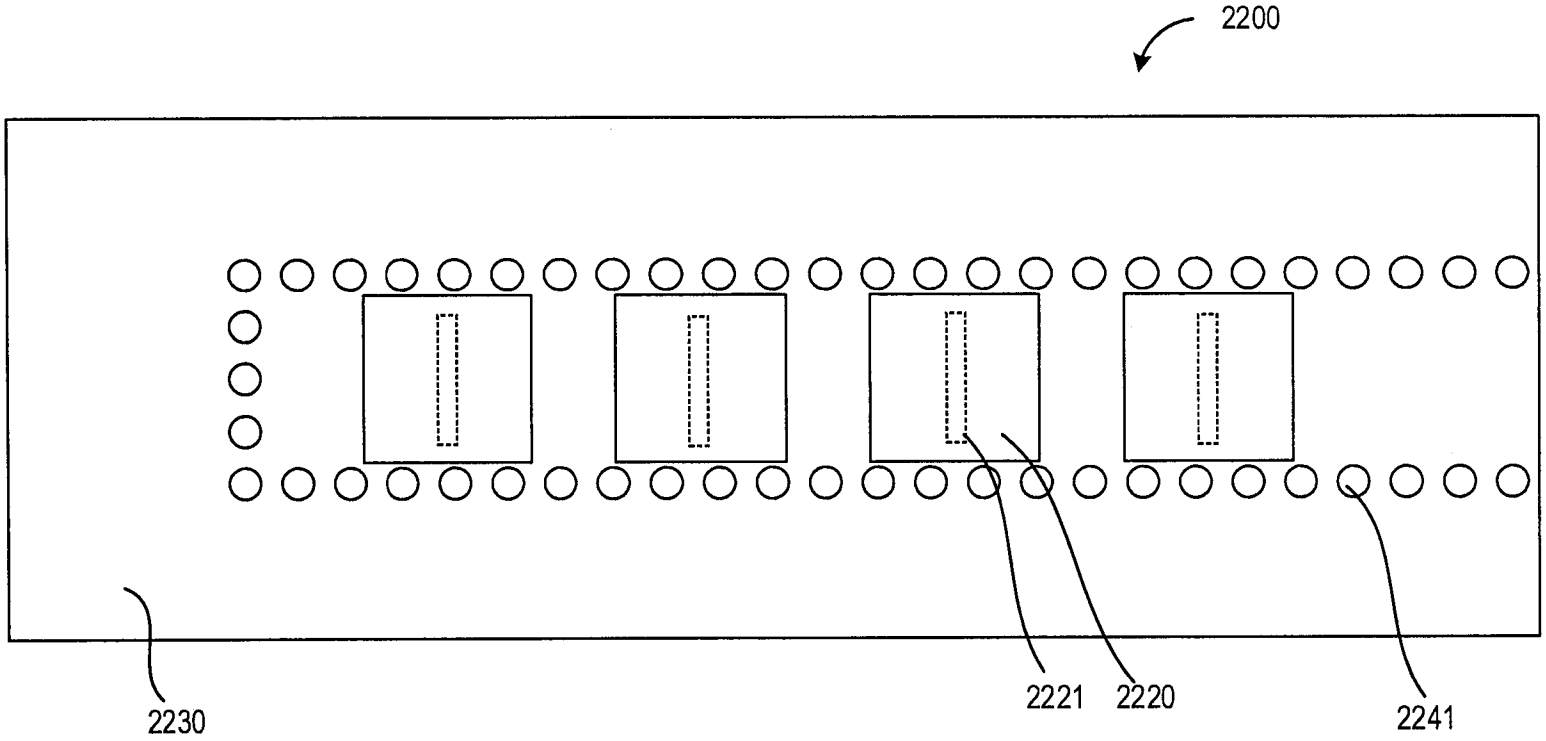
FIG. 22B is a plan view of the substrate integrated waveguide slot-coupled PRA array of FIG. 22A.

Referring now to FIGS. 22A and 22B, there are illustrated a perspective view and a plan view of another example periodically loaded single TL PRA array 2200 which is similar to PRA array 1100. However, in this embodiment the periodically loaded distribution structure is based on a periodically loaded slot coupled substrate integrated waveguide structure as an alternative to the microstrip distribution structure shown in FIG. 11A. The PRA structures sit atop metal plane 2230 of the substrate integrated waveguide distribution structure, which also includes the bottom metal plane 2232, and a dielectric layer 2231 between the top metal plane 2230 and bottom metal plane 2232. Metal vias 2241 connect the top plane 2230 and bottom plane 2232. Coupling slots 2221 are provided in the top metal plane 2230, positioned beneath the PRA elements 2220 which lie atop plane 2230. The substrate integrated waveguide structure may provide better performance than metal strip type TLs, particularly at higher millimeter-wave frequencies due to lower loss and dispersion characteristics.

The periodically loaded single TL PRA array 2200 can be fabricated as a single monolithic piece with narrow line connecting structures joining the individual array bodies as previously described (not shown in FIGS. 22A and 22B). Such periodically loaded single TL PRA array structures can also be used as sub-arrays, and generally assembled in a larger distribution scheme, employing for instance, substrate integrated waveguide based power dividers, or other types of power dividers with transitions to interface to the substrate integrated waveguides. Alternatively, multiple periodically loaded single TL sub-arrays could be fabricated together as a single monolithic piece containing all the separate periodically loaded single TL PRA sub-arrays, these separate PRAs sub-arrays being connected together by narrow wall connecting structures, to form a single monolithic piece.

Figure 22C:
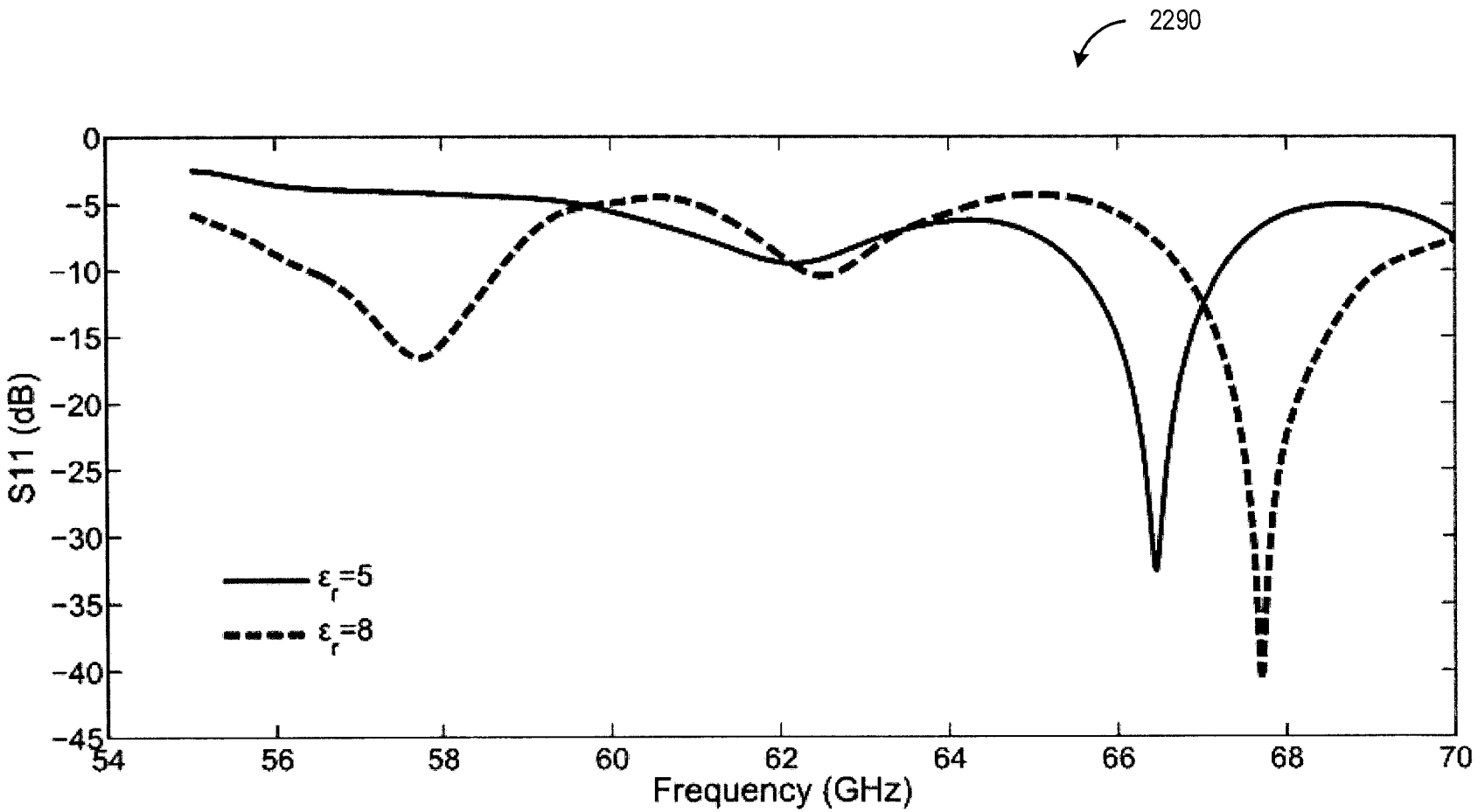
FIG. 22C is a plot of the reflection coefficient for the PRA array of FIGS. 22A and 22B with 2 different permittivities.
Figure 22D:
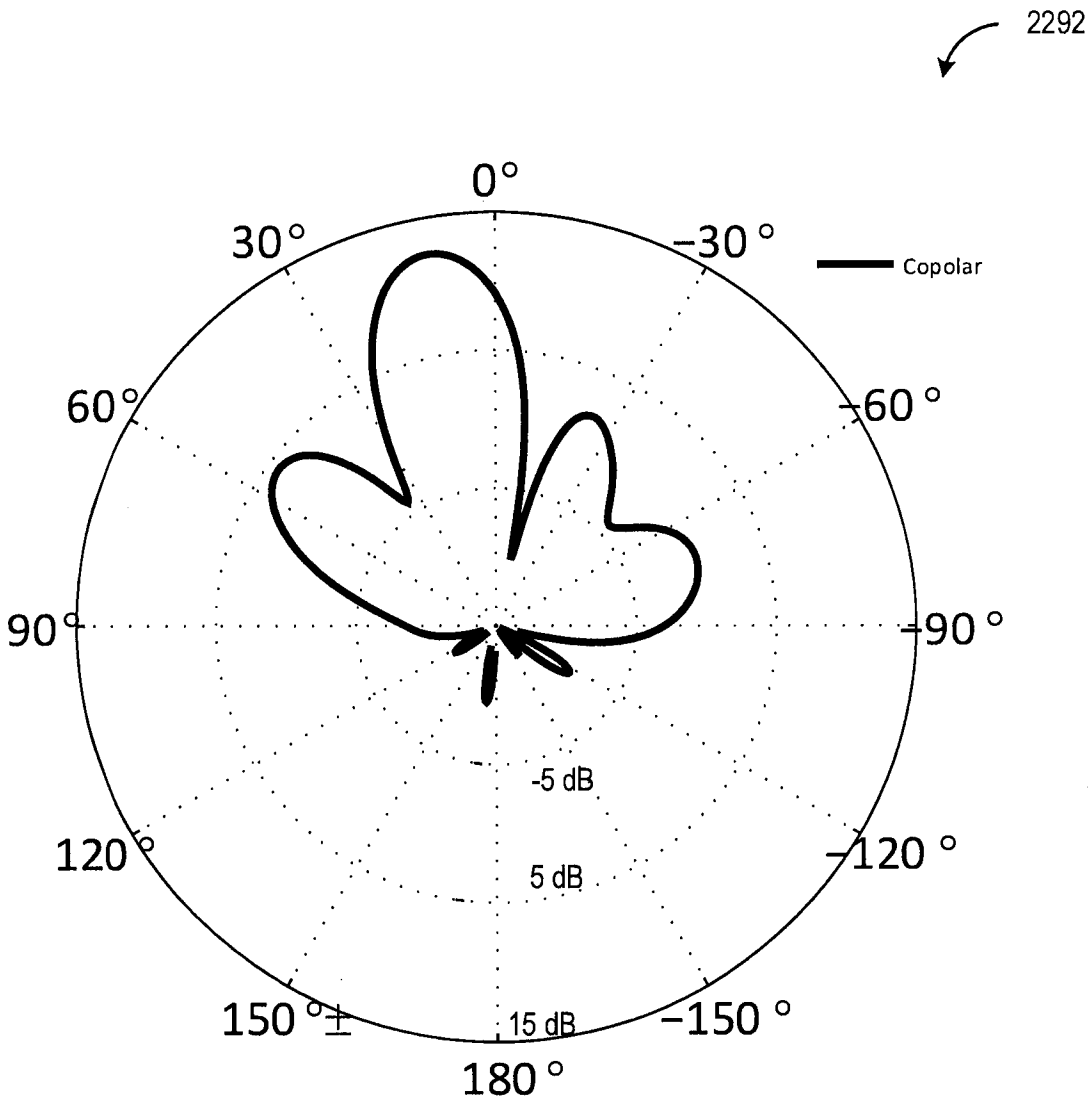
FIGS. 22D and 22E illustrate different planes perpendicular to each other and mutually perpendicular to the substrate surface, of radiation patterns showing the gain distribution for the PRA array of FIGS. 22A and 22B.
Figure 22E:
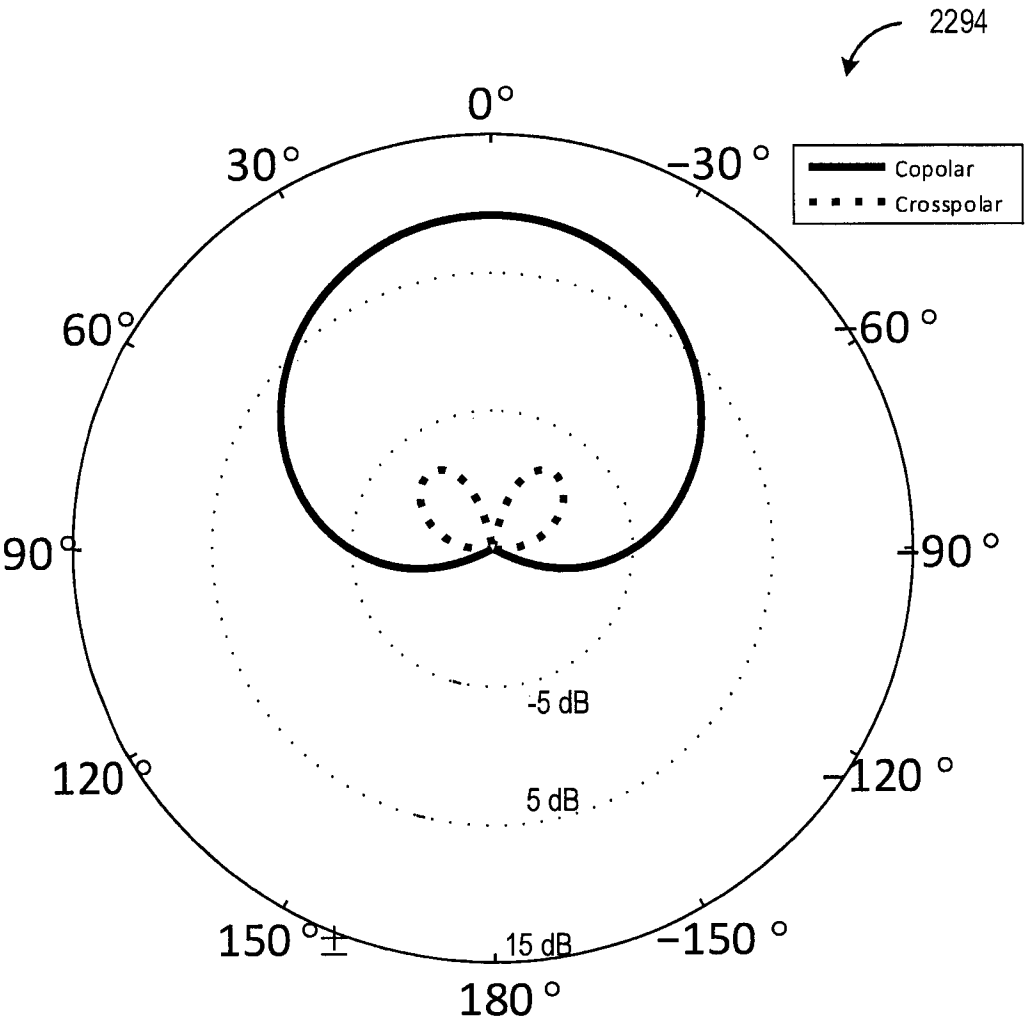

FIGS. 22C, 22D and 22E illustrate plots of sample simulation results for 4-element examples of the periodically loaded substrate integrated waveguide PRA array similar to array 2200. In this example, the PRA elements are made of low permittivity dielectric materials (two examples, one with $\varepsilon_r$=5, one with $\varepsilon_r$=8) with element dimensions (L×W×H) of 1.6 mm×1.6 mm×1.2 mm, on a 0.254 mm thick substrate (permittivity=3.6) metallized on both sides. Slots in the top metal plane are 1.1 mm (length)×0.15 mm (width). Spacing between the PRA elements is 2.5 mm. Metallized via rows are spaced at 2 mm apart, the via diameter is 0.3 mm and the pitch between vias in each row is 0.5 mm.

FIG. 22C is a plot 2290 of a reflection coefficient for two example 4-element PRA arrays with permittivities of $\varepsilon_r$=5 and $\varepsilon_r$=8, in a configuration similar to PRA array 2200. As shown in FIG. 22C, the PRA arrays resonate effectively in the 60 GHz to 70 GHz range. FIGS. 22D and 22E are plots 2292 and 2294, respectively, of different planes perpendicular to each other and mutually perpendicular to the substrate surface, showing radiation patterns that illustrate the realized gain distribution for the PRA array with $\varepsilon_r$=8. The plots 2292 and 2294 are for a frequency of operation of approximately 70 GHz. The main lobe directivity is approximately 12.4 dBi and with low cross polarization levels.

Figure 21A:
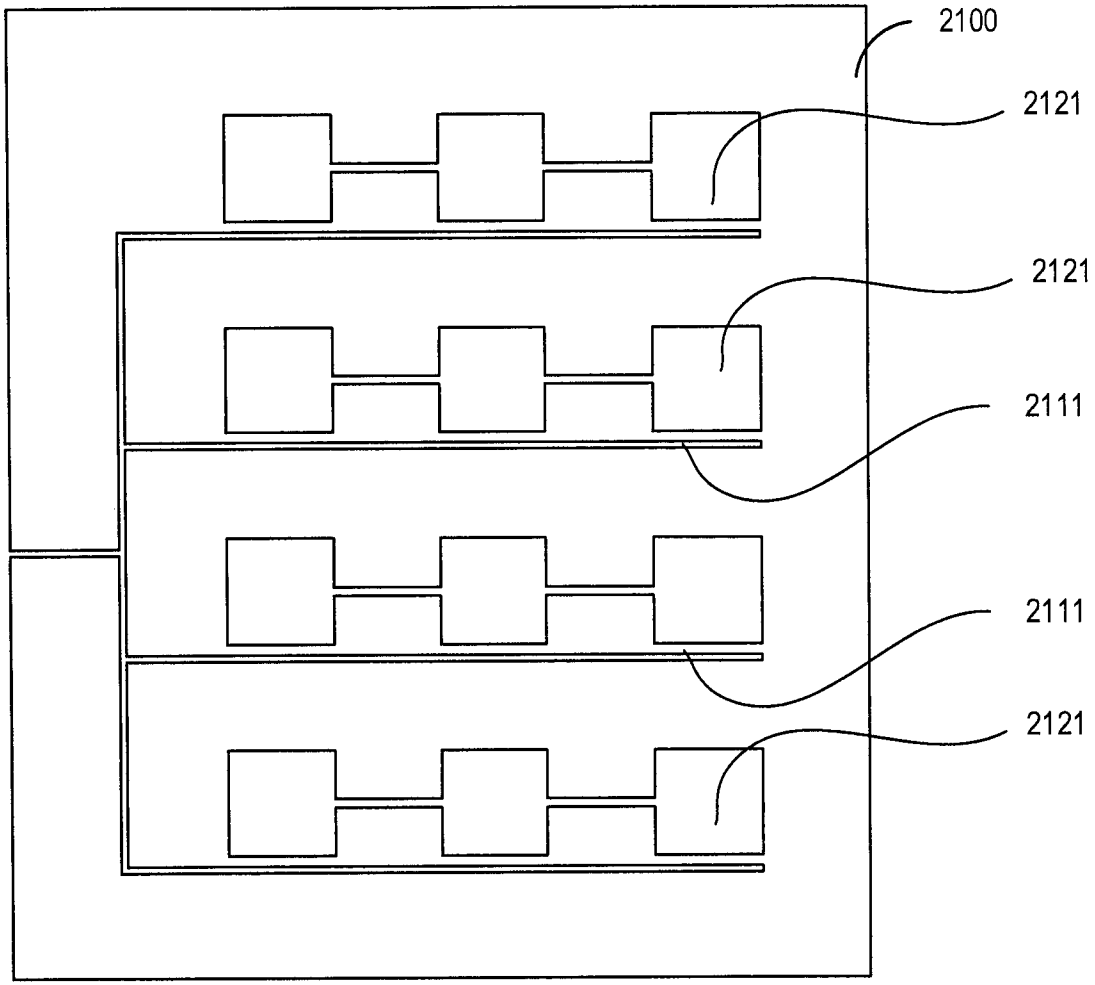
FIG. 21A is a plan view of an example PRA array template for molding of metal and/or dielectric materials.
Figure 21B:
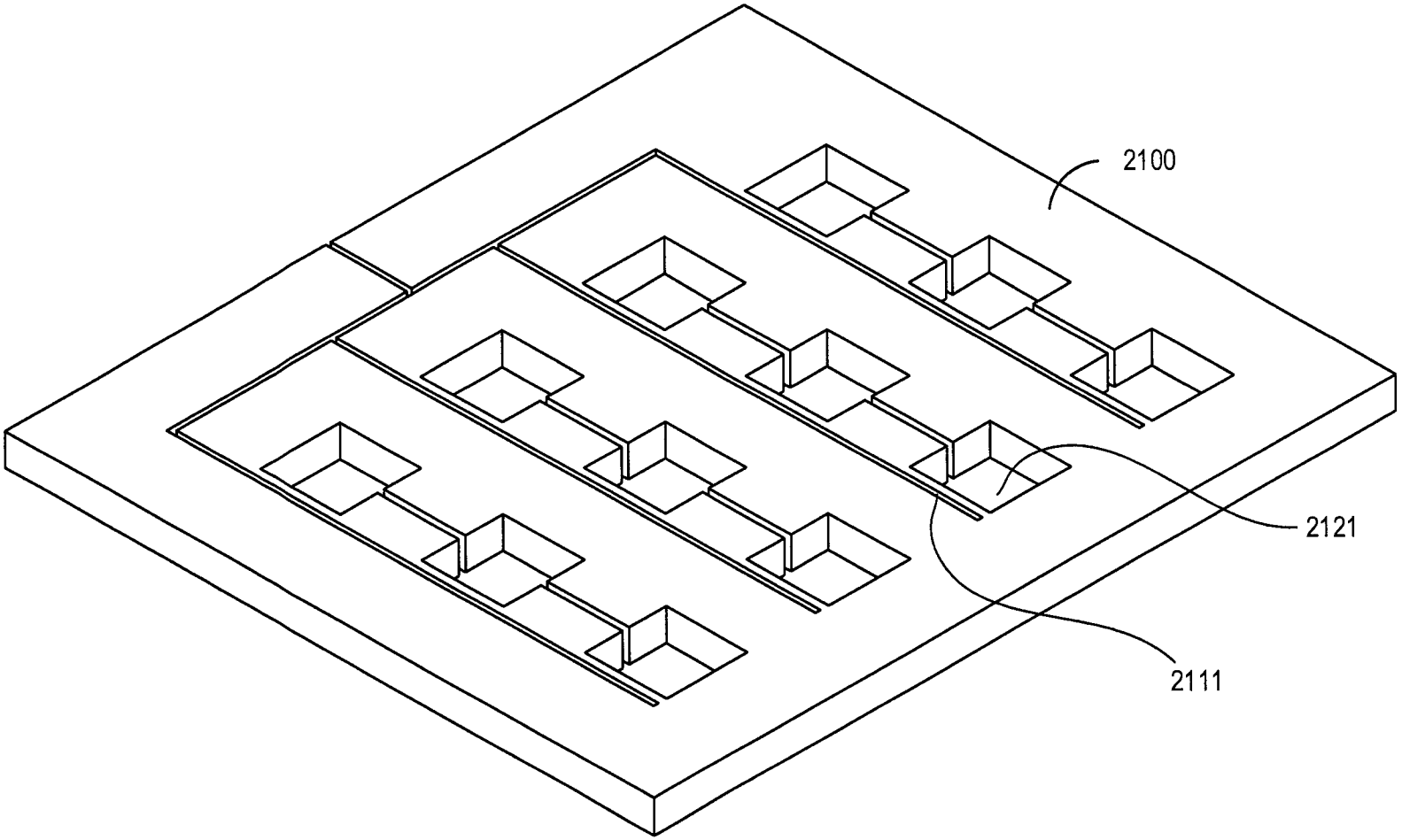
FIG. 21B is a perspective view of the template of FIG. 21A.
Figure 21C:
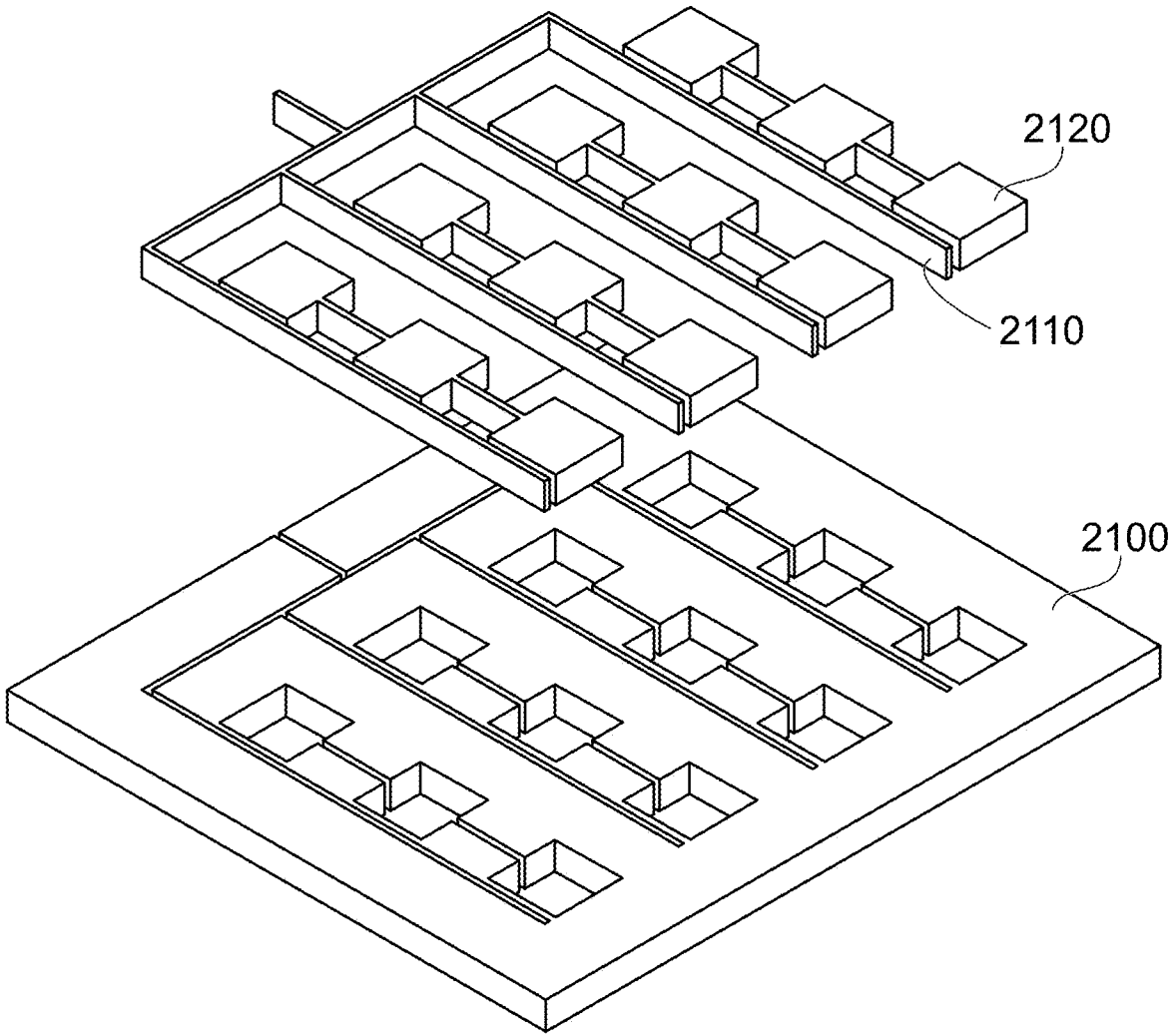
FIG. 21C is an exploded perspective view of the resonator bodies and distribution/feed structures formed in the template of FIG. 21B.
Figure 22F:
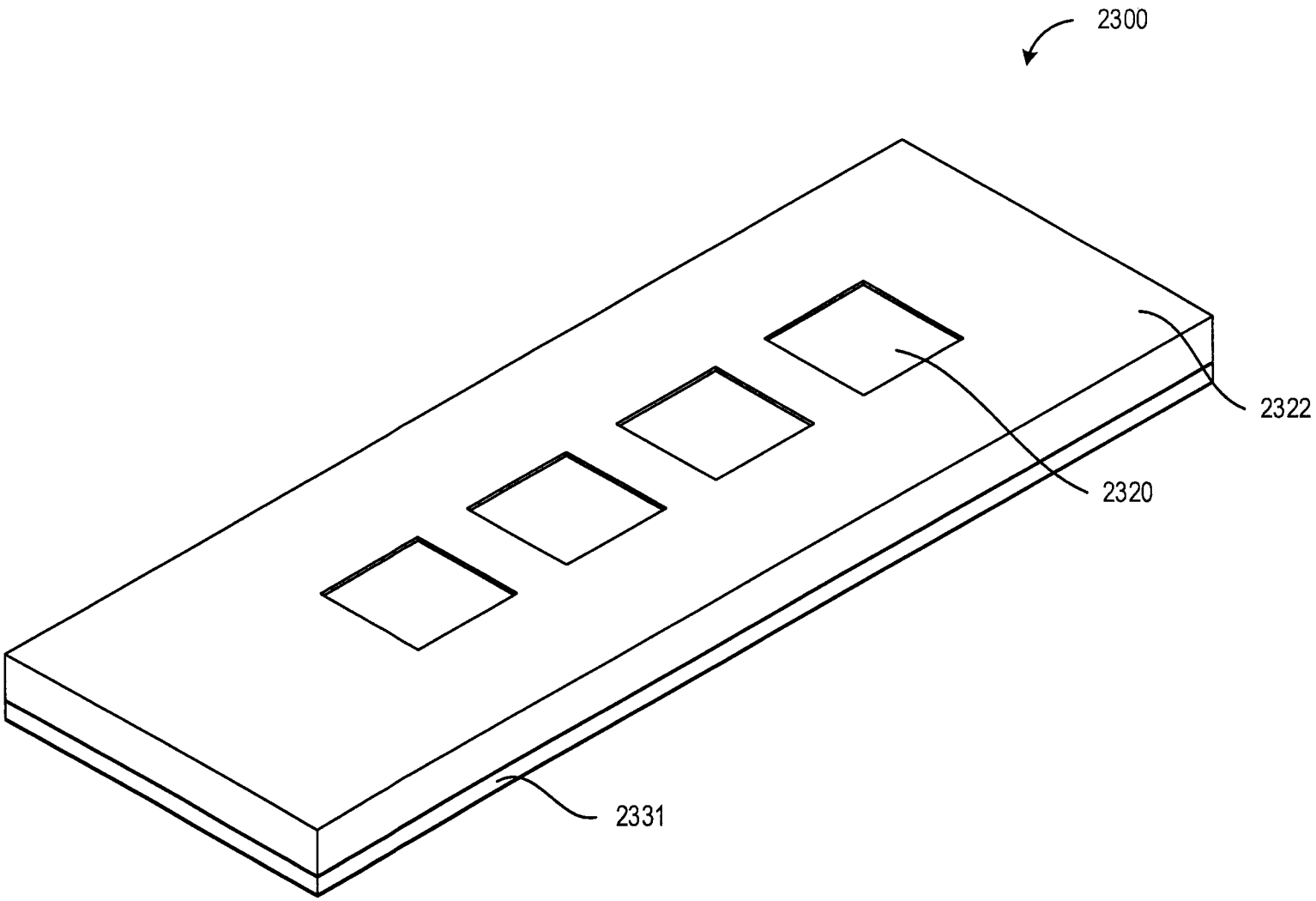
FIG. 22F is a perspective view of a substrate integrated waveguide slot-coupled PRA array realized using templating.
Figure 22G:
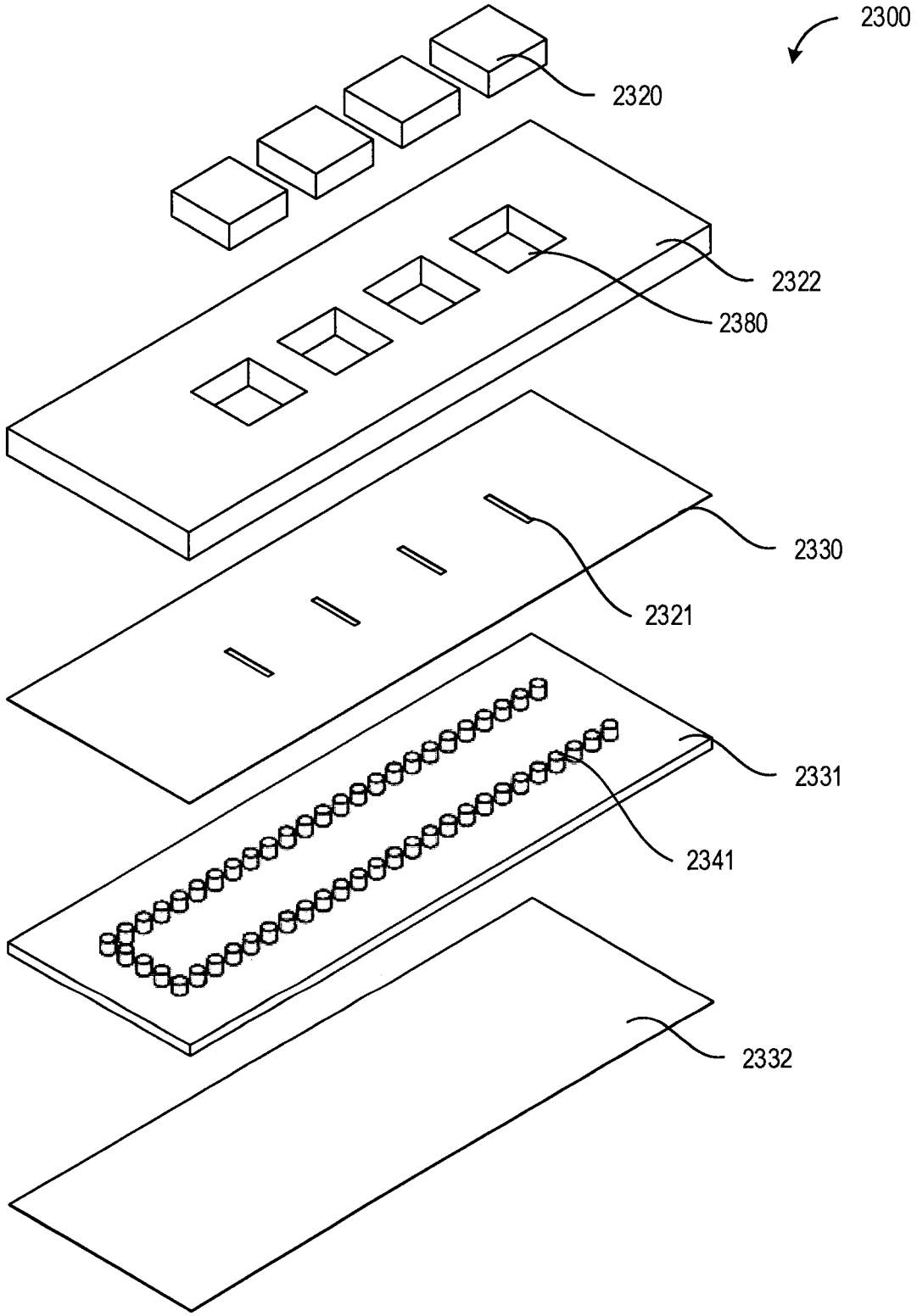
FIG. 22G is an exploded perspective view of the substrate integrated waveguide slot-coupled PRA array of FIG. 22F.

Referring now to FIGS. 22F and 22G, there are illustrated a perspective view and an exploded perspective view of another example periodically loaded single TL PRA array 2300, which is similar to PRA array 2200 in the application of a substrate integrated waveguide distribution structure. However, in embodiments such as PRA 2300 a templating approach may be used to fabricate the PRA array, similar to that described for the arrays shown in FIGS. 20A to 21C. The template formed PRA structures 2320 are provided atop a top metal plane 2330 of the substrate integrated waveguide distribution structure 2300. The templating material 2322 defines cavities 2380, which can be formed by lithography, or other microfabrication approaches, and which may be filled with a desired dielectric material to form the PRA structures 2320.

In some cases, the templating material 2322 can be retained after fabrication, or removed if desired. If the templating material 2322 is removed, the PRA arrays may resemble those shown in FIGS. 22A and 22B.

The periodically loaded single TL PRA array shown in FIGS. 22F and 22G, with the templating material 2322 retained, can be fabricated as a single layer structure which contains the PRA elements 2320 embedded in the template. As such, this templating layer can partially or completely cover the underlying distribution and coupling structures, and function as a type of lid. For example, the PRA structures 2320 may sit atop metal plane 2330 of the substrate integrated waveguide distribution structure, which also includes the bottom metal plane 2332, and a dielectric layer 2331 between the top metal plane 2330 and bottom metal plane 2332. Metal vias 2341 connect the top plane 2330 and bottom plane 2332. Coupling slots 2321 are provided in the top metal plane 2330, positioned beneath the PRA elements 2320 which lie atop plane 2330.

In this embodiments, and in others, several sub-arrays can be contained within the templating layer to form a single monolithic piece. Additionally, individual PRA elements and/or sub-arrays within a single template can be composed of different shapes, sizes, or dielectric materials.

Figure 22H:
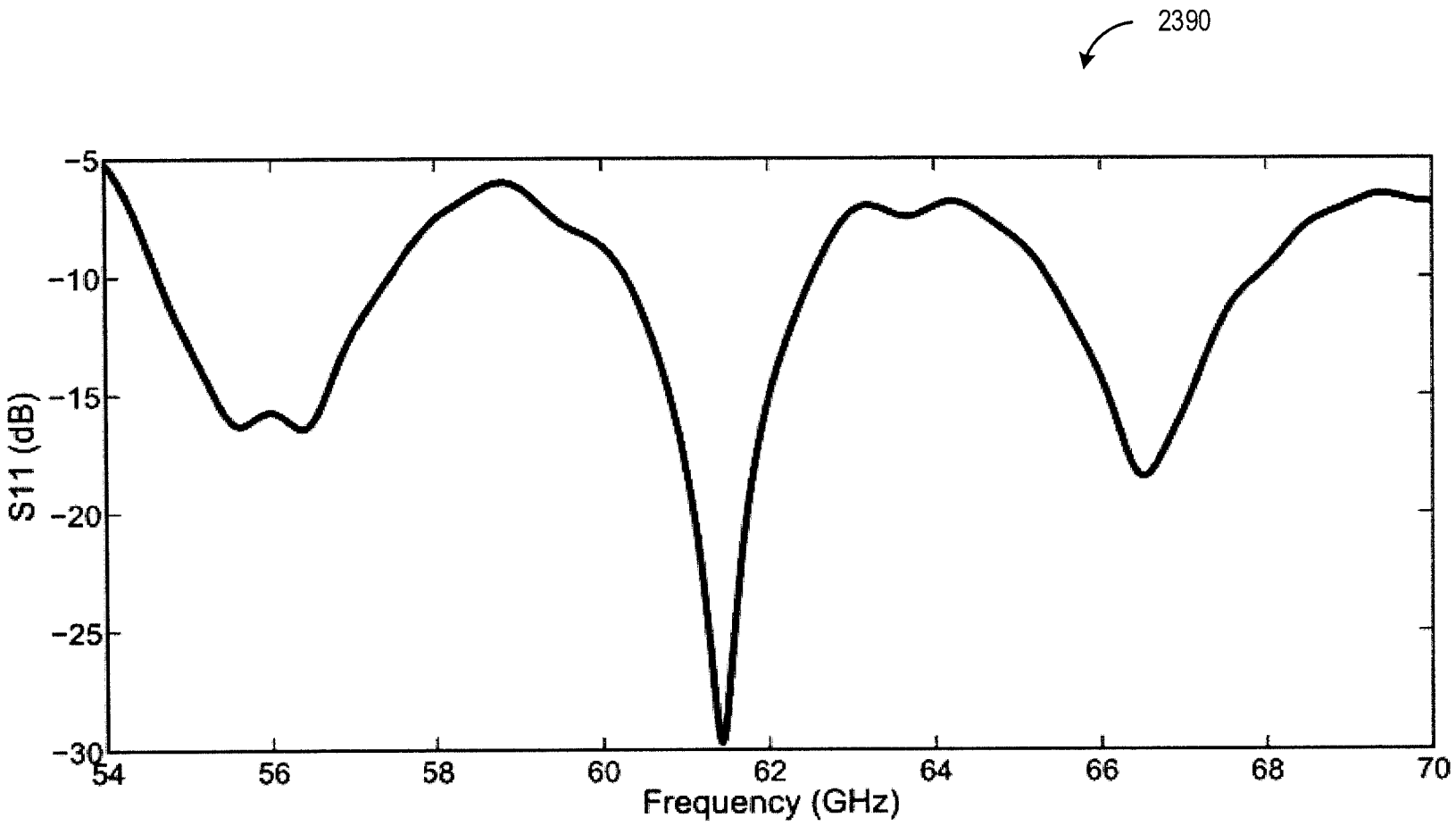
FIG. 22H is a plot of the reflection coefficient for the PRA array of FIGS. 22F and 22G.
Figure 22I:
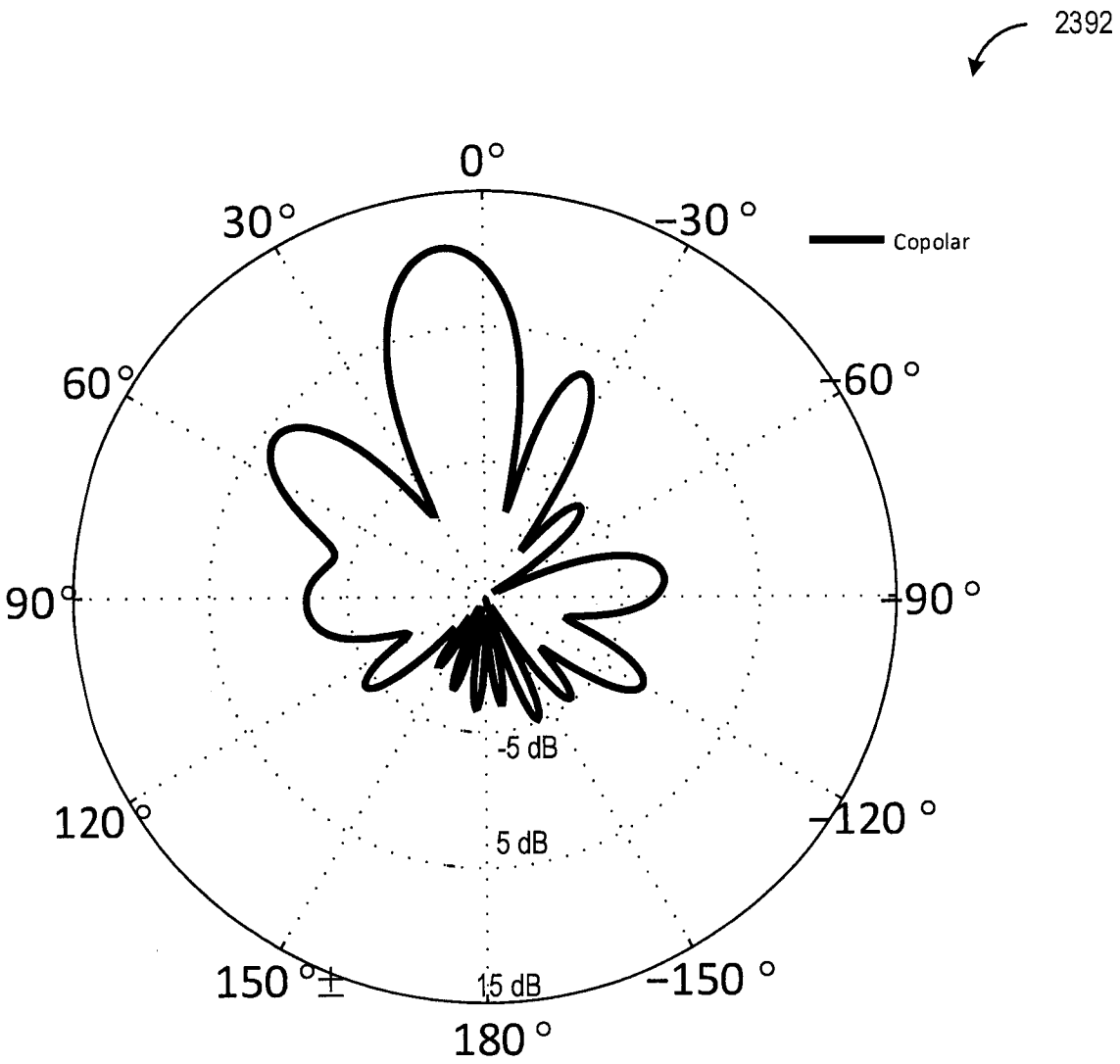
FIGS. 22I and 22J illustrate different planes perpendicular to each other and mutually perpendicular to the substrate surface, of radiation patterns showing the gain distribution for the PRA array of FIGS. 22F and 22G.
Figure 22J:
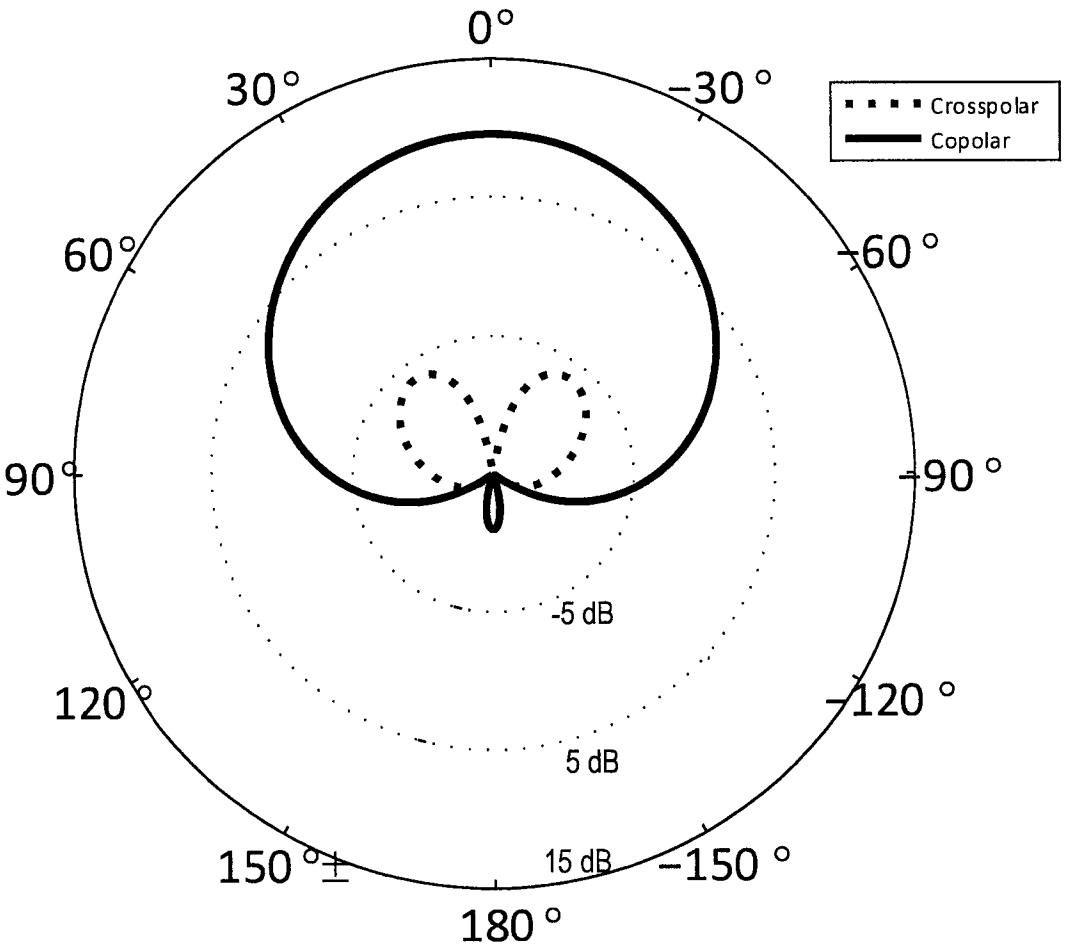

FIGS. 22H, 22I and 22J illustrate plots of sample results for a 4-element example of the periodically loaded substrate integrated waveguide PRA array with retained template, in a configuration similar to array 2300. In this example, the PRA elements within the template cavities are formed from a dielectric material ($\varepsilon_r$=7) with element dimensions (L×W×H) of 1.6 mm×1.6 mm×1.2 mm, while the surrounding templating material is a polymer with dielectric permittivity of $\varepsilon_r$=2. The template layer sits on a 0.254 mm thick substrate (permittivity=3.6) metallized on both sides. Slots in the top metal plane are 1.1 mm (length)×0.15 mm (width). Spacing between the PRA elements is 2.5 mm. Metallized via rows are spaced at 2 mm apart, the via diameter is 0.3 mm and the pitch between vias in each row is 0.5 mm.

FIG. 22H is a plot 2390 of a reflection coefficient for the example 4-element template PRA array, similar in configuration to PRA array 2300. As shown in FIG. 22H, the PRA array resonates effectively with the retained template material, in the 60 GHz to 70 GHz range. FIGS. 22I and 22J are plots 2392 and 2394, respectively, of different planes perpendicular to each other and mutually perpendicular to the substrate surface, showing radiation patterns that illustrate the realized gain distribution for the templated PRA array with $\varepsilon_r$=7 (template $\varepsilon_r$=2). The plots 2392 and 2394 are for a frequency of operation of approximately 70 GHz. The main lobe directivity is approximately 11 dBi, comparable to the performance obtained without the template, and also with low cross polarization levels. The grating lobes could possibly be reduced by further optimization of PRA element size and spacing.

Example 4—Arrays with Thick Metal Coupling Structures

PRA arrays incorporating signal distribution and coupling structures fabricated in thick metal layers can offer certain advantages, both for fabrication and also for performance. Deep penetrating lithographies, for instance deep X-ray lithography, offer the ability to create deep cavity structures in polymer-based materials. These cavities can be filled with thick metal layers as part of the processing, up to hundreds of microns or even millimeters in thickness, to provide the thick metal structures. In addition, the polymer structures can be functional PRA antenna structures or can alternatively be used as templates for injection of functional polymer dielectric materials. In this sense, these fabrication techniques allow the functional integration of thick dielectric material PRA array structures and thick metal coupling and distribution structures together in a common process and on a common substrate.

With tall metal microstrip TLs, the metal thickness is not negligible and can be on the order of the height of the DRA element. Other thick metal TLs could also be employed, for instance tall metal CPW, tall metal slotline, or tall metal parallel standing strips. A thick metal TL offers additional performance advantages, for instance for strongly coupling energy into the elements, due to increased vertical metal cross-sectional area and increased coupling capacitance. This makes them especially useful for exciting low permittivity PRA elements, typical of polymer and polymer-based materials.

Two example thick metal feed structures for PRA array elements are shown in perspective view in FIGS. 12A and 13A. FIG. 12A shows a tall metal TL side coupled microstrip line and FIG. 13A shows a tall metal TL end coupled microstrip line. Both of these configurations can be in direct contact with the PRA array element, or in close proximity, separated by an air gap or a gap filled with dielectric material.

FIG. 12A illustrates an antenna structure 1200 with a single PRA antenna element 1201 excited by a tall metal TL side coupled microstrip line 1205. In this example, the PRA element 1201 is formed of a polymer composite material ($\varepsilon_r$=10) with dimensions (L×W×H) of 7 mm×9 mm×4 mm, on a 1.5 mm thick quartz glass substrate 1220 (εr=3.78). In this case, the tall metal microstrip line 1205 is in direct contact with the PRA element 1201, and is 1.5 mm high and therefore is comparable to the height of the PRA element 1201 (in this case, 38% of the height). Generally, the thickness of the tall metal microstrip line 1205 can range from 10%-100% of the height of the PRA element.

Figure 12B:
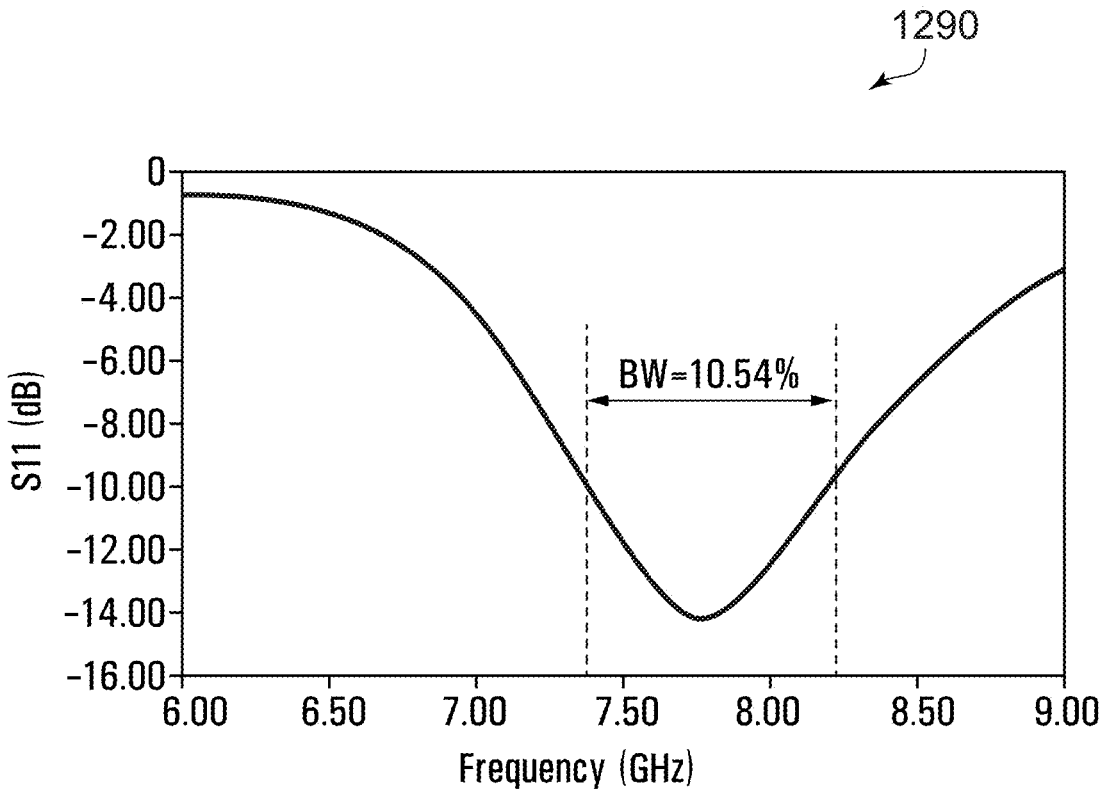
FIG. 12B is a plot of a reflection coefficient for the PRA element of FIG. 12A.

FIG. 12B is a plot 1290 of reflection coefficient as a function of frequency for the single element PRA antenna structure 1200. Plot 1290 demonstrates that the single PRA tall metal TL side coupled element 1201 resonates at 7.8 GHz with a good match, and has a large −10 dB bandwidth of 10.5%, suggesting the feed structure is appropriate for successful excitation of low permittivity single antenna array elements.

Figure 12C:
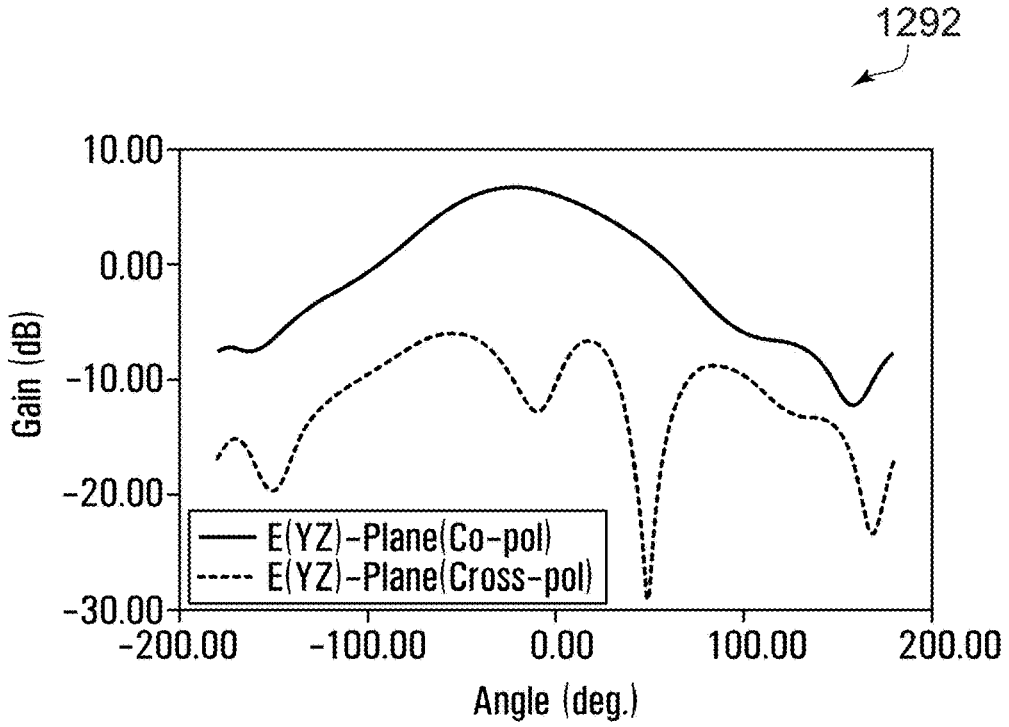
FIGS. 12C and 12D illustrate different planes perpendicular to each other and mutually perpendicular to the substrate surface, of radiation patterns showing the realized gain distribution for the PRA of FIG. 12A.
Figure 12D:
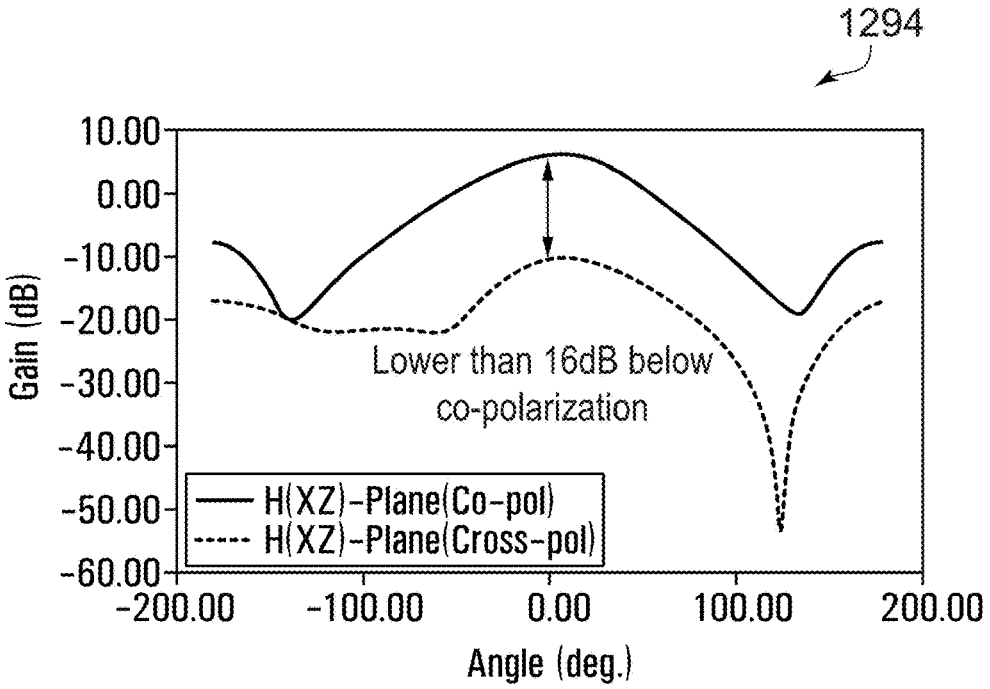

FIGS. 12C and 12D illustrate plots 1292 and 1294, respectively, of the gain as a function of radiation direction for single PRA antenna element 1201. The realized gain at resonance is quite high at around 6.1 dBi, and there may be a slight skew in the radiation direction of maximum gain in one plane due to the asymmetric feeding scheme.

Similar to the sidewall coupled configuration described with reference to FIG. 2A, the tall metal TL side coupled feeding of structure 1200 can also reduce the resonant frequency of the antenna elements as well as provide relatively low side lobe and back radiation level. In this single element example, the resonant frequency is reduced from approximately 9.0 GHz to 7.8 GHz (approximately 13%).

FIG. 13A illustrates an antenna structure 1300 with a single PRA antenna element 1301 excited by a tall metal TL end coupled microstrip line 1305. In this example, the PRA element 1301 is assumed to be made of a low permittivity polymer composite material ($\varepsilon_r$=5) with dimensions (L×W×H) of 3.1 mm×3.3 mm×1.7 mm, on a 1 mm thick quartz glass substrate 1320 ($\varepsilon_r$=3.78). In this case, the tall metal end-coupled microstrip TL 1305 is in direct contact with the PRA element 1301, and is 0.6 mm high and therefore, is comparable to the height of the PRA element 1301 (in this case, 35% of the height). Generally, the thickness of the tall metal microstrip line 1305 can range from 10% to 100% of the height of the PRA element 1301.

Figure 13B:
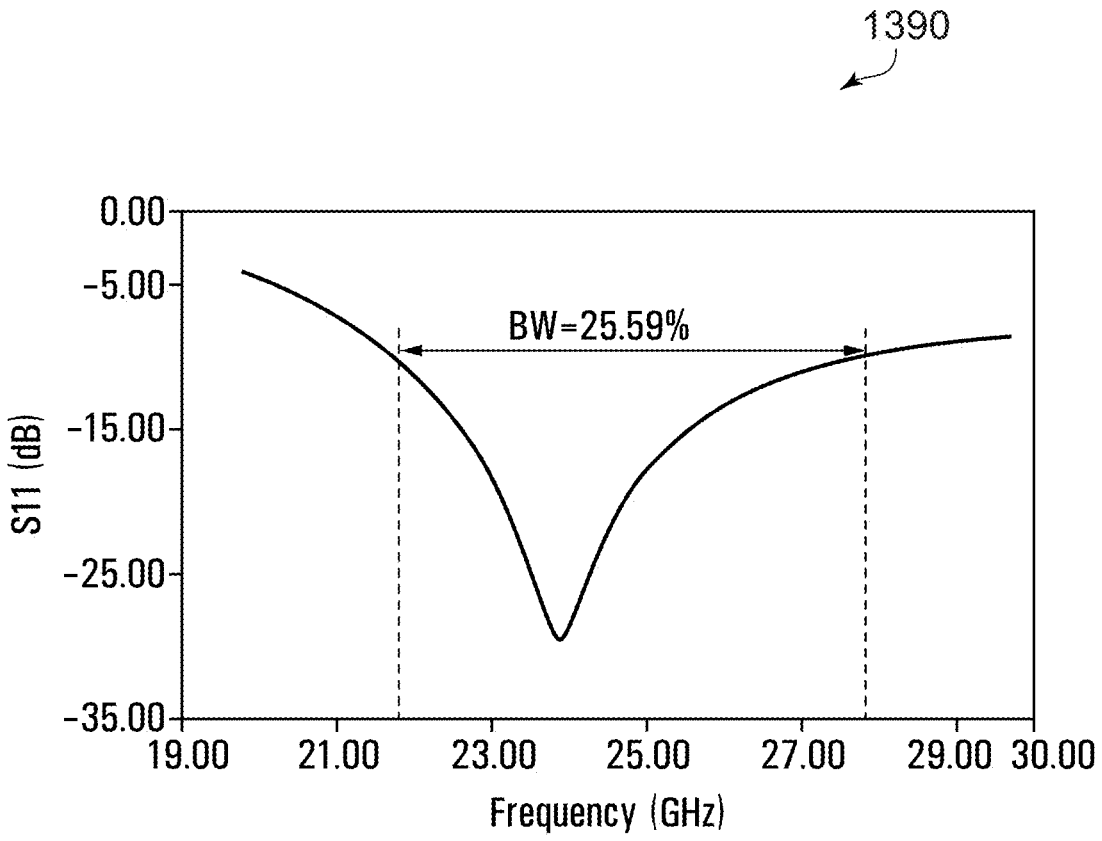
FIG. 13B is a plot of a reflection coefficient for the PRA of FIG. 13A.

FIG. 13B is a plot 1390 of reflection coefficient as a function of frequency for the single element PRA antenna structure 1300. Plot 1390 demonstrates that the example single PRA tall metal TL end coupled element 1301 resonates at 23.8 GHz with a good match, and has a large −10 dB bandwidth of 25.6% suggesting the structure 1300 is appropriate for successful excitation of low permittivity single antenna array elements.

Figure 13C:
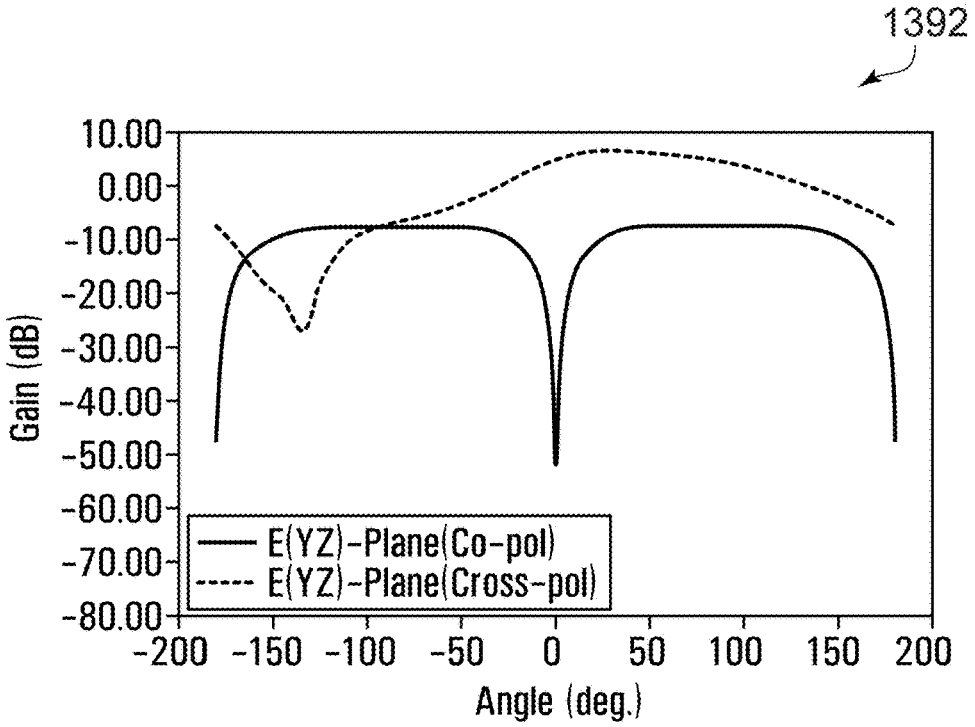
FIGS. 13C and 13D illustrate different planes perpendicular to each other and mutually perpendicular to the substrate surface, of radiation patterns showing the realized gain distribution for the PRA of FIG. 13A.
Figure 13D:
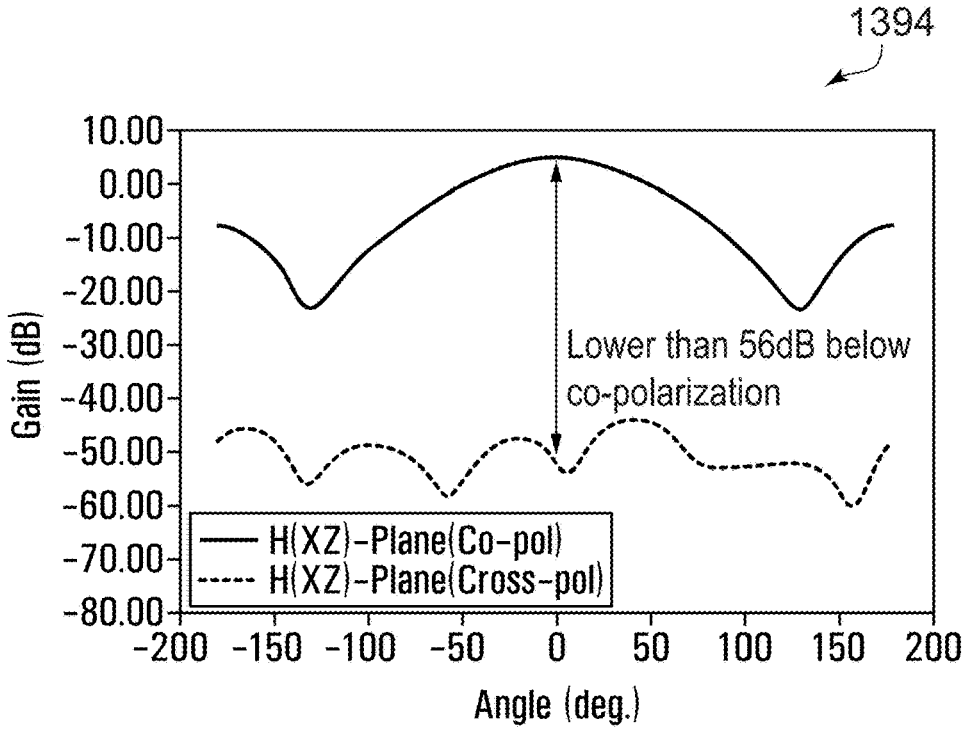

FIGS. 13C and 13D illustrate plots 1392 and 1394, respectively, of the gain as a function of radiation direction for single PRA antenna element 1301. The realized gain at resonance is at around 4.9 dBi, and there may be a slight skew in the radiation direction of maximum gain in one plane due to the asymmetric feeding scheme.

Similar to the tall metal TL side coupled feeding of structure 1200, the tall metal TL end coupled feeding of structure 1300 can also reduce the resonant frequency of the antenna elements as well as provide relatively low side lobe and back radiation level. In this single element example, the resonant frequency is reduced from approximately 27.4 GHz to 23.8 GHz (approximately 13%).

Signal divider type distribution networks similar to distribution structure 100 shown in thin planar microstrip TL can be implemented in thick metal microstrip TL versions. In such cases, the end coupled thick microstrip coupling structure described for antenna structure 1300 may be appropriate for terminating the feedlines 132*a* and 132*b* and interfacing to the PRA elements.

Figure 12E:
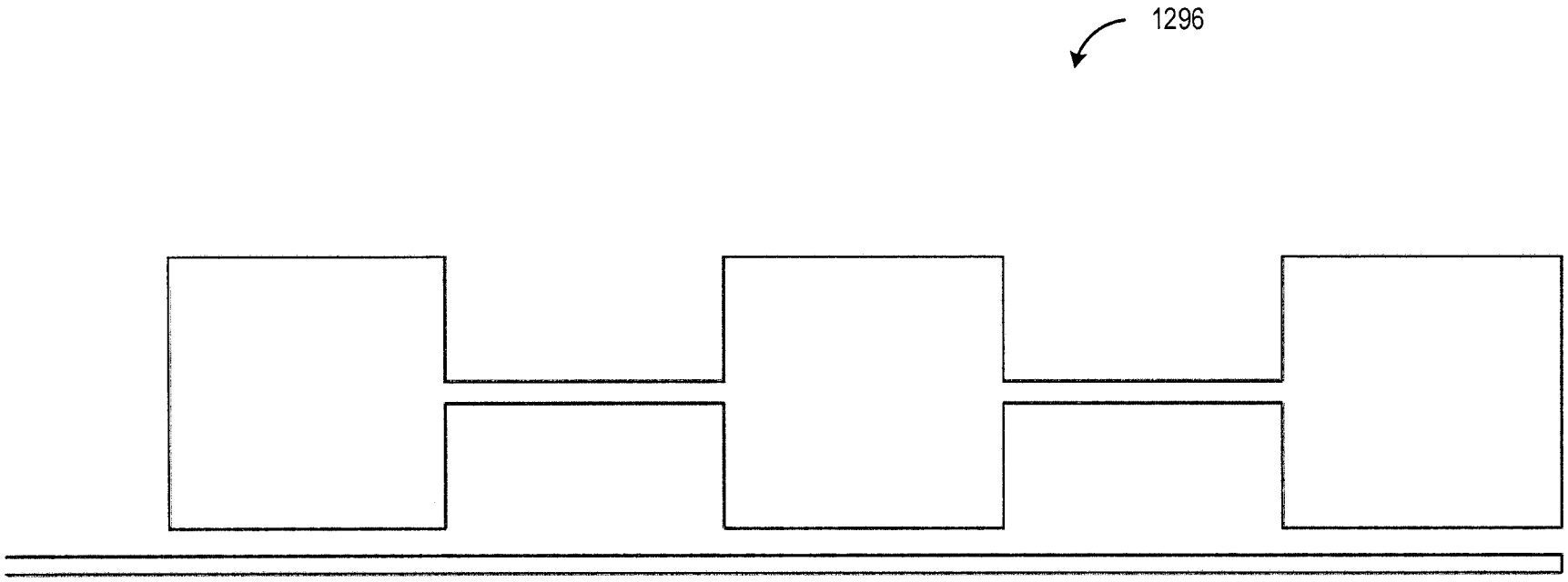
FIG. 12E is a plan view of an antenna array incorporating a similar antenna structure to FIG. 12A.
Figure 12F:
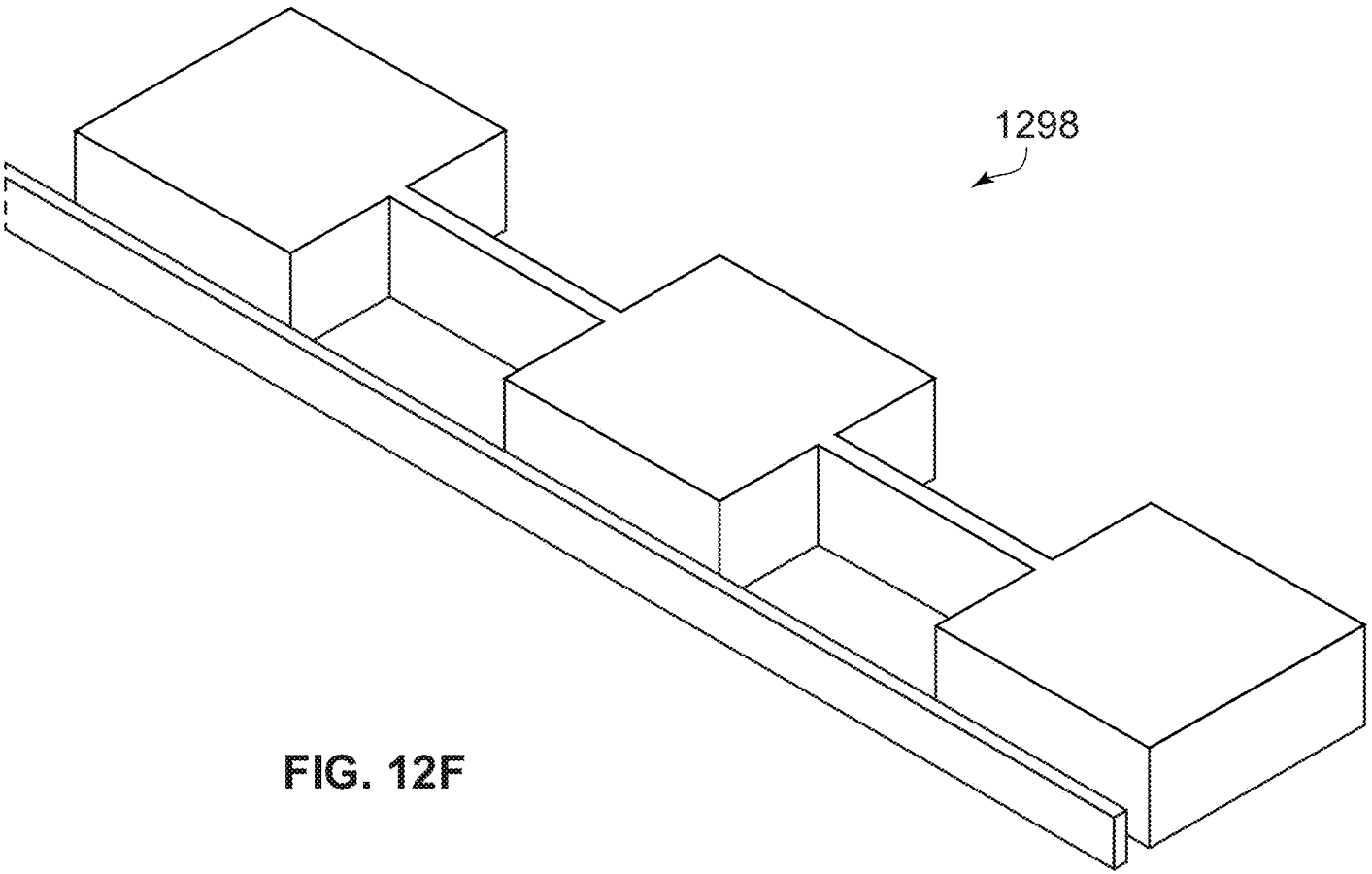
FIG. 12F is a perspective view of an antenna array incorporating a similar antenna structure to FIG. 12A.

Alternatively, the thick metal TLs may also function well with signal distribution structures where the TL is periodically loaded by the PRA array elements, and in which signal power is transferred to the elements from the common TL as it travels down the loaded tall TL. In one example, additional PRA elements may be added along the TL in a similar fashion to that described with reference to FIG. 11A for a slot-coupled configuration, but in this case along a tall transmission line shown in FIGS. 12E and 12F (in plan and perspective view, respectively), whereby the elements are all fed in a side-coupled manner. Another form physically tees off of the main TL at certain load points, and interfaces to the PRA elements in an end-coupled manner as shown in FIG. 13A. A plan view of this second form is shown in FIG. 14A, and is described in more detail below as an example embodiment.

Figure 14A:
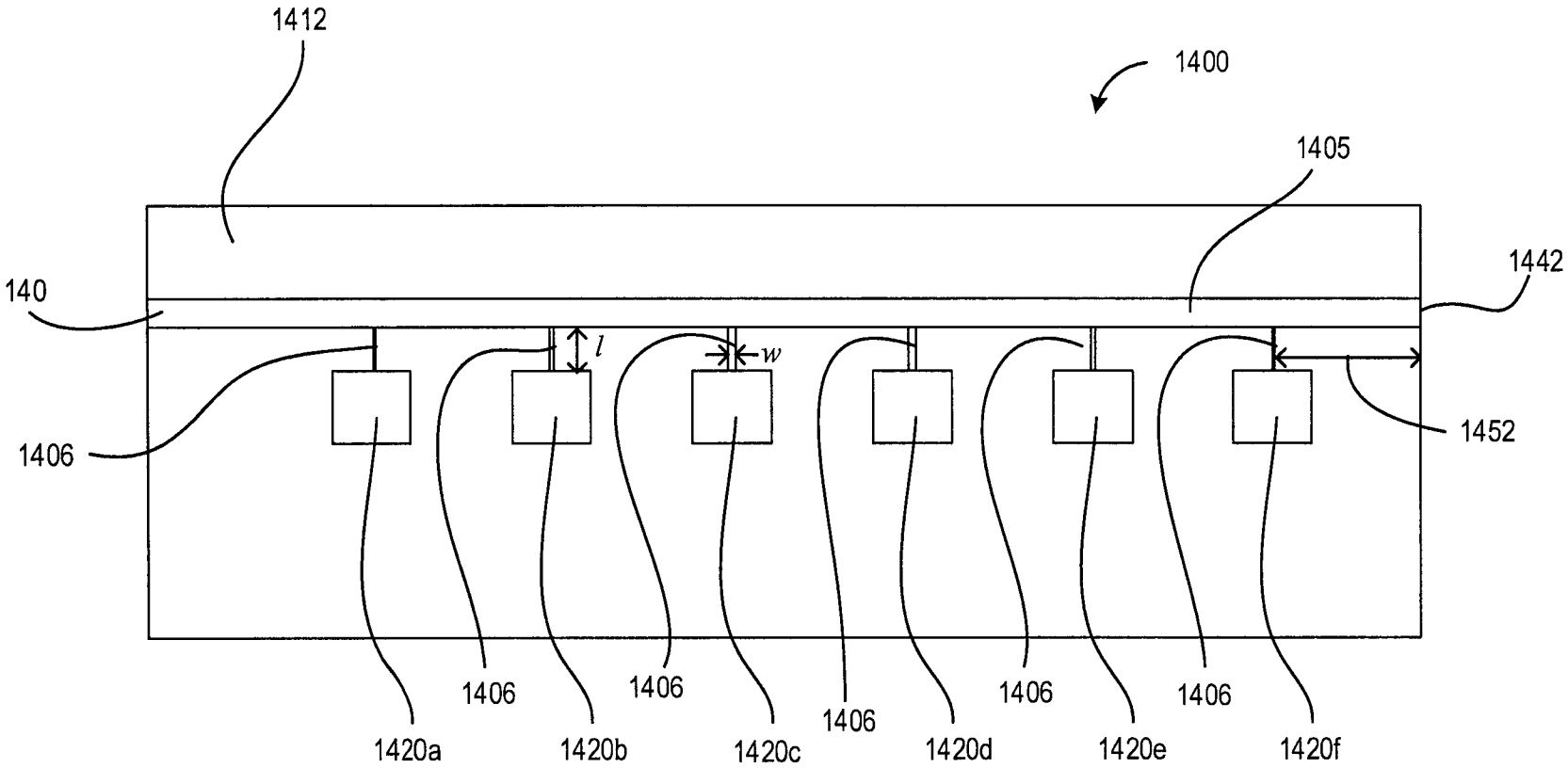
FIG. 14A is a plan view of a periodically tee-loaded single tall TL end-coupled PRA array.

Referring now to FIG. 14A, there is illustrated a plan view of a periodically tee-loaded single tall TL end-coupled PRA array 1400. As described elsewhere herein, the PRA array elements may be formed in a single monolithic structure, with individual elements connected together by narrow-wall structures formed of the same material as the PRA elements, and combined with a tall metal TL distribution and coupling structure.

An alternative fabrication approach is to fabricate all tall metal structures and dielectric PRA element structures in a common deep lithography process (for instance deep X-ray lithography) or other suitable microfabrication process.

Referring now to FIGS. 21A to 21C, there is illustrated a PRA constructed using a template process. FIG. 21A is a plan view of a template 2100. FIG. 21B is a perspective view of template 2100. FIG. 21C is an exploded perspective view of template 2100, resonator bodies 2120 and distribution and coupling structure 2110.

Template 2100 may be formed of a templating material, such as a thick dielectric polymer or polymer-composite material or a pure photoresist, and defines one or more resonator body apertures 2121, along with one or more distribution and coupling structure apertures 2111.

In some cases, template 2100 may be formed using a two-mask fabrication process, in which a first mask is used to define distribution and coupling structure channels 2111 in the templating material, into which channels metal may be deposited. A second mask is used to define the resonator body apertures 2121 in the templating material, which may then be filled up with the desired dielectric material.

In some cases, templating material can be retained after fabrication, or removed if desired.

Referring again to FIG. 14A. Array 1400 includes an example single tall metal microstrip distribution line 1405, which may be nickel, for example, and have a nominal impedance of 50 ohms, with a height of 0.2 mm. Distribution line 1405 is loaded by tee-lines 1406 of typically the same metal height, but with varying width. The 50 ohm distribution line 1405 is terminated in an open circuit termination 1442 after the last PRA element 1420*f* opposing signal input port 140, the distance 1452 from this open circuit termination 1442 to the last tee-line 1406 feeding element 1420*f* is approximately one wavelength in this example (or generally a multiple of wavelength) of the main signal frequency so as to minimally load the last element 1420*f*. The widths of the tee-lines 1406 are selected in a symmetrical fashion to provide a PRA element impedance function generally representing a certain array distribution (e.g., for the example, a Dolph-Chebyshev six element array, with coefficients of 1, 1.437, 1.850, 1.850, 1.437, 1). The tall metal tee-structures 1406 feed six low permittivity polymer composite material ($\varepsilon_r$=5) PRA elements 1420*a* to 1420*f*, with dimensions (L×W×H) of 3.1 mm×3.3 mm×1.7 mm, on a 1 mm thick quartz glass substrate 1412 ($\varepsilon_r$=3.78).

Figure 14B:
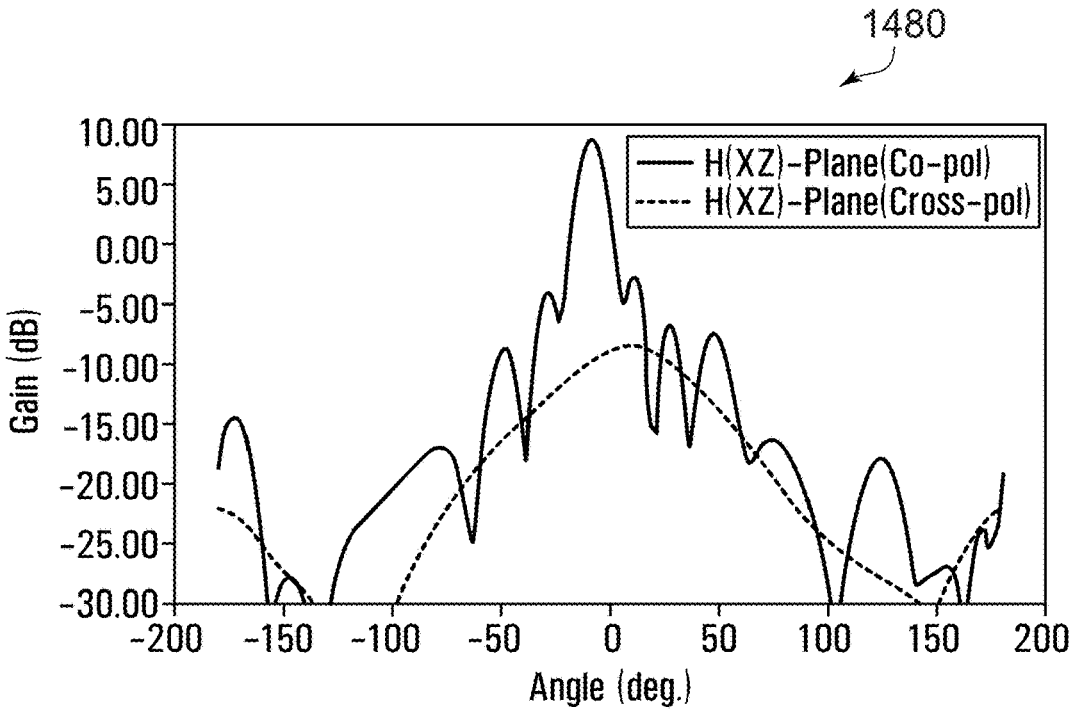
FIGS. 14B and 14C illustrate different planes perpendicular to each other and mutually perpendicular to the substrate surface, of radiation patterns showing the realized gain distribution for the PRA array of FIG. 14A.
Figure 14C:
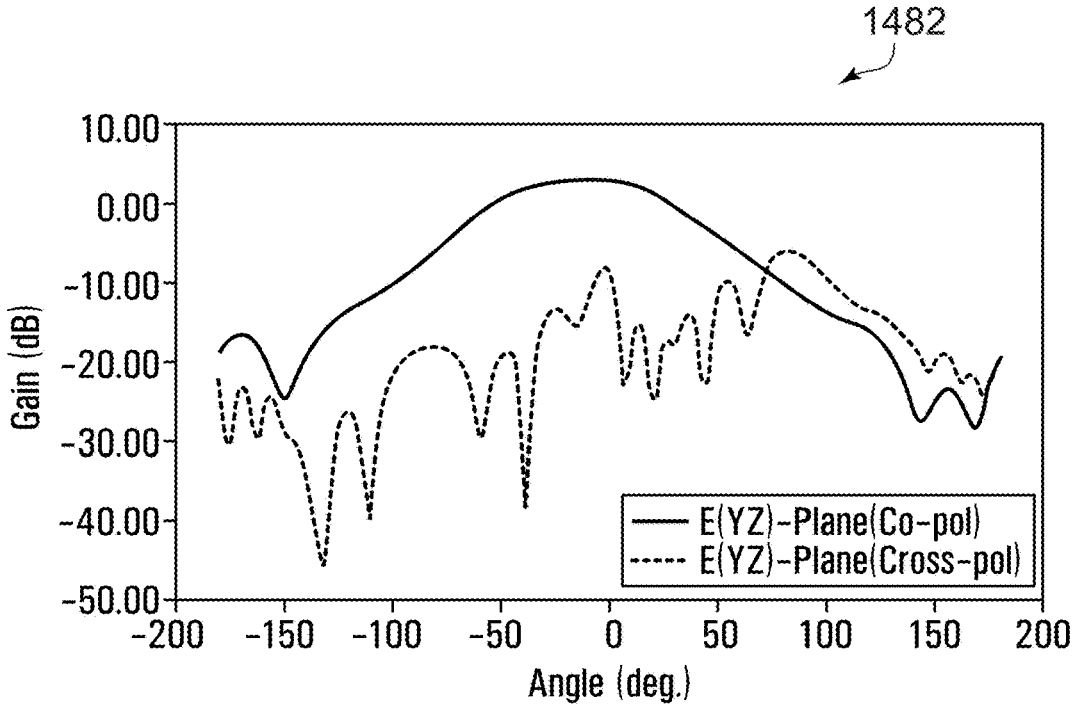
Figure 14D:
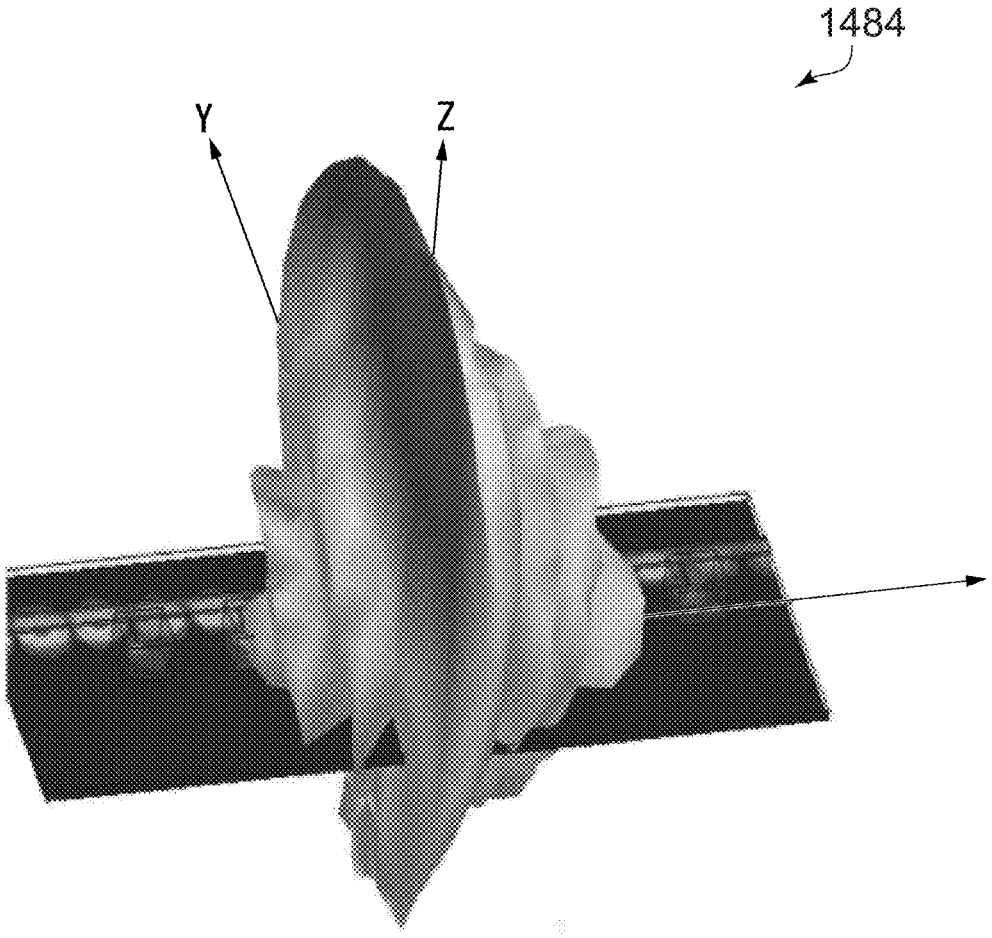
FIG. 14D illustrates the radiation patterns showing the realized gain distribution for the PRA array of FIG. 14A.
Figure 14E:
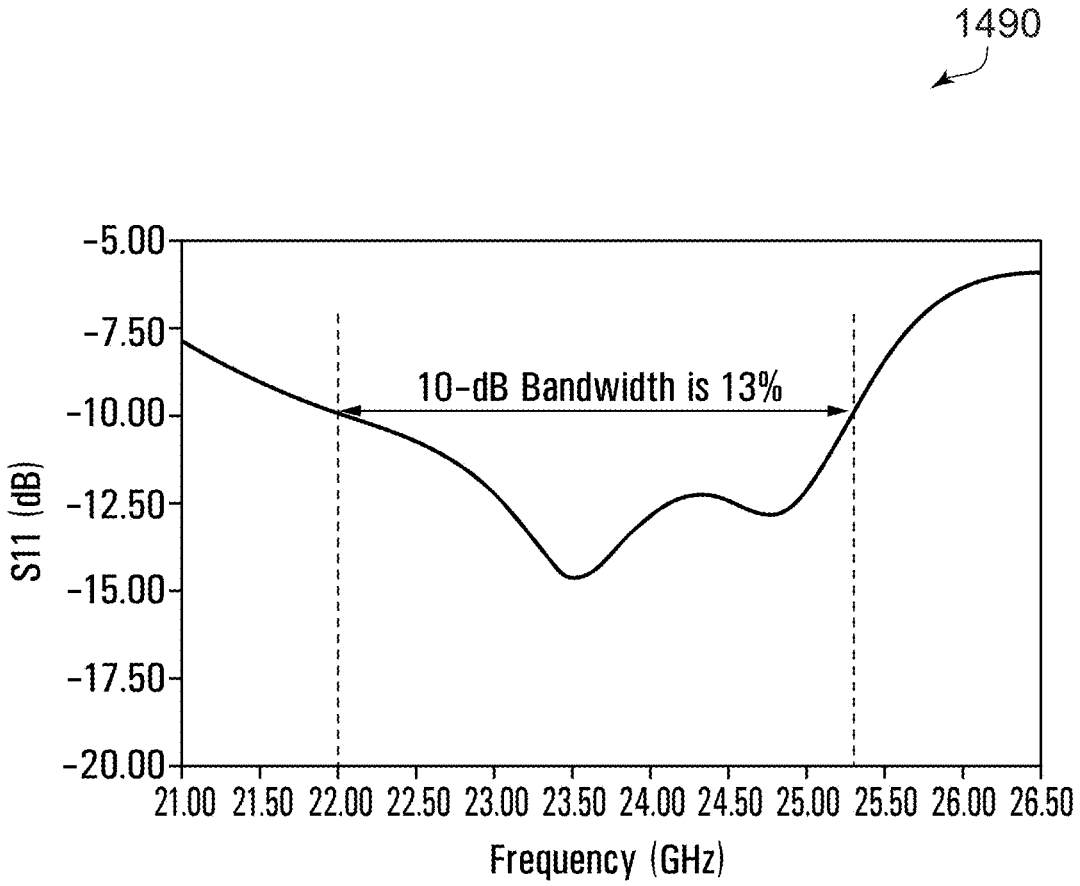
FIG. 14E is a plot of a reflection coefficient for the PRA array of FIG. 14A.

FIGS. 14B, 14C, 14D, and 14E, illustrate plots of sample results for the periodically tee-loaded single tall TL end-coupled PRA array 1400. FIG. 14E is a plot 1490 of a reflection coefficient for the PRA array 1400. As shown in FIG. 14E, the −10 dB bandwidth for the PRA array 1400 is approximately from 22.0 GHz to 25.3 GHz, which is approximately a 14% bandwidth. FIGS. 14B and 14C illustrate different planes 1480 and 1482, respectively, perpendicular to each other and mutually perpendicular to the substrate surface, of radiation patterns showing the realized gain distribution for the PRA array 1400. The planes 1480 and 1482 are illustrated at a frequency of operation of approximately 23.5 GHz. The realized gain is approximately 9 dBi in the broadside radiation pattern direction, however the main lobe is slightly tilted as seen at 1484 in FIG. 14D, and the gain at the peak in the narrow mainlobe pattern is somewhat higher. The radiation pattern roughly matches the expected Dolph-Chebyshev array distribution over +60 to −60 degrees, and the symmetry could be improved through further optimization or periodically changing the direction of the PRA elements in distribution line 1405.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments. Various modifications and variations may be made to these exemplary embodiments without departing from the scope of the invention, which is limited only by the appended claims.

We claim:

1. A dielectric resonator antenna array comprising:

a substrate with a first planar surface;

a template with a top surface and a bottom surface opposite the top surface, the bottom surface of the template disposed on the first planar surface of the substrate, the template defining a plurality of cavities extending from the bottom surface toward the top surface and substantially through the template;

a plurality of dielectric resonator bodies, embedded respectively within the plurality of cavities of the template, and disposed on the first planar surface of the substrate, wherein each of the resonator bodies is spaced apart from each other, wherein each of the resonator bodies has a relative permittivity in the range between 2 and 12;

a plurality of coupling structures, each of the coupling structures operatively coupled to a respective one of the resonator bodies to provide an excitation signal thereto; and a signal distribution structure operatively coupled to the plurality of coupling structures to provide the excitation signal thereto.

2. The dielectric resonator antenna array of claim 1, wherein the signal distribution structure comprises a plurality of feedlines, each of the feedlines operatively coupled to at least one of the coupling structures.

3. The dielectric resonator antenna array of claim 1, wherein the signal distribution structure further comprises at least one transmission line.

4. The dielectric resonator antenna array of claim 1, wherein each of the resonator bodies is connected to at least one other of the resonator bodies via a wall structure.

5. The dielectric resonator antenna array of claim 4, wherein the resonator bodies form a single monolithic structure.

6. The dielectric resonator antenna array of claim 4, wherein the resonator bodies form an array of sub-arrays, wherein the sub-arrays are formed as separate monolithic structures.

7. The dielectric resonator antenna array of claim 3, wherein the at least one transmission line is a thick metal transmission line that has a metal thickness between 10% and 100% of a thickness of the plurality of resonator bodies.

8. The dielectric resonator antenna array of claim 1, wherein each of the plurality of coupling structures is provided under a respective resonator body in proximity to and substantially parallel to the planar surface.

9. The dielectric resonator antenna array of claim 1, wherein each of the plurality of coupling structures is a tapered respective section of the signal distribution structure.

10. The dielectric resonator antenna array of claim 1, wherein each of the plurality of coupling structures is provided by a slot defined in the planar surface beneath a respective resonator body.

11. The dielectric resonator antenna array of claim 1, wherein each of the plurality of coupling structures terminates in proximity to a respective resonator body substantially perpendicularly to the planar surface.

12. The dielectric resonator antenna array of claim 11, wherein each of the plurality of coupling structures has a height between 10% and 100% of the respective resonator bodies.

13. The dielectric resonator antenna array of claim 1, wherein each of the plurality of coupling structures is embedded within a respective resonator body substantially perpendicularly to the planar surface.

14. The dielectric resonator antenna array of claim 1, wherein each of the feedlines is a tee-line that branches off at least one main feedline.

15. The dielectric resonator antenna array of claim 1, wherein the signal distribution structure is periodically loaded by the plurality of resonator bodies.

16. The dielectric resonator antenna array of claim 1, wherein the dielectric resonator bodies are formed of polymer-based materials.

17. A method of fabricating a dielectric resonator antenna array, the method comprising:

providing a substrate with at least a first planar surface;

providing a template with a top surface and a bottom surface opposite the top surface, the bottom surface of the template disposed on the first planar surface of the substrate;

defining a plurality of cavities in the template, each of the plurality of cavities extending from the bottom surface toward the top surface and substantially through the template;

embedding a plurality of polymer-based resonator bodies within the plurality of cavities of the template and on the first planar surface, wherein each of the bodies is spaced apart from each other, wherein each of the resonator bodies has a relative permittivity in the range between 2 and 12;

providing a plurality of feed coupling structures on the first planar surface, each of the coupling structures positioned to operatively couple to a respective one of the resonator bodies to provide an excitation signal thereto; and providing a signal distribution structure to operatively couple to the plurality of coupling structures to provide the excitation signal thereto.

18. The method of claim 17, wherein at least one of the plurality of resonator bodies is coupled to at least one other of the resonator bodies by a wall structure.

19. The method of claim 17, wherein the template is provided by depositing at least one polymer-based material;

exposing the at least one polymer-based material to a lithographic source via a pattern mask, wherein the pattern mask defines each of the plurality of cavities;

developing a portion of the at least one polymer-based material;

removing one of an exposed portion and an unexposed portion of the at least one polymer-based material to reveal the plurality of cavities, and wherein the plurality of polymer-based resonator bodies are embedded by filling the plurality of cavities with at least one other of the at least one polymer-based material to form the respective polymer-based resonator bodies.

20. The method of claim 17, wherein the dielectric resonator bodies are formed of polymer-based materials.

21. A method of fabricating a dielectric resonator antenna array, the method comprising:

providing a substrate with at least a first planar surface;

providing a mold that is retained on the substrate, the mold defining a plurality of cavities shaped to define a plurality of resonator bodies disposed on the first planar surface, wherein each of the cavities is spaced apart from each other;

filling the plurality of cavities with a first dielectric material to form the resonator bodies, wherein the first dielectric material has a relative permittivity in the range between 2 and 12;

providing a plurality of feed coupling structures on the first planar surface, each of the coupling structures positioned to operatively couple to a respective one of the resonator bodies to provide an excitation signal thereto; and providing a signal distribution structure to operatively couple to the plurality of coupling structures to provide the excitation signal thereto.

22. The method of claim 21, wherein the mold further defines at least one coupling cavity shaped to define the plurality of feed coupling structures, and wherein the plurality of feed coupling structures are provided by depositing a conductive material within the at least one coupling cavity.

23. The method of claim 21, wherein the mold further defines at least one distribution cavity shaped to define the signal distribution structure, and wherein the signal distribution structure is deposited within the at least one distribution cavity.

24. The method of claim 21, wherein the mold is defined by lithography.

25. The method of claim 21, further comprising, prior to providing the mold, initially providing the mold on a sacrificial substrate, wherein the cavities are filled on the sacrificial substrate, further comprising removing the mold and the resonator bodies from the sacrificial substrate, and transferring the mold and the resonator bodies to the first planar surface.

26. The method of claim 21, wherein the dielectric resonator bodies are formed of polymer-based materials.

27. The method of claim 21, wherein the mold has a plurality of layers, the layers formed by repeating the forming, the exposing, the developing and the removing at least once.

* * * * *